US009462885B2

(12) United States Patent
Cohen et al.

(10) Patent No.: US 9,462,885 B2
(45) Date of Patent: Oct. 11, 2016

(54) BATHING AREA ACCESSORIES

(71) Applicant: Kohler Co., Kohler, WI (US)

(72) Inventors: Ben Cohen, Sheboygan, WI (US); Greta Knowles, Sheboygan, WI (US); Erin Lilly, Kohler, WI (US); Thomas Lilly, Kohler, WI (US); Alan McDonald, Sheboygan, WI (US); Jeff Tempas, Oostburg, WI (US); Luke Zimbric, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/743,737

(22) Filed: Jun. 18, 2015

(65) Prior Publication Data

US 2015/0366342 A1 Dec. 24, 2015

Related U.S. Application Data

(60) Provisional application No. 62/015,214, filed on Jun. 20, 2014.

(51) Int. Cl.
*A47K 3/022* (2006.01)
*A47B 81/00* (2006.01)
(Continued)

(52) U.S. Cl.
CPC ..... *A47B 81/00* (2013.01); *A47B 5/00* (2013.01); *A47B 5/02* (2013.01); *A47B 47/0075* (2013.01);
(Continued)

(58) Field of Classification Search
CPC .... A47B 81/00; A47B 57/00; A47B 81/002; A47B 96/061; A47B 47/0075; A47B 96/021; A47K 3/125; A47K 3/281
USPC ..... 211/85.12, 119.009, 119.011; 4/548, 4/596, 605, 614; D23/275, 283, D23/303–305; 312/242, 245, 405.1
See application file for complete search history.

(56) References Cited

U.S. PATENT DOCUMENTS 1,077,199 A * 10/1913 James ..... A47C 19/22 297/188.1
1,632,668 A * 6/1927 Murphy ..... A47K 3/08 4/550
(Continued)

FOREIGN PATENT DOCUMENTS

CN 202457198 10/2012
DE 298 12 245 U1 9/1998

OTHER PUBLICATIONS

Extended European Search Report on Application 15173031.4, dated Nov. 6, 2015.

*Primary Examiner* — Joshua J Michener
*Assistant Examiner* — Devin Barnett
(74) *Attorney, Agent, or Firm* — Foley & Lardner LLP

(57) ABSTRACT

A bathing area accessory may be used within a bathing area. The bathing area accessory may be a bathing area shelving assembly, a bathing area bar assembly, a storage assembly, a bathing area seat assembly, or a shaving ledge assembly. The shelving assembly for use within a bathing area may include a niche and at least one shelf that is attachable to, removable from, and reattachable to the attachment portions of the niche. The niche may include attachment portions that receive and secure the at least one shelf. The niche may include two sidewalls that extend substantially vertically along a vertical length of the niche. The attachment portions may be on the two sidewalls and the at least one shelf may attach with a pair of the attachment portions that are vertically aligned with each other.

16 Claims, 53 Drawing Sheets

(51) Int. Cl.

| | |
|---|---|
| ***A47K 3/28*** | (2006.01) |
| ***A47B 57/00*** | (2006.01) |
| ***A47B 96/06*** | (2006.01) |
| ***A47B 47/00*** | (2006.01) |
| ***A47B 96/02*** | (2006.01) |
| ***A47K 3/00*** | (2006.01) |
| ***E04F 19/08*** | (2006.01) |
| ***A47C 3/18*** | (2006.01) |
| ***A47C 7/02*** | (2006.01) |
| ***A47C 9/06*** | (2006.01) |
| ***A47C 16/02*** | (2006.01) |
| ***A47B 5/00*** | (2006.01) |
| ***A47B 5/02*** | (2006.01) |
| ***A47K 3/12*** | (2006.01) |

(52) U.S. Cl.

CPC ..... *A47B 57/00* (2013.01); *A47B 81/002* (2013.01); *A47B 96/02* (2013.01); *A47B 96/021* (2013.01); *A47B 96/06* (2013.01); *A47B 96/061* (2013.01); *A47C 3/18* (2013.01); *A47C 7/02* (2013.01); *A47C 9/06* (2013.01); *A47C 16/025* (2013.01); *A47K 3/001* (2013.01); *A47K 3/125* (2013.01); *A47K 3/281* (2013.01); *A47K 3/282* (2013.01); *E04F 19/08* (2013.01)

(56) References Cited

U.S. PATENT DOCUMENTS 2,171,663 A * 9/1939 Marchand ..... A47B 67/02 126/42
D125,639 S * 3/1941 Larson ..... D6/675.1
2,439,664 A 1/1945 Marchand
2,572,463 A * 10/1951 Fine ..... A47K 3/04 4/549
2,911,275 A * 11/1959 Wise ..... A47B 96/00 312/242
3,003,644 A * 10/1961 Hildebrand ..... A47B 73/002 211/181.1
3,004,815 A * 10/1961 O'Kain ..... A47B 67/005 312/242
3,314,741 A * 4/1967 Litner ..... A47B 55/00 312/242
3,351,403 A * 11/1967 Magnuson ..... A47B 61/00 211/186
3,449,773 A * 6/1969 Seib ..... A47K 3/004 4/549
D225,995 S * 1/1973 Alexander ..... D23/275
D238,275 S * 12/1975 Folden ..... D23/275
3,997,060 A * 12/1976 Kunin ..... A47F 5/01 211/133.2
D243,849 S * 3/1977 Seymour ..... D23/275
D252,585 S * 8/1979 Clow ..... D23/275
4,234,094 A * 11/1980 Jorgensen ..... A47J 47/16 211/106
4,319,792 A * 3/1982 Britt ..... A47B 67/02 108/107
4,424,598 A 1/1984 Cima
D278,120 S * 3/1985 Grant ..... D9/521
4,581,858 A * 4/1986 Clark ..... E04B 2/7407 312/209
D284,689 S * 7/1986 King ..... D23/304
4,681,380 A 7/1987 Carlin
4,728,158 A * 3/1988 D'Elia ..... A47B 57/06 211/184
4,919,280 A * 4/1990 Phillips ..... A47F 5/08 211/187
5,029,792 A * 7/1991 Desjardins ..... A47F 7/00 211/70.6
5,139,322 A * 8/1992 Aisley ..... A47B 67/02 16/318
5,241,715 A 9/1993 Duvall et al.
5,255,971 A * 10/1993 Aisley ..... A47B 67/02 312/242
5,294,163 A * 3/1994 Lang ..... A01K 97/01 211/70.8
5,327,838 A * 7/1994 Beltman ..... A47B 25/00 108/25
5,413,035 A * 5/1995 Fernandez ..... B60N 3/005 100/44
5,427,446 A 6/1995 Glomski
5,548,855 A 8/1996 Jackson
5,570,939 A * 11/1996 Scott ..... B08B 15/023 108/24
5,577,819 A * 11/1996 Olsen ..... A47B 81/00 312/209
5,707,125 A 1/1998 Coglin
5,778,800 A * 7/1998 Liang ..... A47B 88/10 108/26
5,788,092 A * 8/1998 Teeney ..... B25H 3/04 211/182
5,788,093 A * 8/1998 Krut ..... B42F 15/0094 211/103
D400,653 S * 11/1998 Smith ..... D23/275
D405,877 S * 2/1999 Larsson ..... D23/304
5,865,124 A * 2/1999 Wroe ..... A47C 7/70 108/157.11
5,947,307 A * 9/1999 Battaglia ..... A47F 5/101 108/108
5,954,411 A 9/1999 Katz
D429,158 S 8/2000 Weber
6,464,092 B1 * 10/2002 Kortman ..... A47B 46/00 211/162
D485,096 S 1/2004 Overthun et al.
6,698,037 B2 * 3/2004 Lippe ..... A47K 3/30 4/612
D495,789 S * 9/2004 Helmetsie ..... D23/283
D496,439 S * 9/2004 Helmetsie ..... D23/283
D496,440 S 9/2004 Helmetsie et al.
D503,464 S 3/2005 Helmetsie et al.
6,984,066 B2 * 1/2006 Borom ..... A61B 6/0442 108/42
7,275,648 B2 * 10/2007 Segovia, Jr. ..... A47B 57/10 108/42
7,290,490 B2 * 11/2007 Goldberg ..... A47B 23/001 108/24
D560,767 S * 1/2008 Koury ..... D23/275
D566,251 S 4/2008 Bates
D570,967 S * 6/2008 Hood ..... D23/275
D588,237 S * 3/2009 Patterson ..... D23/275
D588,684 S * 3/2009 Patterson ..... D23/305
D596,279 S * 7/2009 Patterson ..... D23/305
D618,768 S * 6/2010 Hoernig ..... D23/283
D627,571 S * 11/2010 Hoernig ..... D6/362
8,060,955 B2 11/2011 Johnson et al.
D653,316 S 1/2012 Deswick et al.
8,215,064 B2 7/2012 Diacono
8,347,790 B1 1/2013 Maiers
D676,534 S * 2/2013 Lam ..... D23/304
8,585,162 B2 11/2013 Pantoja et al.
8,607,978 B2 * 12/2013 Bradford ..... B65D 19/44 206/335
8,800,073 B2 8/2014 Hoernig et al.
9,282,816 B2 * 3/2016 Ahart ..... A47B 47/0091
2003/0062809 A1 * 4/2003 Park ..... A47B 63/00 312/31.3
2004/0150301 A1 8/2004 Liberman
2005/0086736 A1 4/2005 Helmetsie et al.
2005/0172395 A1 8/2005 Helmetsie et al.
2005/0210577 A1 9/2005 Sisk
2006/0152122 A1 * 7/2006 Garrett ..... F25D 23/04 312/405.1
2006/0191066 A1 8/2006 Johnson et al.
2007/0283487 A1 12/2007 Diacono
2008/0052816 A1 3/2008 Gillis
2008/0237162 A1 * 10/2008 Lynch ..... A47B 47/00 211/90.01
2009/0026900 A1 1/2009 DeStefano

(56) References Cited

U.S. PATENT DOCUMENTS

2009/0033190 A1* 2/2009 Becke ..... F25D 23/04 312/405.1
2010/0146698 A1* 6/2010 Diacono ..... A47K 3/281 4/605
2010/0155350 A1 6/2010 Kaplan
2010/0162928 A1* 7/2010 Helline ..... A47B 13/16 108/26
2010/0176702 A1* 7/2010 Kim ..... F25D 23/04 312/405.1
2011/0047696 A1* 3/2011 Szekely ..... A47B 5/00 5/400
2012/0061289 A1* 3/2012 Langtry ..... B65D 5/42 206/736
2012/0200211 A1* 8/2012 Yanni ..... A47B 67/00 312/242
2012/0223626 A1* 9/2012 Thomas ..... E06B 7/34 312/242
2013/0186306 A1* 7/2013 Thornley ..... A47B 37/00 108/24
2014/0331585 A1 11/2014 Morneau et al.
2015/0176887 A1* 6/2015 Castro Solis ..... F25D 25/025 312/405.1
2015/0245706 A1* 9/2015 Fill ..... A47J 47/005 269/16
2016/0035256 A1* 2/2016 Trinh ..... G09F 7/18 40/611.01
2016/0069606 A1* 3/2016 Baumann ..... F25D 23/028 312/405.1

* cited by examiner

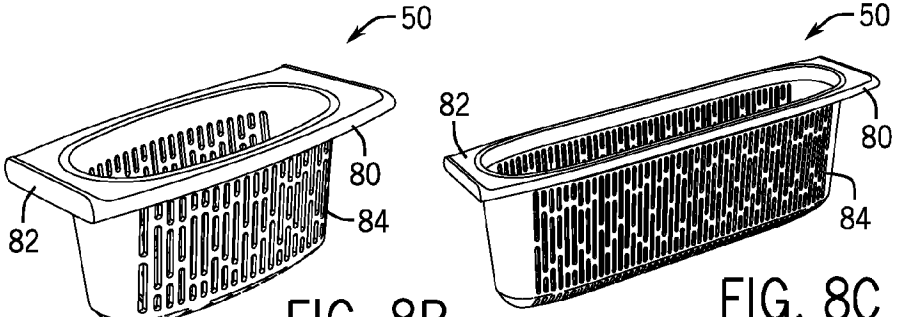
FIG. 8B
FIG. 8C
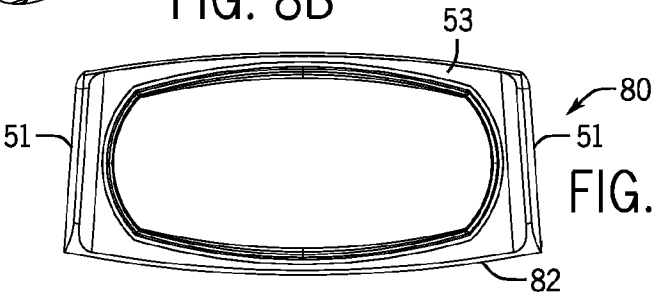
FIG. 8D
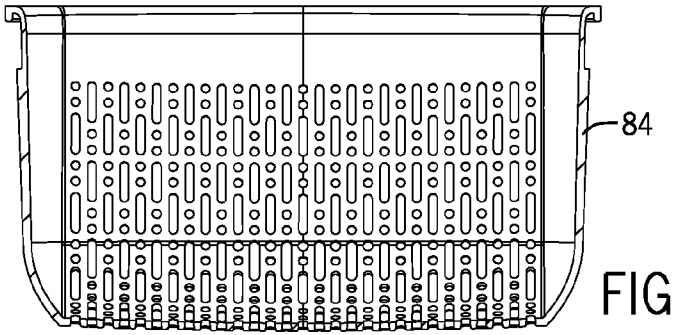
FIG. 8E
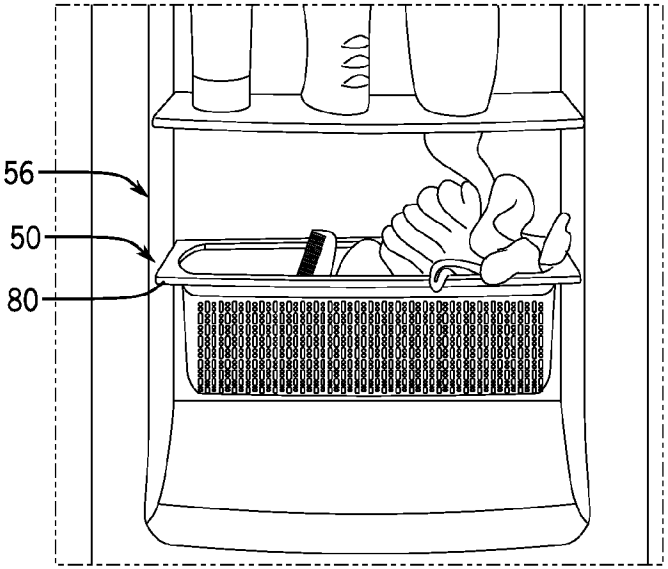
FIG. 8A
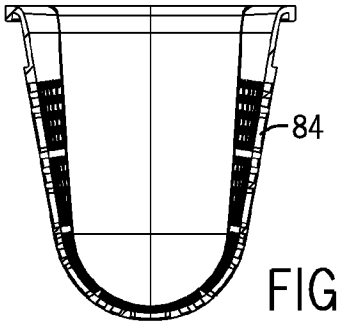
FIG. 8F

BATHING AREA ACCESSORIES

CROSS-REFERENCE TO RELATED PATENT APPLICATIONS

This application claims priority to and the benefit of U.S. Provisional Patent Application No. 62/015,214 filed Jun. 20, 2014, the entire disclosure of which is incorporated herein by reference.

FIELD

The present invention relates generally to bathing area accessories, and more particularly, to bathing area shelving assemblies, bathing area bar assemblies, storage assemblies, bathing area seat assemblies, and shaving ledge assemblies.

SUMMARY

According to one embodiment, a shelving assembly for use within a bathing area may include a niche that is configured to be recessed relative to a wall of the bathing area and at least one shelf that is attachable to, removable from, and reattachable to the attachment portions of the niche. The niche may include attachment portions that are configured to receive and secure the at least one shelf. The niche may include two sidewalls that extend substantially vertically along a vertical length of the niche and a lower surface that extends substantially horizontally between and connects a lower portion of the two sidewalls. The attachment portions may be on the two sidewalls and the at least one shelf may attach with a pair of the attachment portions that are vertically aligned with each other. The lower surface of the niche may have a front portion that is aligned with the wall of the bathing area and a back portion that is recessed relative to the wall of the bathing area. The front portion and the back portion may extend between the two sidewalls. The front portion may be lower than the back portion such that the lower surface of the niche may be angled.

According to another embodiment, a shelving assembly for use within a bathing area may include a niche that is configured to be recessed relative to a wall of the bathing area and at least one shelf that is attachable to, removable from, and reattachable to the attachment portions of the niche. The niche may include attachment portions that are configured to receive and secure the at least one shelf. The niche may include two sidewalls that extend substantially vertically along a vertical length of the niche and a lower surface that extends substantially horizontally between and connects a lower portion of the two sidewalls. The attachment portions may be on the two sidewalls and the at least one shelf may attach with a pair of the attachment portions that are vertically aligned with each other. The niche may comprise a back wall that extends substantially vertically along the vertical length of the niche and extends between a back portion of the sidewalls. A back edge of the at least one shelf may be spaced apart from the back wall such that there is a gap between the back edge the at least one shelf and the back wall for liquid to flow through.

According to yet another embodiment, a shelving assembly for use within a bathing area may include a niche that is configured to be recessed relative to a wall of the bathing area and at least one shelf that is attachable to, removable from, and reattachable to the attachment portions of the niche. The niche may include attachment portions that are configured to receive and secure the at least one shelf. The niche may include two sidewalls that extend substantially vertically along a vertical length of the niche and a lower surface that extends substantially horizontally between and connects a lower portion of the two sidewalls. The attachment portions may be on the two sidewalls and the at least one shelf may attach with a pair of the attachment portions that are vertically aligned with each other. The at least one shelf may have a front edge and a back edge. The back edge may be recessed further into the niche than the front edge. The at least one shelf may be angled within the niche such that the back edge of the at least one shelf is lower than the front edge of the at least one shelf.

According to another embodiment, a bar assembly for a wall of a bathing area may include a bar including a channel extending along a length of the bar and at least one bracket configured to rigidly attach to the wall of the bathing area and to be selectively fixed in position relative to the bar. The at least one bracket may include an extension slidable within the channel to enable selective positioning of the at least one bracket prior to the at least one bracket being fixed in position relative to the bar.

According to still another embodiment, a storage assembly for a wall of a bathing area may include a storage device, a storage device attachment unit on a back side of the storage device, and a wall attachment unit attachable to a front surface of the wall of the bathing area. One of the storage device attachment unit and the wall attachment unit may be a male attachment unit with a protrusion and the other of the storage device attachment unit and the wall attachment unit may be a female attachment unit with a slot. The protrusion may fit within and secure to the slot. The storage device attachment unit may be attachable to, removable from, and reattachable to the wall attachment unit.

According to another embodiment, a seat assembly may be to be attached to a wall of a bathing area and may include a bench movable between a seated position and a folded position and a support bracket configured to be statically attached to the wall of the bathing area and hingably attached to the bench such that the bench may rotate relative to the support bracket between the seated position and the folded position. The bench may include an outer covering and an internal support plate. The bench may be substantially perpendicular to the wall of the bathing area in the seated position and may be substantially parallel to the wall of the bathing area in the folded position. The outer covering may substantially conceal a seating portion of the internal support plate.

According to yet another embodiment, a shaving ledge assembly may be configured to be attached to a wall of a bathing area and may include a footrest movable between a use position and a folded position and a support bracket configured to be statically attached to the wall of the bathing area and hingably attached to the footrest such that the footrest may rotate relative to the support bracket between the use position and the folded position. The footrest may include an outer covering and an internal support plate. The footrest may be substantially perpendicular to the wall of the bathing area in the use position and may be substantially parallel to the wall of the bathing area in the folded position. The outer covering may substantially conceal a footrest portion of the internal support plate.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

FIG. 8A-8F are perspective, top, front, and side views of a basket shelf that may be located within the shelving assemblies of FIGS. 1A-1B.

FIG. 9 is a perspective view of the shelving assemblies of FIG. 1B with water flowing through.

DETAILED DESCRIPTION

Figure 1A:
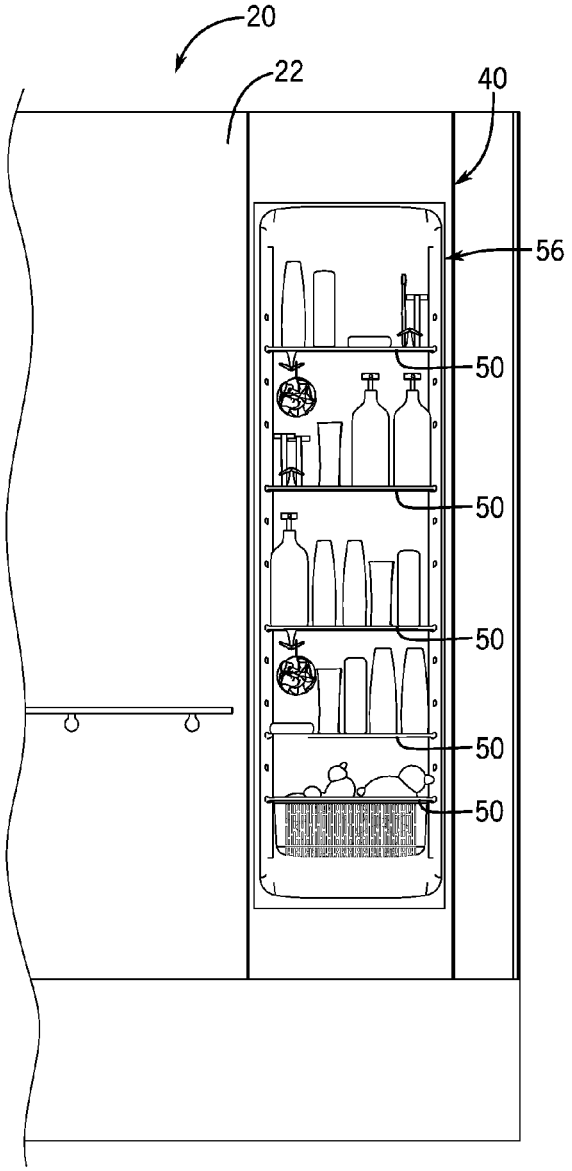
FIGS. 1A-1B are front views of a shelving assembly within a bathing area according to various embodiments.

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to the figures, disclosed herein are bathing area accessories, including but not limited to bathing area shelving assemblies, bathing area bar assemblies, storage assemblies, bathing area seat assemblies, and shaving ledge assemblies, as shown according to exemplary embodiments. The bathing area accessories may be positioned and used within a variety of showers, baths, or bathing areas. Although a "bathing area 20" and a "wall 22" are referred to herein, it is understood that the concepts described herein may be used with a shower or bath and with a shower wall or bath wall. However, it is understood that the bathing area accessories may be used within any non-showering or bathing application wherein it would be desirable to have, for example, shelving assemblies, bar assemblies, storage assemblies, seat assemblies, and shaving ledge assemblies. For example, the bathing area accessories may be used within areas exposed to water, such as outside a house.

Bathing Area Shelving Assembly

According to one embodiment as shown in FIGS. 1-9, a shower, bath, or bathing area 20 may include a locker or shelving assembly 40, which may be used to store or secure products or shower or bathing items. As shown in FIGS. 1A-1D, the bathing area shelving assembly 40 may be a vertical storage area with storage shelves that is recessed within or tucked into a wall 22 of a bathing area 20 to maximize bathing area space while providing storage. Accordingly, the shelving assembly 40 may eliminate clutter and increase organization by allowing the users to store bathing items in a discreet column. The bathing items include, but are not limited to, soaps, shampoo, conditioner, lotion, toothbrushes, toothpaste, razors, shaving cream, sponges, loofahs, squeegees, washcloths, bubble bath, and toys. The shelving assembly 40 may provide storage space to hold bathing items for an entire family, which may be approximately 15 to 35 products (approximately 27 products for a family of four). Alternatively or additionally, the shelving assembly 40 may include a step or ledge for the user to rest their foot on (e.g., to shave their legs). The shelving assembly 40 may include a niche 56 and at least one shelf 50 that is positionable within the niche 56 and may provide an adjustable storage area as well as facilitate liquid drainage back into the bathing area 20.

Figure 1B:
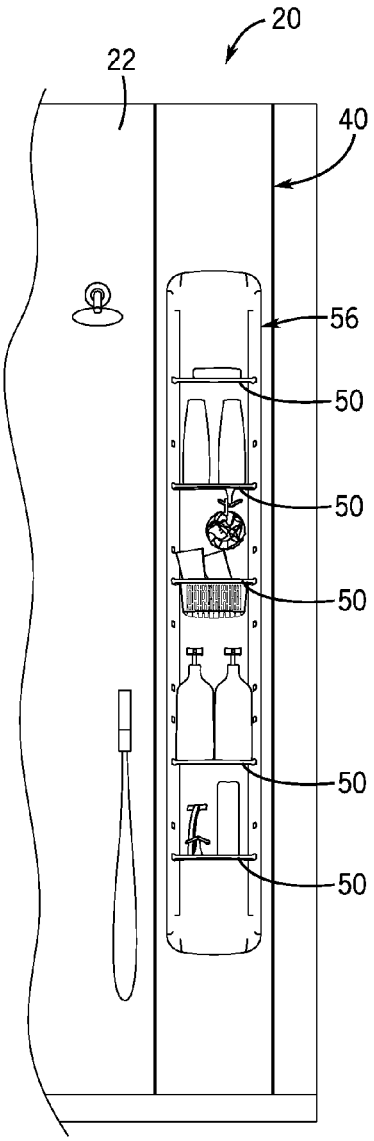
Figure 1D:
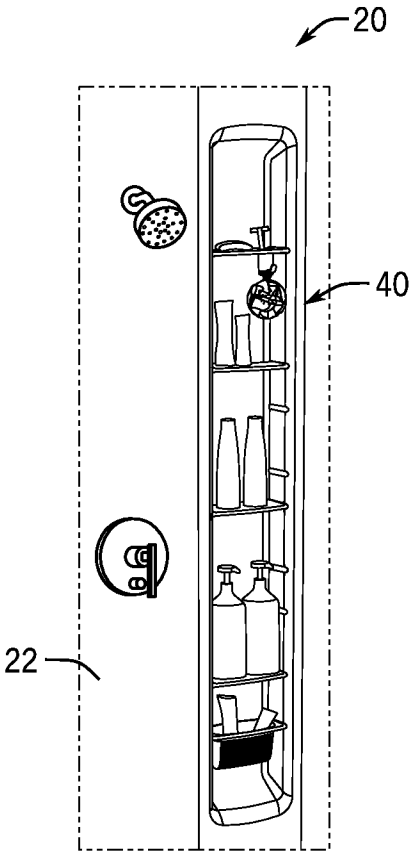
FIGS. 1C-1D are perspective views of the shelving assemblies of FIGS. 1A-1B.
Figure 1C:
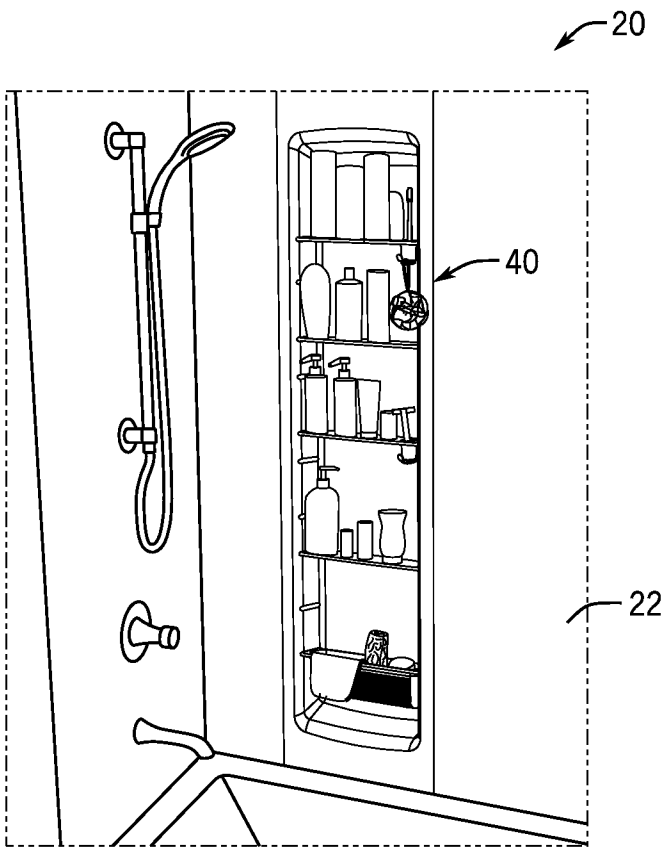

The shelving assembly 40 may be a variety of different sizes, as shown in FIGS. 1A and 1B. The various components of the shelving assembly 40, such as the niche 56 and the shelves 50, may be sized accordingly. For example, according to one embodiment, the niche 56 may fit comfortably between two studs (e.g., within a standard stud pocket) within the wall 22 of the bathing area 20 while still maintaining ample communal storage space. According to one embodiment, the niche 56 may be between 15 to 30 inches wide. According to another embodiment, the niche 56 may be between 18 to 21 inches wide. According to yet another embodiment, the niche 56 may be approximately 19 to 20 inches wide. The shelves 50 may be sized according to the size of the niche 56 (e.g., the width of the niche and the height and width of the attachment portions 52.

However, the niche 56 may have a relatively smaller width to accommodate smaller bathing areas 20. According to one embodiment, the niche 56 may be between 6 to 20 inches wide. According to another embodiment, the niche 56 may be between 9 to 15 inches wide. According to yet another embodiment, the niche 56 may be approximately 11 inches wide.

As shown in FIGS. 2A-2B and 4E-4F, the compartment, locker, alcove, or niche 56 may be a structure that is at least partially recessed within or relative to a wall 22 of the bathing area 20 or above a bathtub, such that the space within the bathing area 20 is not limited or reduced by the niche 56. The niche 56 may provide an area to store the bathing accessories or items.

Figure 3B:
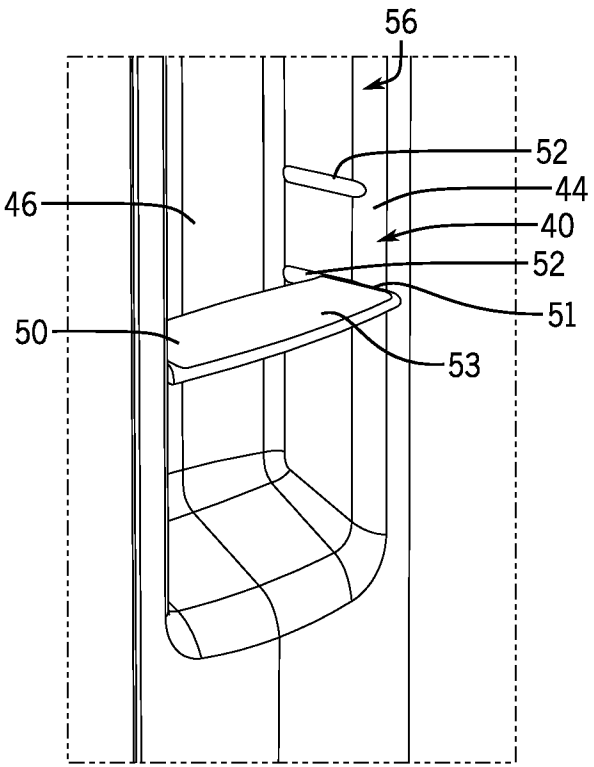
FIGS. 3A-3B are perspective views of shelves being added or removed from the shelving assembly of FIG. 1B.
Figure 3A:
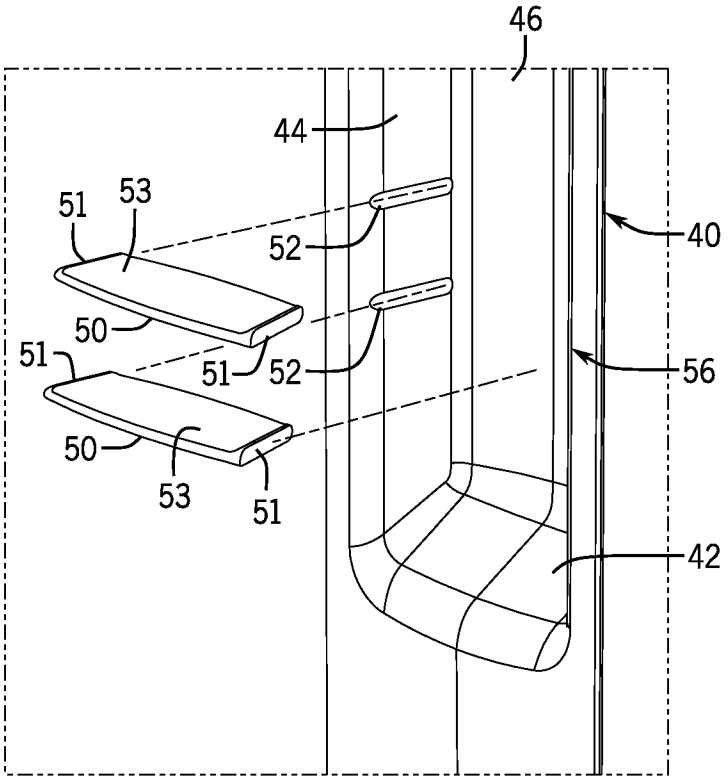
Figure 4D:
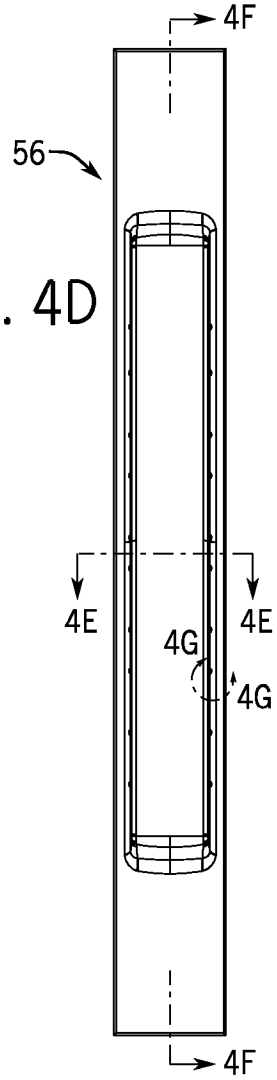
FIGS. 4C-4D are perspective and front views of the niche of the shelving assembly of FIG. 1B without the shelves.
Figure 4C:
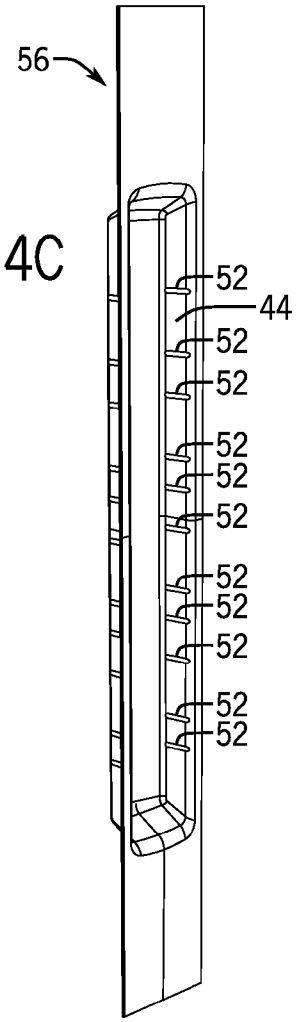
Figure 4B:
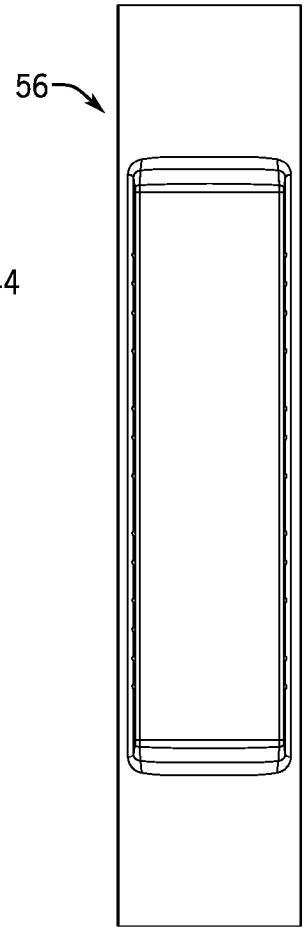
FIGS. 4A-4B are perspective and front views of the niche of the shelving assembly of FIG. 1A without the shelves.
Figure 4A:
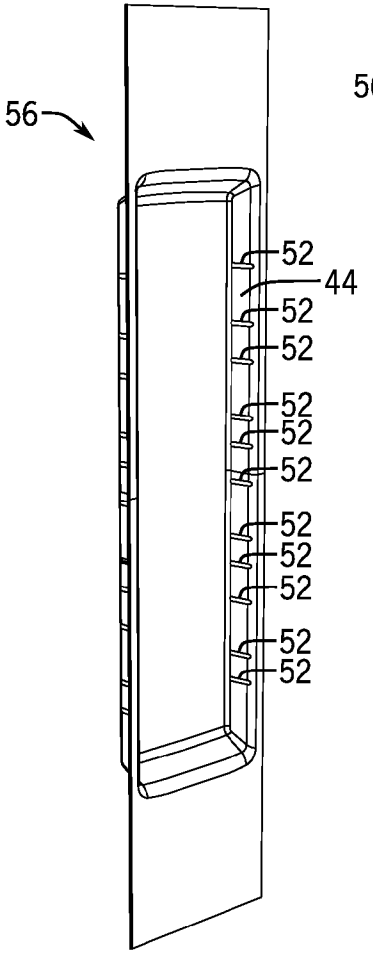
Figure 4E:
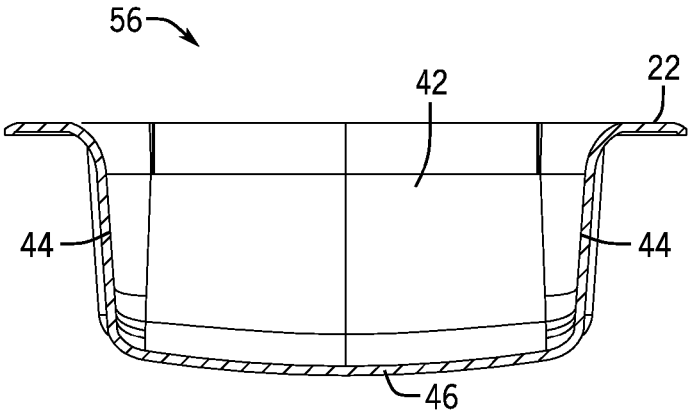
FIG. 4E is a cross-sectional view through Section 4E of the niche of FIG. 4D.
Figure 4G:
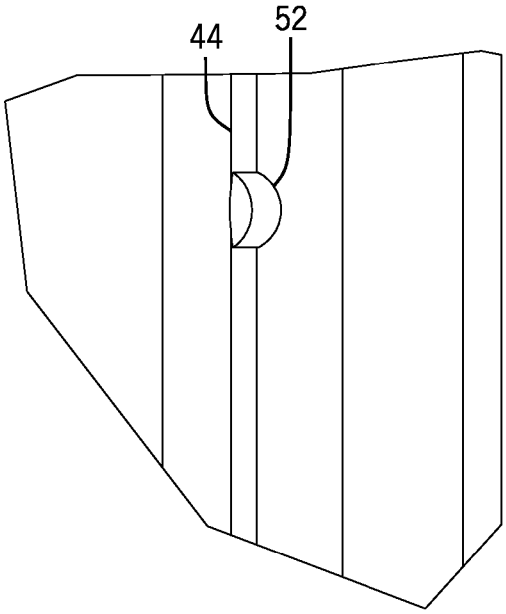
FIG. 4G is an enlarged view of Section 4G of the niche of FIG. 4D.
Figure 4F:
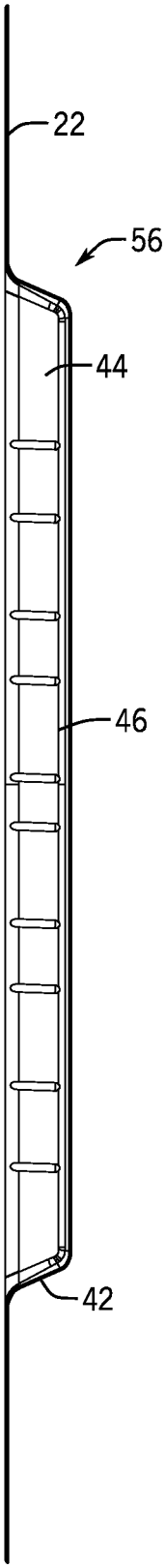
FIG. 4F is a cross-sectional view through Section 4F of the niche of FIG. 4D.

The niche 56 may include two sidewalls 44 (e.g., on the left and right side of the niche 56) that extend substantially vertically along the vertical length of the niche 56. The niche 56 may include attachment portions 52 along each of the two sidewalls 44 that facilitate the attachment of the shelves 50 to the niche 56. The attachment portions 52 may be configured to receive and secure the shelves 50 and may be, for example, a longitudinal ledge, lip, indentation, or crevice, as shown in FIGS. 3A-3B and 4G. The attachment portions 52 may extend from a front region of the sidewalls 44 to a back region of the sidewalls 44 (where the back region of the sidewalls 44 is more recessed relative to the wall 22 of the bathing area 20 than the front region of the sidewalls 44). Two attachment portions 52 (e.g., a pair of attachment portions 52) on each of the sidewalls 44 may be vertically aligned with each other to provide an area for attachment of a shelf 50 to the niche 56. Pairs of attachment portions 52 (that are vertically aligned with each other along each of the sidewalls 44) may be spaced from each other along the vertical length of the niche 56.

The niche 56 may also include a back wall 46 that extends substantially vertically along the vertical length of the niche 56 and along at least a portion of the wall 22. The back wall 46 may extend between and connect a back portion of the two sidewalls 44 and may be approximately parallel to the wall 22.

The niche 56 may additionally include a bottom or lower surface 42 and a top surface that may extend substantially horizontally between and connect a lower portion and an upper portion, respectively, of each of the two sidewalls 44. The lower surface 42 and the top surface may also connect to a lower portion and an upper portion, respectively, of the back wall 46. The lower surface 42 and the top surface may be shorter in length than the sidewalls 44.

As described further herein, the lower surface 42 may facilitate liquid drainage from the shelving assembly 40. Alternatively or additionally, the lower surface 42 (as shown, for example, in FIGS. 2A, 2B, 4E, and 4F) may be a bottom ledge that may serve as a footrest for the user to rest their foot on. For example, the user may rest their foot on the lower surface 42 to help raise and hold their leg and to stabilize them while shaving their legs.

According to one embodiment, the niche 56 may have a smooth or curved transition between the wall 22 and the edges of the niche 56 in order to provide a more aesthetically pleasing look and to further help with cleaning.

Figure 2A:
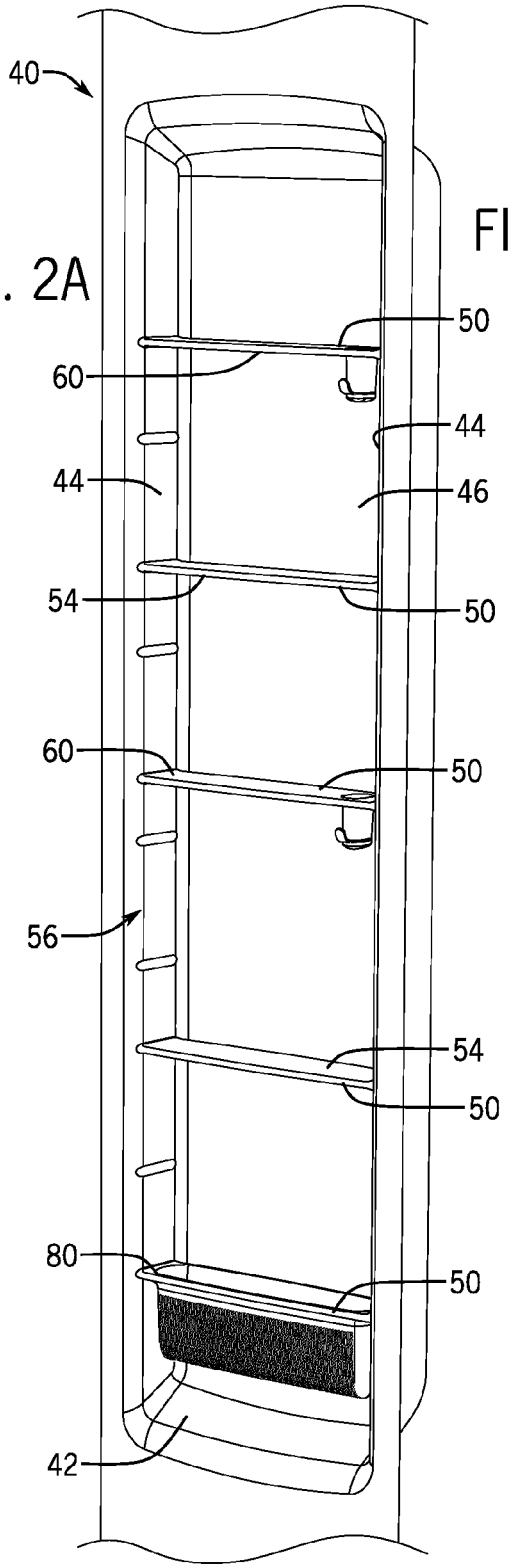
FIGS. 2A-2B are perspective views of the shelving assemblies of FIGS. 1A-1B isolated from the bathing area.
Figure 2B:
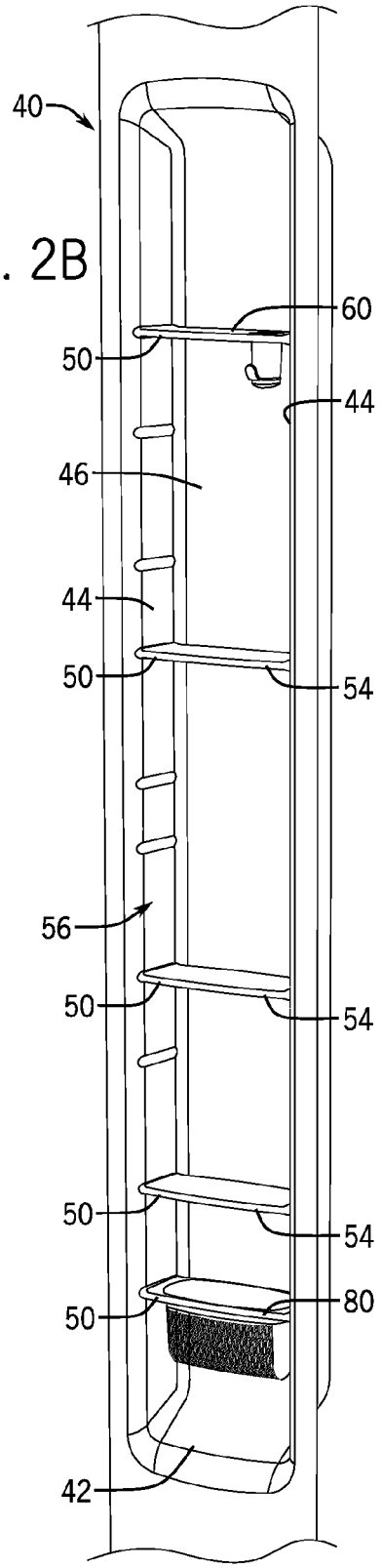

As shown in FIGS. 2A and 2B, the shelving assembly 40 may include at least one shelf 50 that is positionable along the vertical length of the niche 56. As shown in FIGS. 1A-1D, various bathing items may be stored on the shelves 50. The shelves 50 may be spaced apart to maximize the usability of the shelves 50 and for user convenience.

The shelf 50 height, function, and positioning may be adaptable to meet the user's needs. According to one embodiment and as shown in FIGS. 3A-3B, the shelves 50 may be attachable to, removable from, and reattachable to the attachment portions 52 of the niche 56. The shelves 50 may be held by and attaches to a pair attachment portions 52 (one on each of the sidewalls 44 of the niche 56) that are vertically aligned with each other. Further, the shelves 50 and the niche 56 may be easily and deeply cleaned by removing the shelves 50 from the niche 56. For example, FIGS. 4A-4F depict the niche 56 with all of the shelves 50 removed.

By removing and reattaching the shelf 50 to different attachment portions 52, the vertical position of the shelf 50 is adjustable according to the vertical position of each of the pairs of the attachment portions 52 within the niche 56. Accordingly, as shown in FIGS. 4A and 4C, multiple attachment portions 52 may be positioned along the vertical length of the niche 56 to provide different options for where the shelf 50 may be attached, which allows the user to customize the position of each of the shelves 50 according to, for example, the desired height of the shelf 50 within the bathing area 20 and/or the desired vertical space above the shelf 50 within the niche 56 (e.g., to hold larger bathing items).

The shelving assembly 40 may include multiple shelves 50 (as shown in FIGS. 1A-1B) that are each positionable along the vertical length of the niche 56 within the pairs of attachment portions 52. Since there may be more attachment portions 52 than shelves 50, the particular configuration and relative spacing (e.g., the vertical distance) between each of the multiple shelves 50 may be adjustable depending on the desired configuration and according to the vertical positions of the pairs of the attachment portions 52.

The relative spacing between the shelves 50 may vary according to the type of product to be stored. For example, there may be more vertical space above a shelf 50 that is designated to store large containers of shampoo and conditioner and relatively less vertical space above a shelf 50 designated to hold a bar of soap.

As described further herein and as shown in FIGS. 5-9, the shelving assembly 40 may include multiple different types of shelves 50 that may fit within the attachment portions 52. For example, the shelves 50 may include a flat shelf 54, a container and hook shelf 60, a hook shelf 70, and/or a basket shelf 80. Accordingly, the shelves 50 may be positioned within the niche 56 in a particular hierarchy according to the user's needs and the types of produces the shelves 50 may store. For example, the height of the shelf 50 may vary according to the type and size of the shelf 50. More specifically, the basket shelf 80, which may be particularly useful in holding toys, may be positioned toward the bottom of the niche 56 to allow children to access the toys. The container and hook shelf 60, however, may be positioned relatively higher within the niche 56 to position razors closer to the adult user.

According to one embodiment and as shown in FIGS. 3A-3B, a portion of the shelf 50 may be slidable within the attachment portions 52 to move in and out of the niche 56. Accordingly, a portion of the shelf 50 (e.g., a side portion 51) may fit within one of the attachment portions 52. As shown in FIG. 5B, the shelf 50 may have two side portions 51 on either end of the shelf 50 that have complementary geometry to a respective one of the attachment portions 52 such that each of the side portions 51 attach into an attachment portion 52 on each of the sidewalls 44 of the niche 56.

According to one embodiment, the side portions 51 may be a longitudinal bump or raised portion along at least two ends of the shelf 50 that fit within the attachment portions 52 that are crevices. Accordingly, the shelf 50 may be securely held by the attachment portions 52.

The shelf 50 may include a middle portion 53 that extends between and connects the two side portions 51. The side portions 51 may be thicker than the middle portion 53 to direct the flow of liquid and to reduce the required materials.

The shelving assembly 40 may include multiple different types of shelves 50 within the niche 56. For example, the shelves 50 may include a flat shelf 54, a container and hook shelf 60, a hook shelf 70, and/or a basket shelf 80.

Figure 5A:
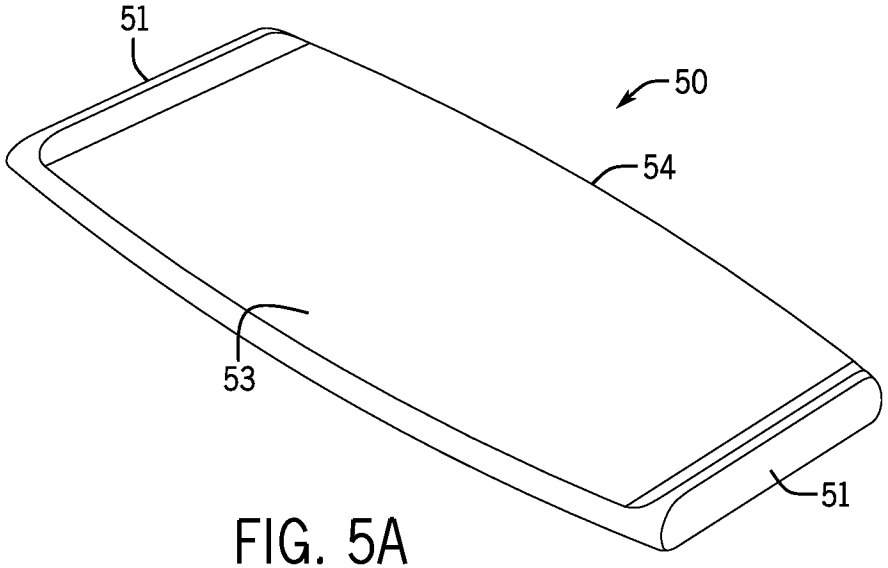
FIGS. 5A-5B are perspective and front views, respectively, of a flat shelf that may be located within the shelving assemblies of FIGS. 1A-1B.
Figure 5B:
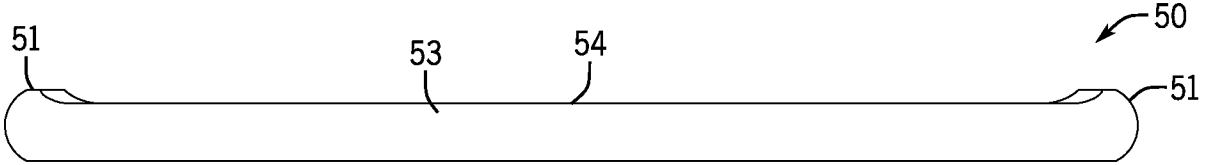

According to one embodiment, at least one of the shelves 50 may be a flat shelf 54, as shown in FIGS. 5A-5B. The middle portion 53 of the flat shelves 54 may include a substantially flat top surface to provide a shelf for bathing items, such as stand-alone bathing accessories. For example, the flat shelf 54 may comfortably hold three 44 ounce shampoo bottles.

Figure 6A:
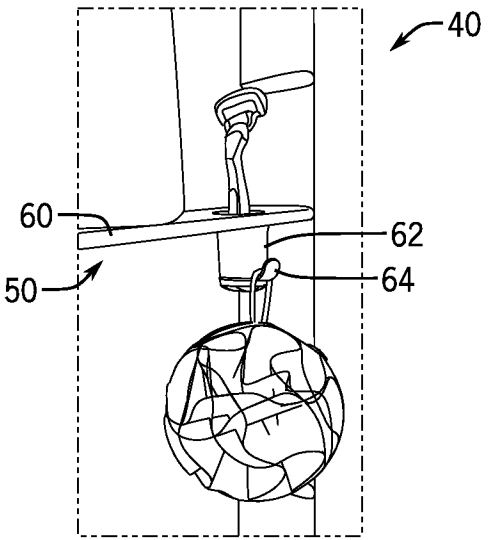
FIGS. 6A-6B are perspective views of a container and hook shelf that may be located within the shelving assemblies of FIGS. 1A-1B.
Figure 6B:
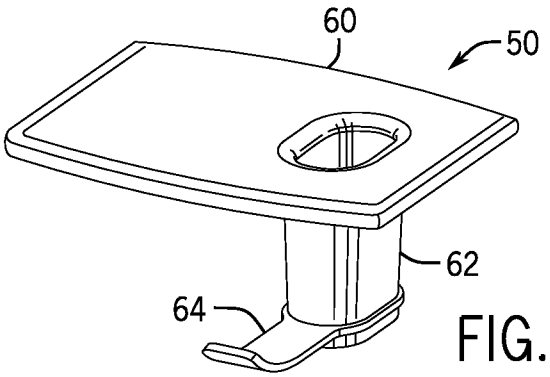
Figure 6C:
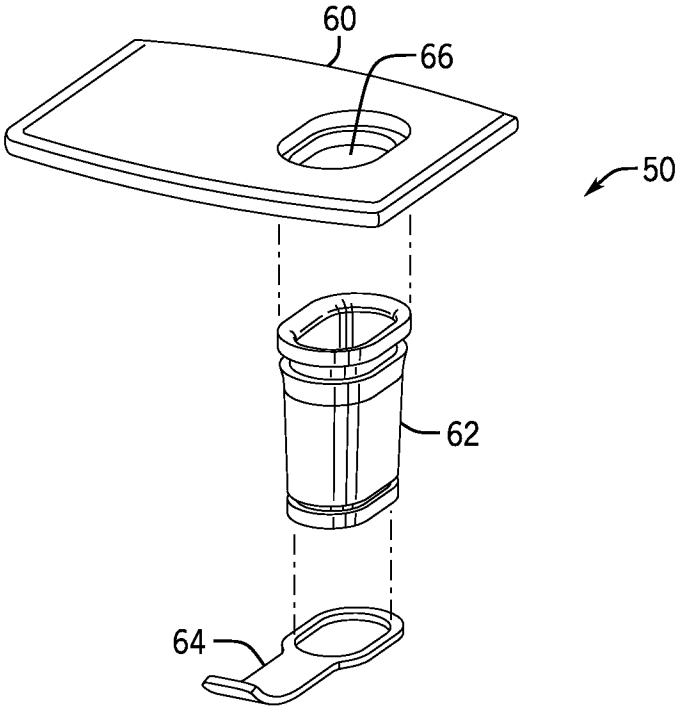
FIG. 6C is an exploded view of a container and hook shelf of FIGS. 6A-6B.
Figure 6F:
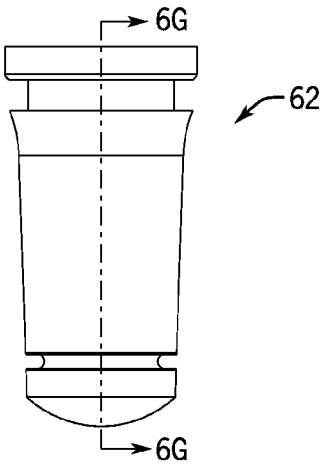
FIG. 6F is a front view of the cup of FIGS. 6A-6C.
Figure 6G:
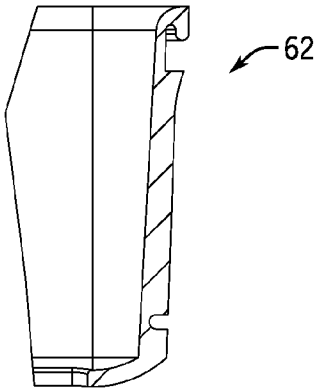
FIG. 6G is a cross-sectional view through Section 6G of FIG. 6F.
Figure 6D:
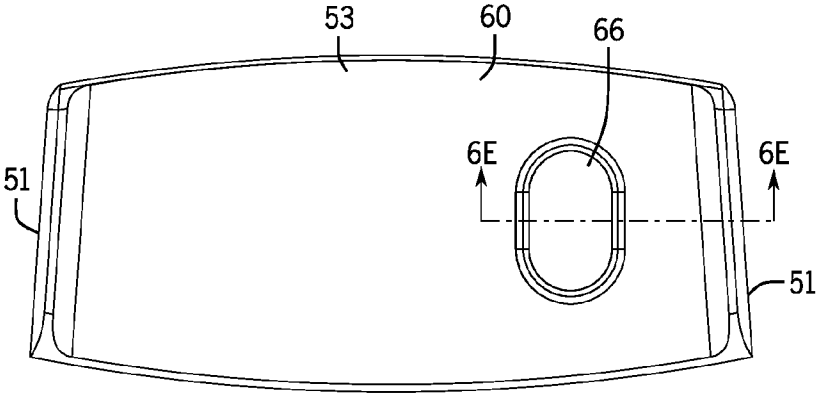
FIG. 6D is a top view of the container and hook shelf of FIGS. 6A-6C.
Figure 6E:
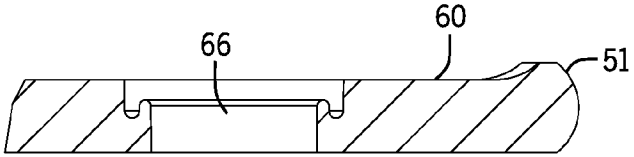
FIG. 6E is a cross-sectional view through Section 6E of FIG. 6D.

Alternatively or additionally, at least one of the shelves 50 may be a container and hook shelf 60, as shown in FIGS. 6A-6C. The middle portion 53 of the container and hook shelf 60 may include a substantially flat top surface, an opening or aperture 66 (as shown in FIGS. 6D-6E), as well as a holder, cup, or container 62 (as shown in FIGS. 6F-6G). The container 62 may be used further secure or hold certain bathing items, such as razors or toothbrushes.

The container 62 may be integral with the container and hook shelf 60 or may be a separate, removable component. According to one embodiment, a top lip or rim of the container 62 may be connected to the top rim of the aperture 66, such that the container 62 extends at least partially through the aperture 66 and hangs at least partially beneath the flat top surface. The container 62 may have an opening along the top rim for bathing items to be inserted into. The container 62 may optionally have at least one hole, opening, meshwork, or drain along a bottom portion to allow liquid to drain through the container 62 (e.g., to prevent water accumulation), while preventing the bathing items from falling through the container 62.

The container 62 may optionally include a hook 64 extending from a surface of the container 62 for hanging bathing items, such as loofahs, sponges, or squeegees. The hook 64 may be located along the body or bottom portion of the container 62 (e.g., beneath the top flat surface of the container and hook shelf 60 and beneath the top rim of the container 62). As shown in FIG. 6C, the hook 64 may have a hoop or loop to wrap around a portion of the container 62. The hook 64 may be positioned relative to the niche 56 such that the hook 64 extends toward the bathing area 20 to great accessibility to the user.

Figure 7A:
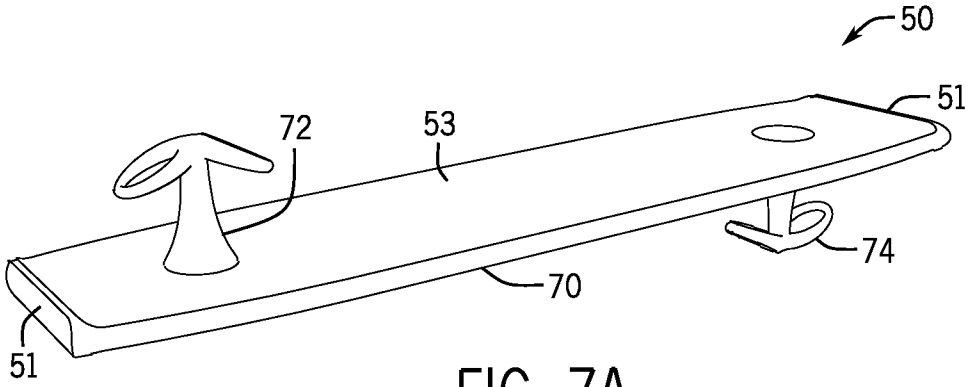
FIG. 7A-7B are perspective views of hook shelves that may be located within the shelving assemblies of FIGS. 1A-1B.
Figure 7B:
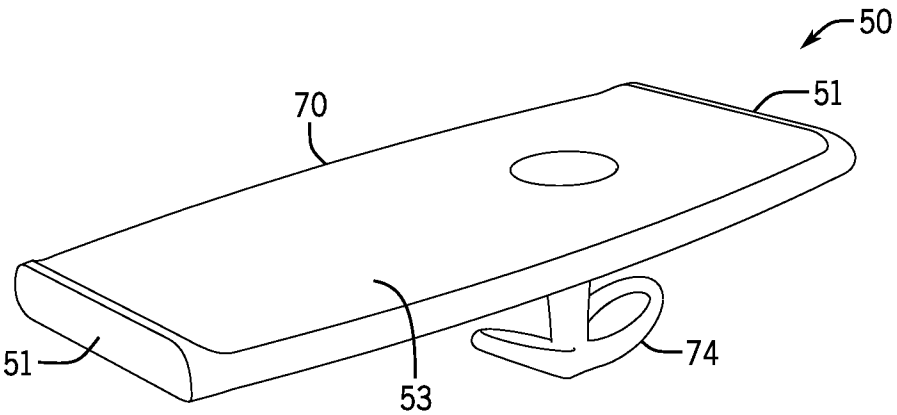

Alternatively or additionally, at least one of the shelves 50 may be a hook shelf 70, as shown in FIGS. 7A-7B. The middle portion 53 of the hook shelf 70 may include a substantially flat top surface to hold bathing items, such as shampoo, as well as at least one extension protruding from a surface of the middle portion 53. The extension may include at least one loop and/or hook to secure bathing items or accessories.

The extension may be, for example, a top hook 72 extending upward from the top flat surface or bottom hook 74 extending downward from a bottom surface of the middle portion 53. The top hook 72 may be particularly beneficial in holding razors or toothbrushes. The bottom hook 74 may be particularly beneficial for holding loofahs, squeegees, or washcloths. The middle portion 53 may optionally include a hole or aperture for the bottom hook 74 to extend through. Accordingly, the bottom hook 74 may optionally extend through the aperture in the middle portion 53 and may include a hole, aperture, or container along a portion that connects to the aperture on the middle portion 53, thus providing an area for the user to store bathing items such as razors or toothbrushes.

Alternatively or additionally, at least one of the shelves 50 may be a basket shelf 80, as shown in FIGS. 8A-8F. The basket shelf 80 may be useful for storing, holding, or concealing odd-shaped bottles, toys, and other miscellaneous items. The middle portion 53 of the basket shelf 80 may include a basket 84 that extends between the two side portions 51. The basket 84 may extend below the side portions 51. The basket 84 may have a perforated or mesh surface along, for example, the sides and/or the bottom of the basket 84 to allow water to drain through the basket shelf 80.

The basket shelf 80 may slide into the niche 56 similarly to the flat shelf 54 or the container and hook shelf 60. For example, a flat portion or rim 82 of the basket shelf 80 may include the two side portion 51 and the middle portion 53 and may surround the basket 84. The two side portions 51 may be slid into the attachment portions 52 in the niche 56 and the basket 84 may hang from the rim 82. Accordingly, the basket 84 may hang or extend beneath the attachment portions 52 that are holding or supporting the basket shelf 80.

Figure 9:
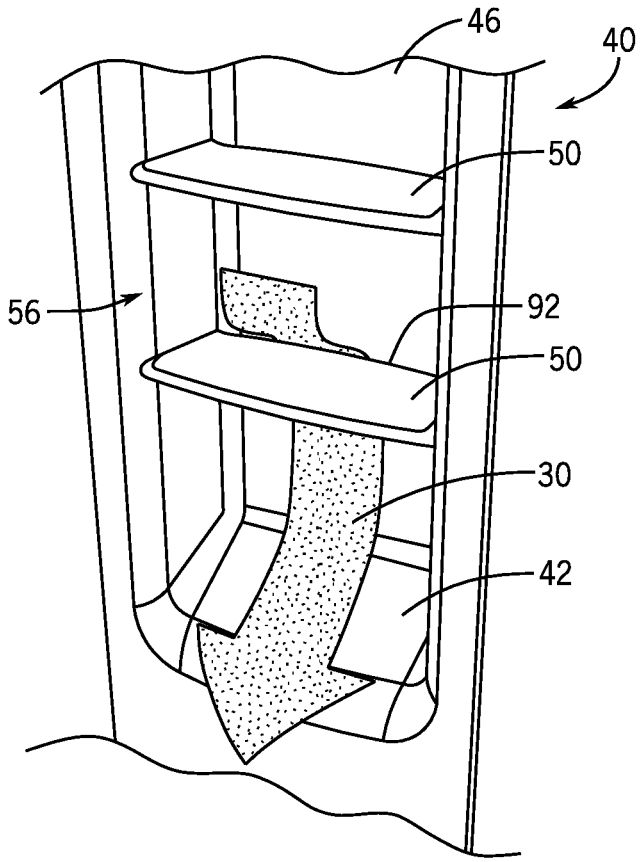

As shown in FIG. 9, the niche 56 and the shelves 50 may oriented in such a manner as to prevent water accumulation or collection within the shelving assembly 40, to direct the liquid flow 30 (e.g., the water flow), and to keep the shelving assembly 40 dry. For example, the lower surface 42 of the niche 56 may be angled (relative to the horizon) such that the front edge or portion of the lower surface 42 is angled down toward the floor of the bathing area 20 and lower to the floor than the back edge or portion of the lower surface 42. (The front portion of the lower surface 42 may be aligned with the wall 22 of the bathing area 20 and the back portion of the lower surface 42 may be recess relative to the wall 22 of the bathing area 20. The front portion and the back portion may extend between the two sidewalls 44.) Accordingly, the lower surface 42 may direct any liquid 30 from the shelving assembly 40 back into the bathing area 20.

Alternatively or additionally, the shelves 50 may be angled (relative to the horizon) within the niche 56 to direct liquid 30 toward the back of the niche 56, down to the lower surface 42, and back into the bathing area 20 (while preventing the bathing accessories from sliding off of the front of the shelf 50). For example, the back edge of the shelf 50 is lower than the front edge of the shelf 50. (The shelf 50 may include a front edge and a back edge that extend between the two side portions 51 of the shelf 50. The back edge is recess further into the niche 56 (e.g., closer to the back wall 46) than the front edge when the shelf 50 is positioned within the niche 56.) This configuration may be due to, for example, the angle of the attachment portions 52 and/or the angle of the top surface of the shelf 50.

In order to allow the liquid 30 to flow down the back wall 46 of the niche 56 toward the lower surface 42, the back edge of the shelves 50 may be spaced apart or at least partially away from the back wall 46 of the niche 56 such that there is a space or gap 92 between the back edge of the shelf 50 and the back wall 46 for liquid 30 to flow through, as shown in FIG. 9. Accordingly, liquid flow 30 may be directed from the shelf 50, toward the back wall 46, through the gap 92 between the shelf 50 and the back wall 46, down the length of the back wall 46 of the niche 56, and to the lower surface 42. Since the lower surface 42 is also angled (as described further herein), the liquid 30 may subsequently flow down the lower surface 42 and back into or toward the bathing area 20. According to one embodiment, the shelves 50 may have a 2° pitch toward the back wall 46.

The shelving assembly 40 and the shelving assembly components may be constructed out of a variety of different materials, including but not limited to acrylic (such as matte acrylic), polypropylene (e.g., 10% glass-filled polypropylene), metal (e.g., aluminum), or rubber (e.g. silicone rubber).

It is understood that the various configurations and embodiments of the shelving assembly 40 may be used in conjunction with each other and in a variety of different configurations.

Bathing Area Bar Assembly

Figure 10:
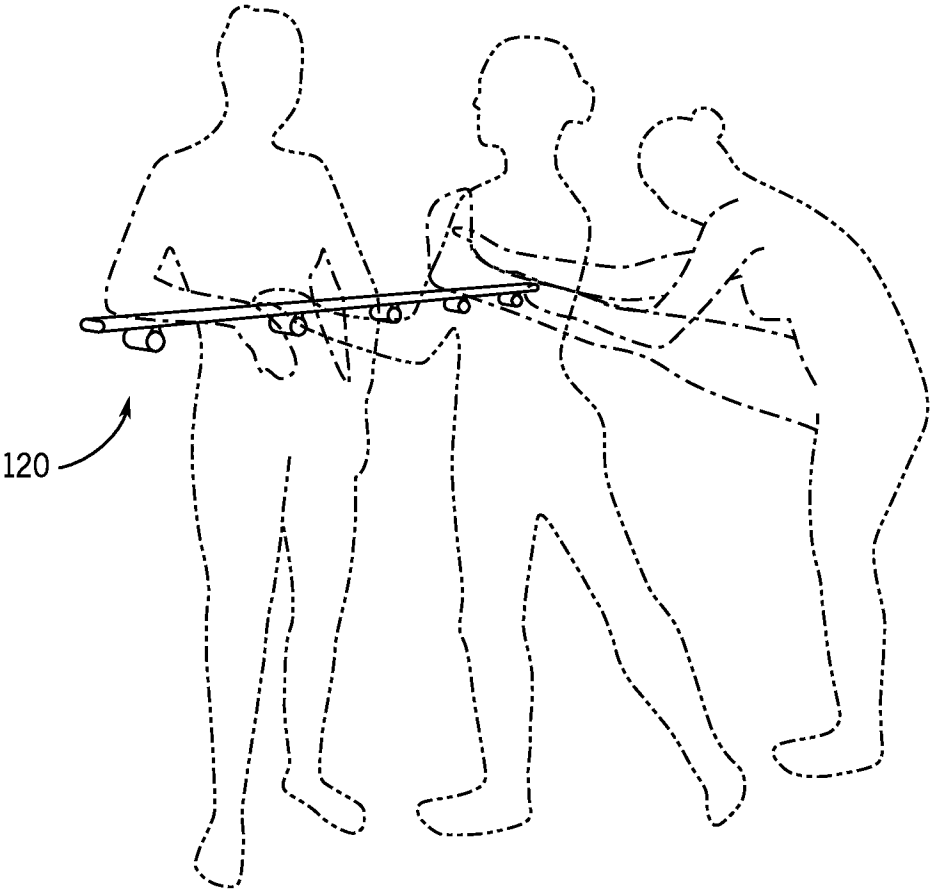
FIG. 10 is a perspective view of a bathing area bar assembly being utilized by a user according to one embodiment.

According to one embodiment as shown in FIGS. 10-21, the bathing area 20 may include a bathing area bar assembly 120, which may be used for physical support and/or product staging. For example, as shown in FIG. 10, the user may use the bar assembly 120 for stabilization and support while showering or bathing. The bar assembly 120 may provide a stable point of contact in the bathing area environment, particularly for users with mobility issues. Accordingly, the user may hold onto, lean on, and/or stretch on the bar assembly 120. As shown in FIG. 19A, the bar assembly 120 may also (or alternatively) be used to hold or store bathing items.

Figure 11:
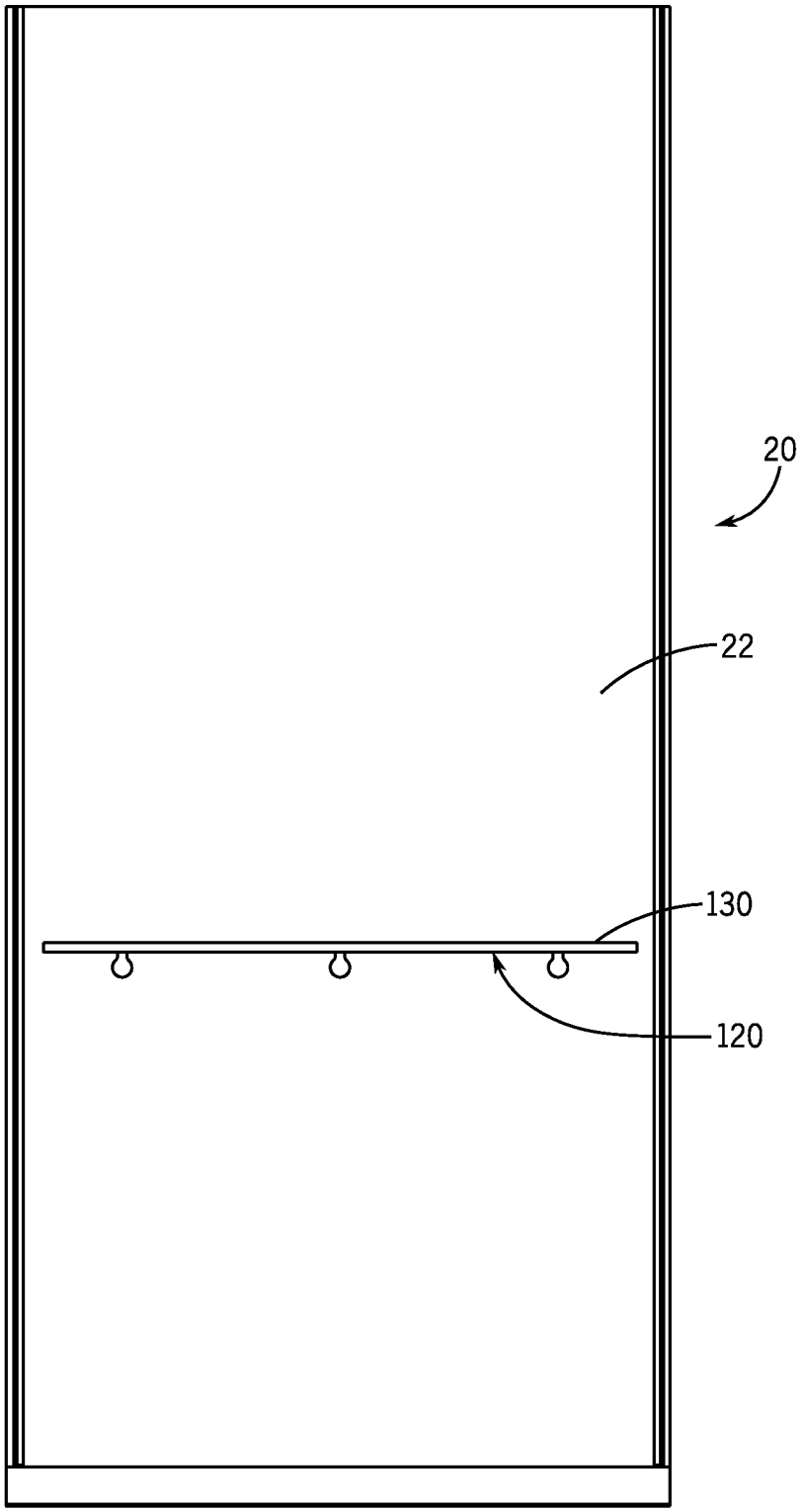
FIG. 11 is a front view of the bar assembly of FIG. 10 in a bathing area.

As shown in FIG. 11, the bar assembly 120 may be installed within the shower or bathing area 20 or and may be attached to the wall 22 of the bathing area 20. The slim profile of the bar assembly 120 may provide support and storage without sacrificing the style and available room within the bathing area 20.

Figure 12A:
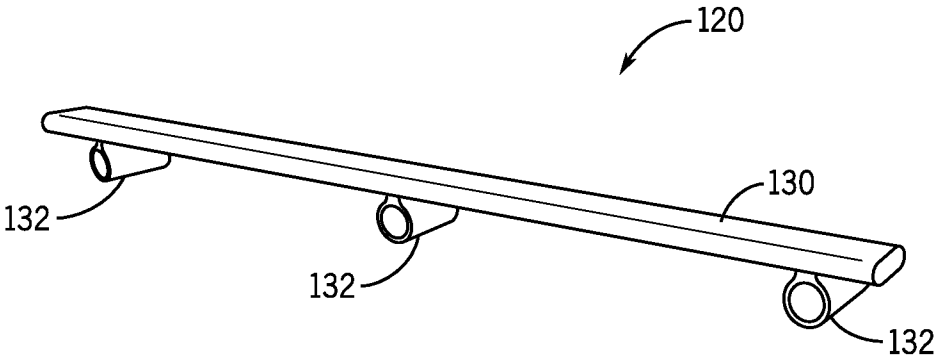
FIGS. 12A-12B are perspective and side views of the bar assembly of FIG. 10.
Figure 12B:
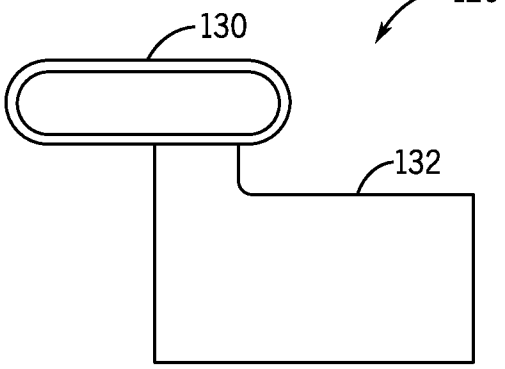
Figure 13:
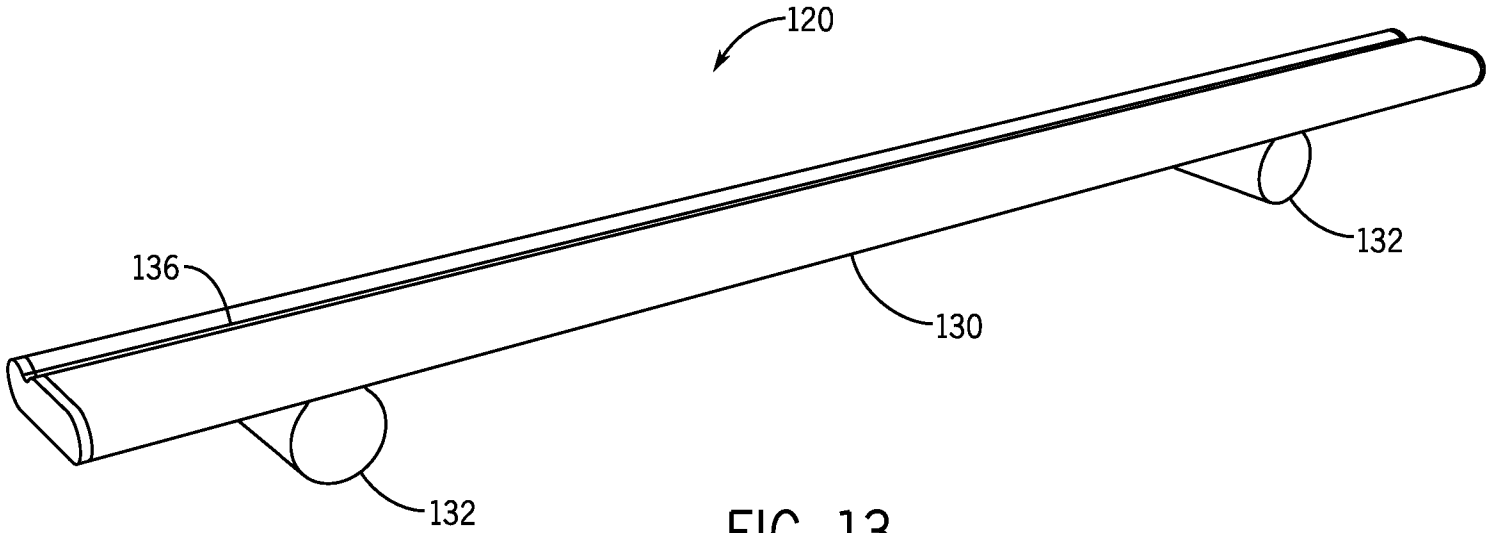
FIG. 13 is a perspective view of a bathing area bar assembly according to another embodiment.

The bar assembly 120 may include a ledge, rail, handrail, barre, or bar 130 which may attach to the wall 22. The bar 130 may be shaped and sized in order to allow the user to securely grasp the bar 130. Accordingly, the edges of the bar 130 may be rounded or smooth. The top of the bar 130 may be smooth, as shown in FIGS. 12A-12B, or may have a groove or divot 136 for additional grasping, as shown in FIG. 13. The various components of the bar assembly 120 (e.g., the bar 130) may be constructed out of a variety of different materials, including but not limited to metal (such as aluminum (e.g., die cast aluminum), carbon ste el, or stainless steel), wood, or plastic (e.g., ABS plastic). The aluminum may be anodized or powder coated.

Figure 14:
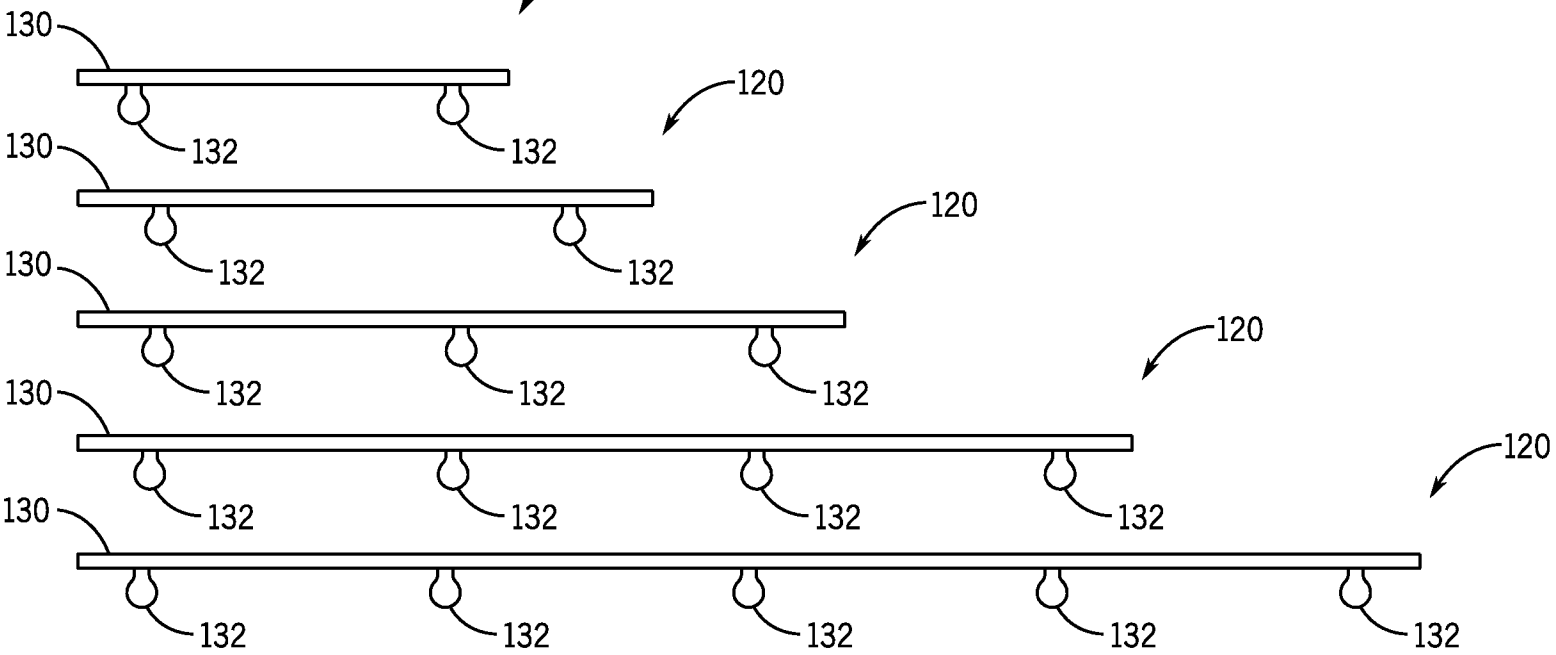
FIG. 14 is a front view of various embodiments of the bar assembly.

As shown in FIG. 14, the bar 130 may be a variety of different lengths, according to the desired configuration and the size of the bathing area 20. For example, according to one embodiment, the length of the bar 130 may be between 6 to 80 inches. According to another embodiment, the length of the bar 130 may be between 12 to 68 inches. According to yet another embodiment, the length of the bar 130 may be between 18 to 56 inches. For example, the length of the bar 130 may be approximately 18, 24, 32, 38, 44, or 56 inches.

Figure 17B:
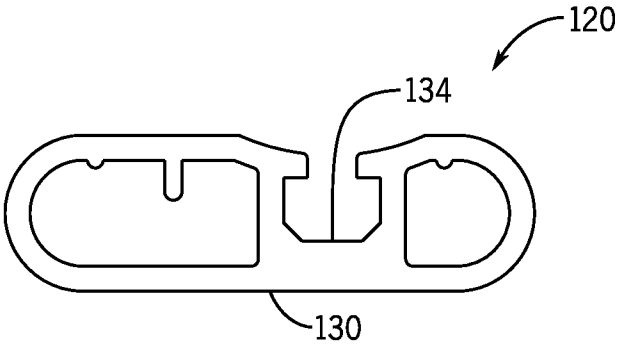
FIGS. 17A-17B are bottom perspective and cross-sectional, side views, respectively, of the bar assembly of FIG. 10.
Figure 17A:
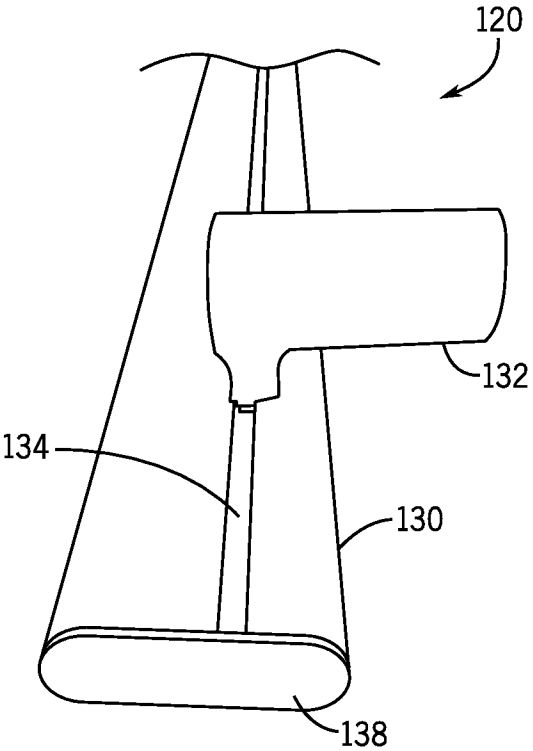

As shown in FIGS. 17A-17B, the bar 130 may have a groove or channel 134 that extends along a length of the bar 130. The channel 134 may open toward a bottom side or underside of the bar 130 to prevent water accumulation, to maintain the appearance of the bar 130, and for greater comfort for the user. The channel 134 may extend partially into or through the bar 130 in a vertical direction. The channel 134 may be in a middle portion along the width of the bar 130 for greater stability.

Figure 15:
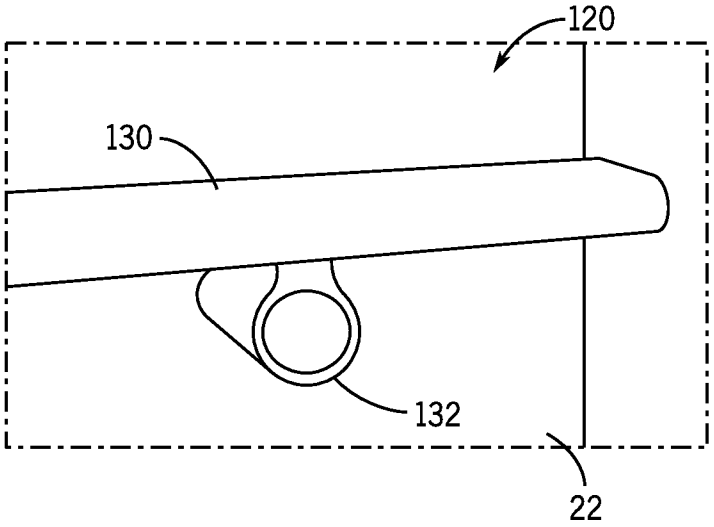
FIG. 15 is a perspective view of a bracket and a portion of a bar of the bar assembly of FIG. 10.
Figures 16A, 16B:
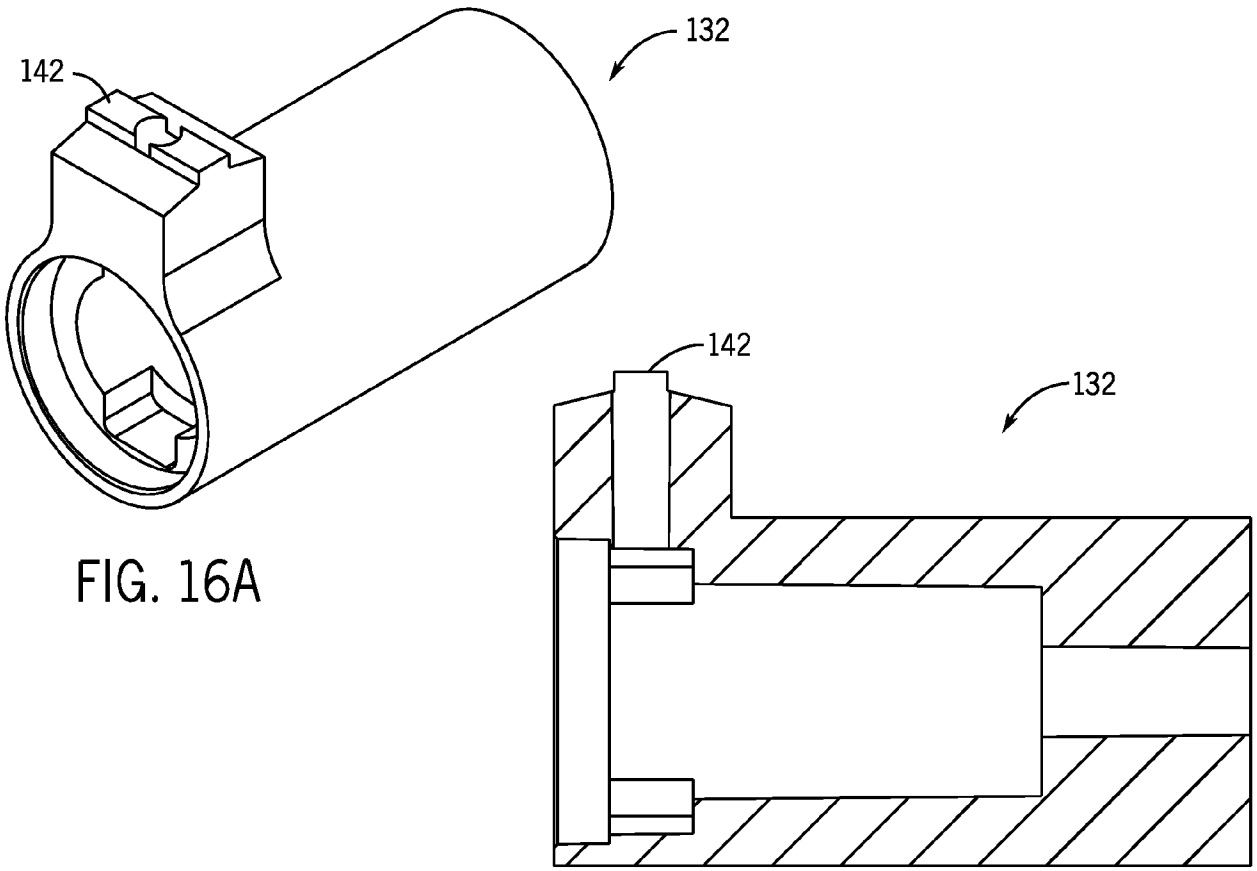
FIGS. 16A-16B are perspective and cross-sectional, side views, respectively, of a bracket of the bar assembly of FIG. 10.

As shown in FIGS. 15 and 16A-16B, the bar assembly 120 may include at least one bracket 132 to rigidly attach to the bar 130 to the wall 22. As shown in FIG. 14, the bar assembly 120 may include any number of brackets 132 along the length of the bar 130. According to various embodiments, the bar assembly 120 may include two, three, four, or five brackets 132.

Figure 18A:
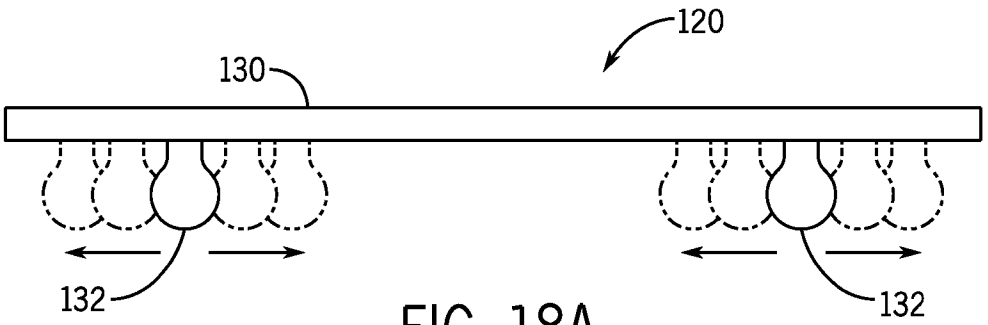
FIG. 18A is a front view of the bar assembly of FIG. 10 with the brackets being adjusted relative to the bar.

The bracket 132 may rigidly attach to the wall 22 and may be selectively fixed in position relative to the bar 130. Accordingly, the brackets 132 may be movable along the length of the bar 130 before installation. As shown in FIGS. 16A-16B, the bracket 132 may have an extended portion or an extension 142 that fits at least partially within and is movable or slidable within the channel 134 of the bar 130. As shown in FIGS. 17A-17B, the channel 134 may provide an area for the extension 142 of the bracket 132 to move within, thus allowing the bracket 132 to move along at least a portion of the length of the bar 130 (as shown in FIG. 18A). Accordingly, the bracket 132 may be selectively positioned along the bar 130 before the bracket 132 is fixed in position relative to the bar 130.

For example, as shown in FIG. 18A, the position of the brackets 132 may be adjusted along the length of the bar 130 according to the desired configuration (e.g., depending on the specific configuration of the bathing area 20 and to align with certain areas of the wall 22, such as the stud locations). In order to secure the bracket 132 in place along the length of the bar 130 once the brackets 132 are properly aligned relative to the bar 130, the bracket 132 may be screwed to the bar 130 through the extension 142 and into the channel 134.

Figure 18B:
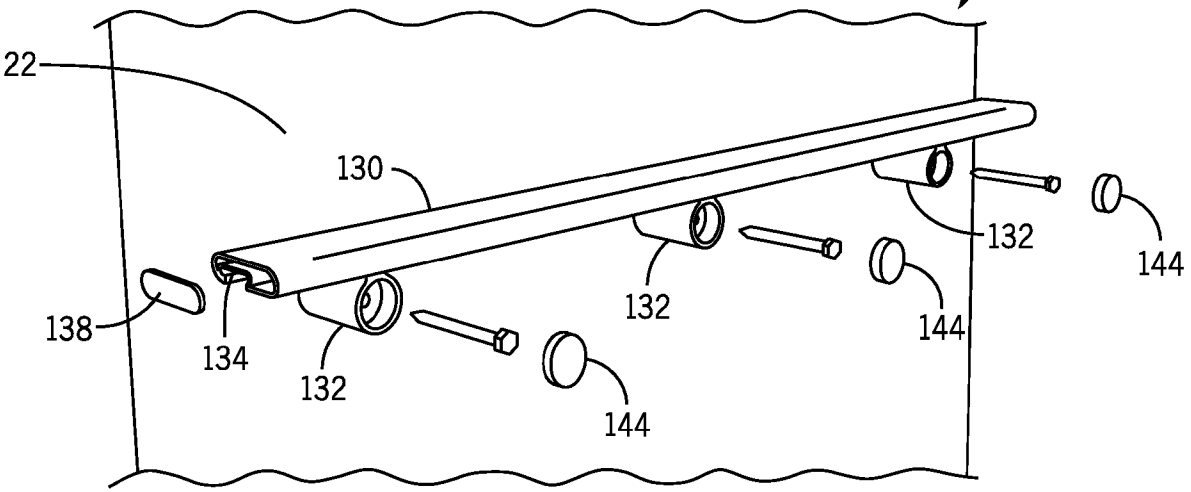
FIG. 18B is a perspective, exploded view of the bar assembly of FIG. 10 being installed.

The extension 142 of the bracket 132 may enter into the channel 134 of the bar 130 through at least one longitudinal end of the bar 130, as shown in FIG. 17B. Accordingly, the bar 130 may also include at least one cap or plug 138 (as shown in FIGS. 17A and 18B) that is attachable along the longitudinal ends of the bar 130 to prevent the brackets 132 from detaching from the bar 130 or falling out from the longitudinal ends of the bar 130 before the bracket 132 are secured in place or fixed in position relative to and along the bar 130. The plugs 138 may also maintain the desired look and style of the bar assembly 120.

The bar assembly 120 may be installed into new, existing, remolded, or "refreshed" bathing areas 20. As shown in FIG. 18B, the bar 130 may attach to the wall 22 through the brackets 132. For example, the brackets 132 may be bolted (with, for example, a lag bolt) into the wall 22. A set screw may be used to secure the location of the brackets 132 on the wall 22. The bolt and the open end of the brackets 132 may be concealed with a cover 144 to maintain the style and desired look of the bar assembly 120.

Figure 19A:
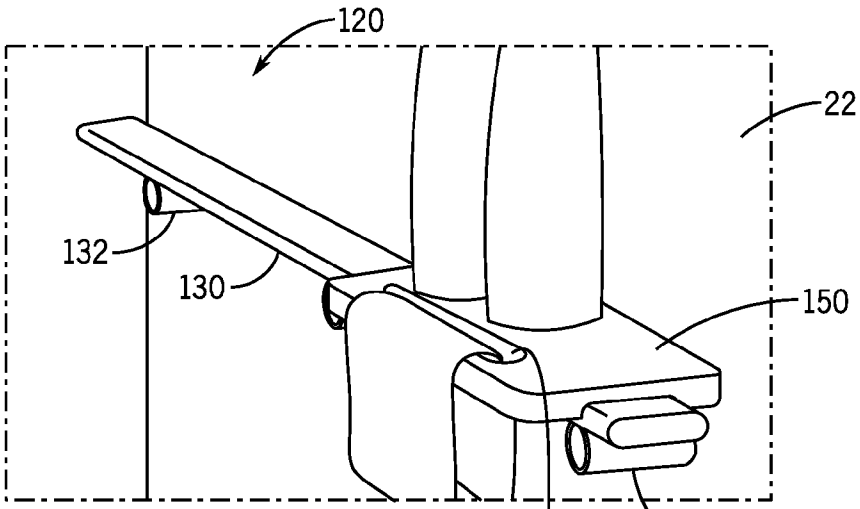
FIG. 19A is a perspective view of a bar assembly within a bathing area and with bathing accessories, according to yet another embodiment.
Figure 19B:
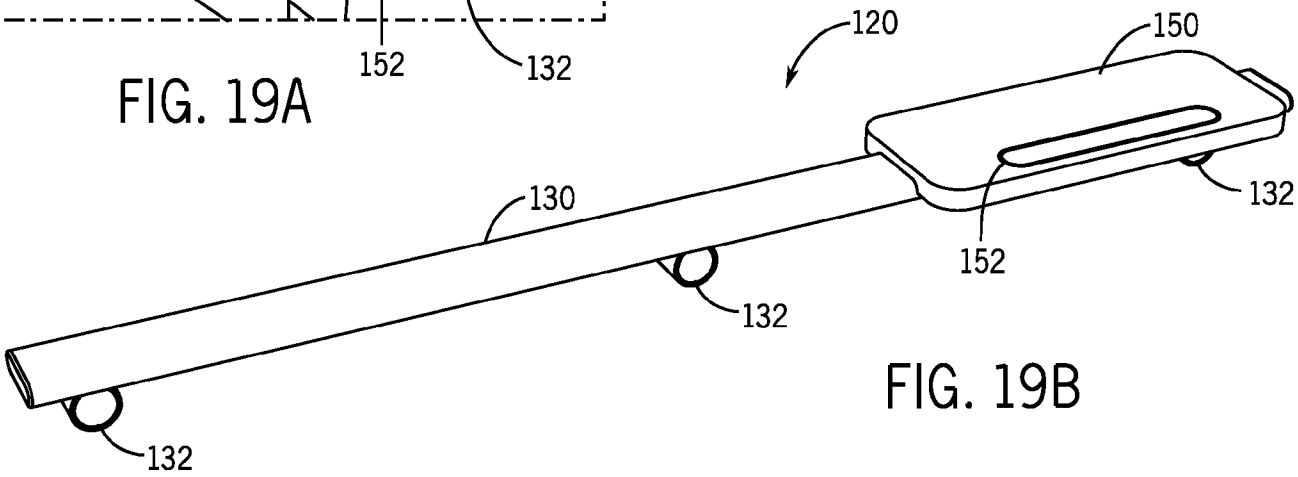
FIG. 19B is a perspective view of the bar assembly of FIG. 19A.

As shown in FIGS. 19A-19B, the bar assembly 120 may include an add-on tray or shelf 150, which may be selectively positioned anywhere along the length of the bar 130 and rigidly secured to the bar 130. The shelf 150 may provide a dedicated place or area to hold or secure bathing items along the bar 130. For example, the shelf 150 may provide a flat surface, stage, or steady surface for bathing items to rest on.

As shown in FIGS. 19A-19B, the shelf 150 may include a groove, opening, slot, or aperture 152 that extends through the shelf 150 to hold certain bathing items. For example, as shown in FIG. 19A, a washcloth may be fed through the aperture 152 and may hang from the shelf 150.

The shelf 150 may be any size (e.g., length or width) according to the desired configuration and desired amount of storage space on the bar assembly 120. The shelf 150 may be constructed out of a variety of different materials, including but not limited to wood, plastic, or metal (e.g., aluminum).

Figure 20A:
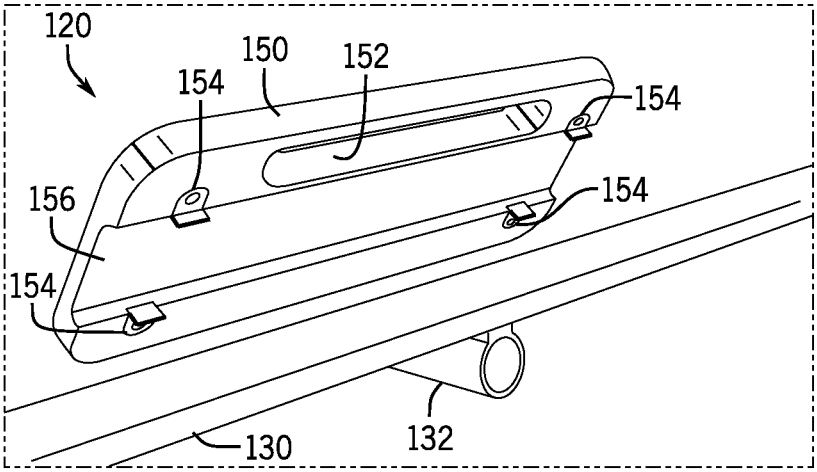
FIGS. 20A-20C are perspective views of a shelf being installed onto the bar of the bar assembly of FIG. 19A.
Figure 20B:
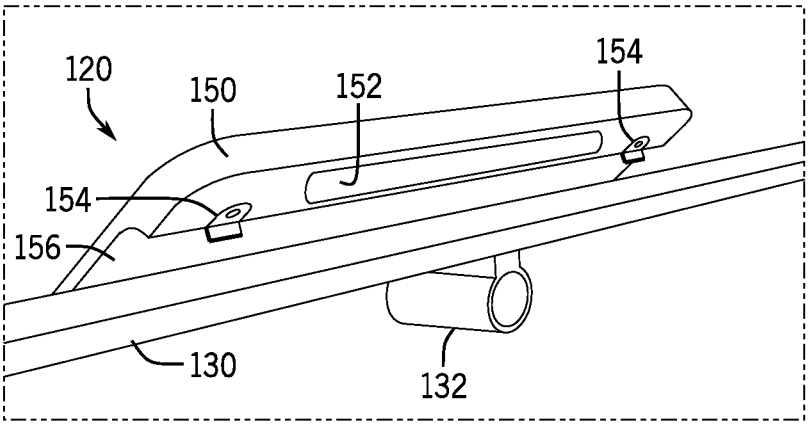
Figure 20C:
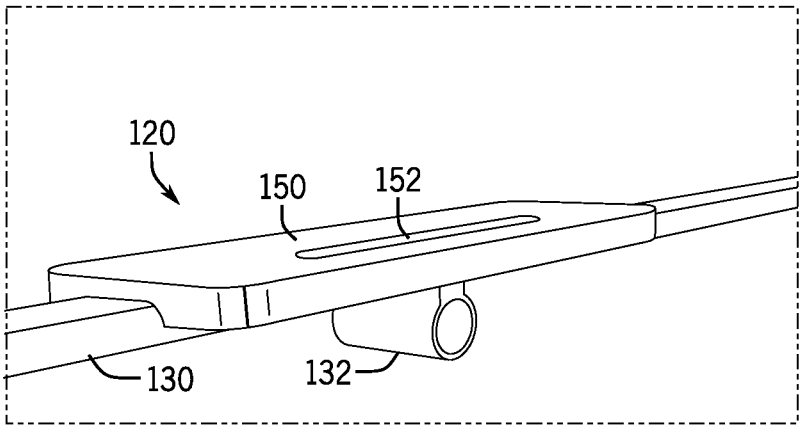

The shelf 150 may permanently or temporarily attach to the bar 130 through a variety of different mechanisms. For example, as shown in FIGS. 20A-20C, the shelf 150 may snap onto the bar 130. As shown in FIGS. 21A-21B, the shelf 150 may include a cut-out or recessed area or region 156 on the bottom surface of the shelf 150 and extending the length of the shelf 150. The recessed region 156 may have complementary geometry to or correspond with the shape (e.g., the width) of the top surface of the bar 130, such that the bar 130 fits at least partially within the recessed region 156 when the shelf 150 is rigidly secured to the bar 130. Accordingly, the recessed region 156 of the shelf 150 may fit at least partially around the top and a portion of the sides of the bar 130.

Figure 21C:
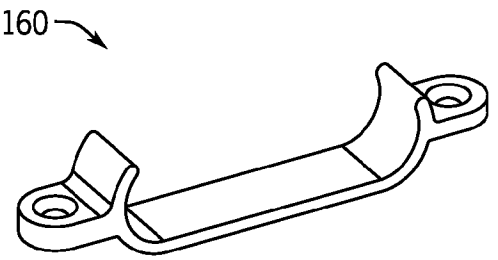
FIG. 21C is a top perspective view of an attachment member to attach the shelf of FIG. 21A to the bar of FIG. 19A.
Figure 21D:
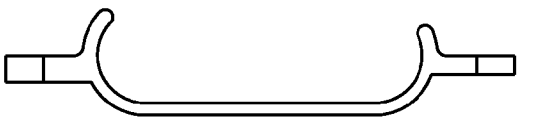
FIG. 21D is a front view of the attachment member of FIG. 21A.
Figure 21A:
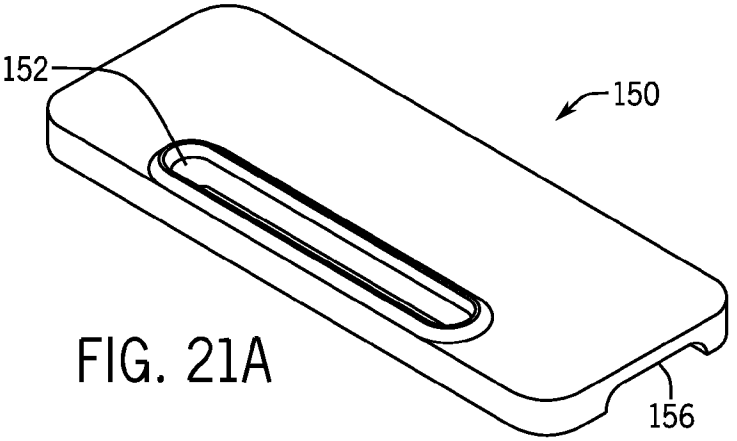
FIG. 21A is a top perspective view of the shelf of FIG. 19A.
Figure 21B:
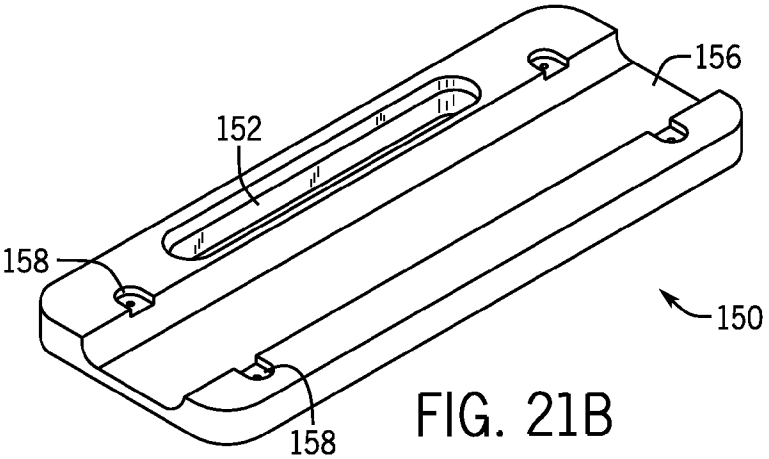
FIG. 21B is a bottom perspective view of the shelf of FIG. 19A.

Alternatively or additionally, the bar assembly 120 may include a shelf clip or attachment member 160 (as shown in FIGS. 21C-21D) to attach or secure the shelf 150 to the bar 130. The attachment member 160 may have complementary geometry to and extend around a bottom surface or portion of the bar 130 and optionally side portions of the bar 130. The attachment member 160 may attach (e.g., screw) to two portions 158 of the shelf 150, such as two longitudinal sides of the bottom surface of the shelf 150 that are along either side of the bar 130 (as shown in FIG. 21B). Alternatively or additionally, the bottom of the shelf 150 may include clips 154 to further help the shelf 150 to attach to either side of the bar 130. According to another embodiment, the shelf 150 may be screwed directly into the bar 130.

It is understood that the various configurations and embodiments of the bar assembly 120 may be used in conjunction with each other and in a variety of different configurations.

Bathing Area Storage Assembly

Figure 22B:
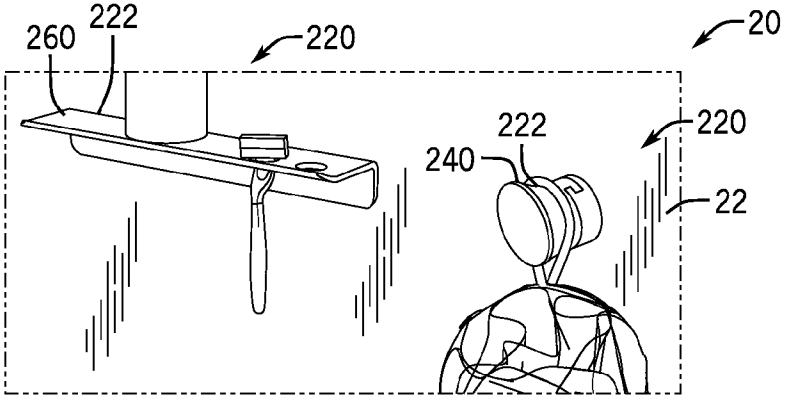
FIGS. 22A-22B are front and perspective views, respectively, of storage assemblies within a bathing area according to one embodiment.
Figure 22A:
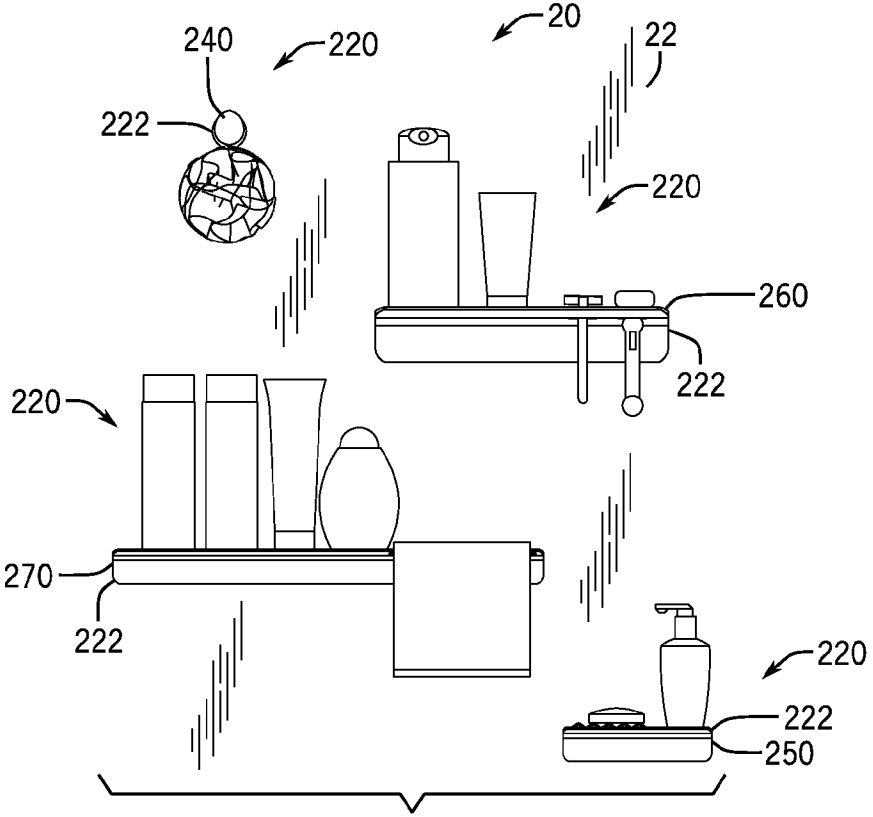
Figure 22C:
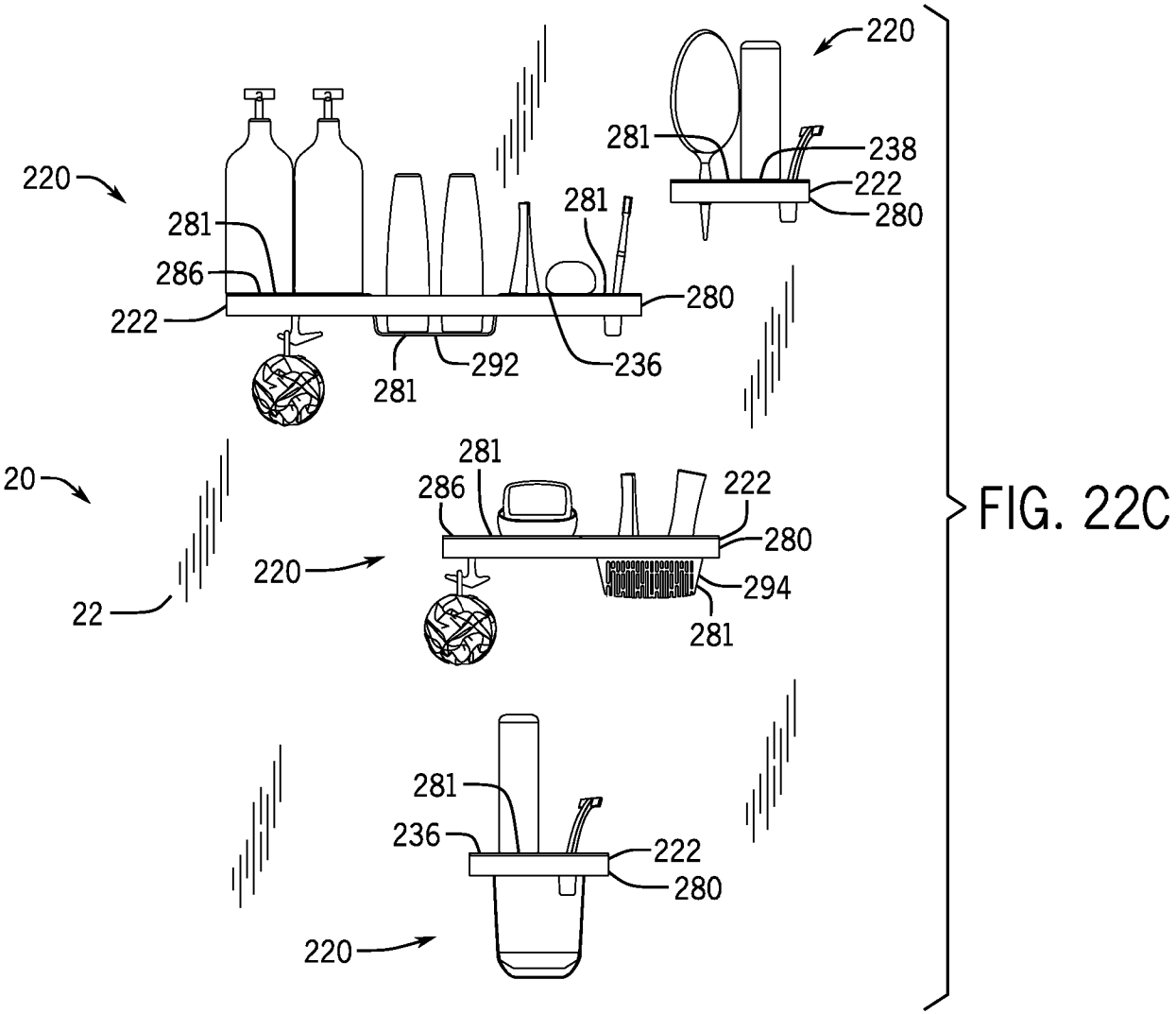
FIG. 22C is a front view of storage assemblies within a bathing area according to another embodiment.

According to another embodiment as shown in FIGS. 22-34, the bathing area 20 may include at least one storage assembly 220 to provide on-wall storage for showering or bathing items with the shower or bathing area 20, thereby improving the organization and look of the bathing area 20 without significantly reducing the available space within the bathing area 20. As shown in FIGS. 22A-22C, the storage assemblies 220 may be placed anywhere along the wall 22 of the bathing area 20, allowing the user to customize the storage within the bathing area 20 into a unique configuration. Further, the storage assemblies 220 may be installed into new, existing, remolded, or "refreshed" bathing areas 20.

The storage assembly 220 may include an adaptable or "floating" shelf or a storage device 222 for providing a storage or shelving area to hold various bathing accessories. The storage device 222 may be easily attachable to, removable from, and reattachable to the wall 22, which may be useful to allow the storage device 222 to be relocated along the wall 22 and/or to clean the wall 22 or the storage assembly 220. For example, the storage device 222, with the storage device attachment unit 224, may be moved around, relocated, and attached to other wall attachment units 226.

In order to attach the storage device 222 onto the wall 22, a universal attachment may be used, as shown in FIGS. 23-25. For example, a storage device attachment unit 224 may be attached (permanently or temporarily) on a back side of the storage device 222 and a wall attachment unit 226 may be attachable to a front surface of the wall 22. The storage device attachment unit 224 and the wall attachment unit 226 may have complementary geometry to each other and may removably interlock with each other in order to attach the storage device 222 to the wall 22. Accordingly, the storage device attachment unit 224 may be attachable to, removable from, and reattachable to the wall attachment unit 226.

The wall attachment unit 226 may be attachable to any location along the wall 22 of the bathing area 20. Depending on the desired use and configuration, multiple wall attachment units 226 may be attached to the wall 22 in order to provide multiple different attachment sites or locations for the storage device 222 and the storage device attachment unit 224 to attach to along the wall 22. The storage device 222 with the storage device attachment unit 224 may be moved to and attachable to any of the multiple wall attachment units 226 and therefore positioned anywhere along the wall 22 according to the desired configuration, as shown in FIG. 22A.

Figure 23A:
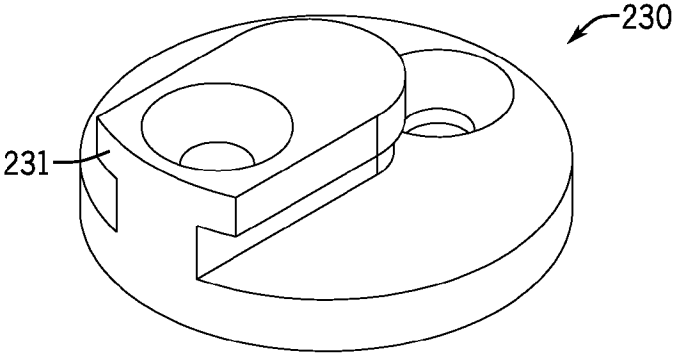
FIG. 23A is a perspective view of a male attachment unit according to one embodiment that may be used with the storage assemblies of FIGS. 22A-22C.
Figure 23C:
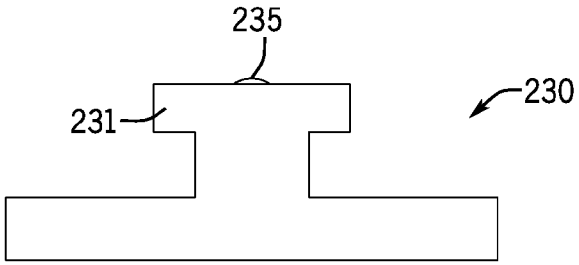
FIGS. 23B-23C are perspective and top views, respectively, of a male attachment unit according to another embodiment that may be used with the storage assemblies of FIGS. 22A-22C.
Figure 23B:
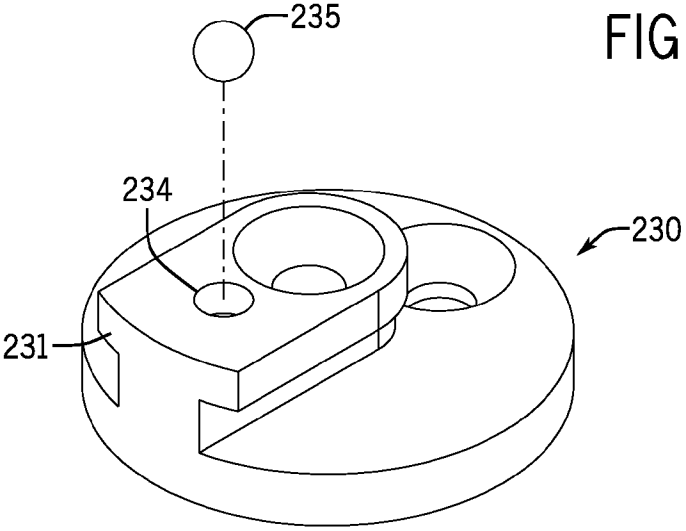
Figure 24A:
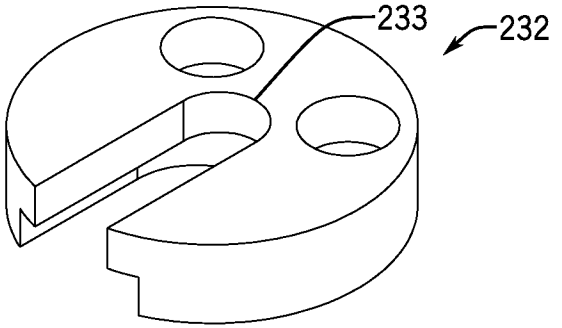
FIGS. 24A-24C are perspective views of female attachment units according to various embodiments that may be used within the storage assemblies of FIGS. 22A-22C.
Figure 24B:
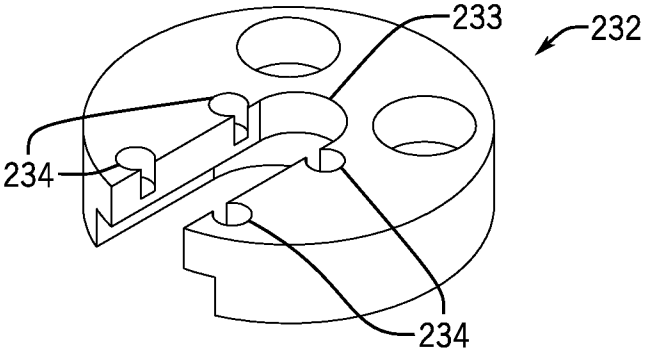
Figure 24C:
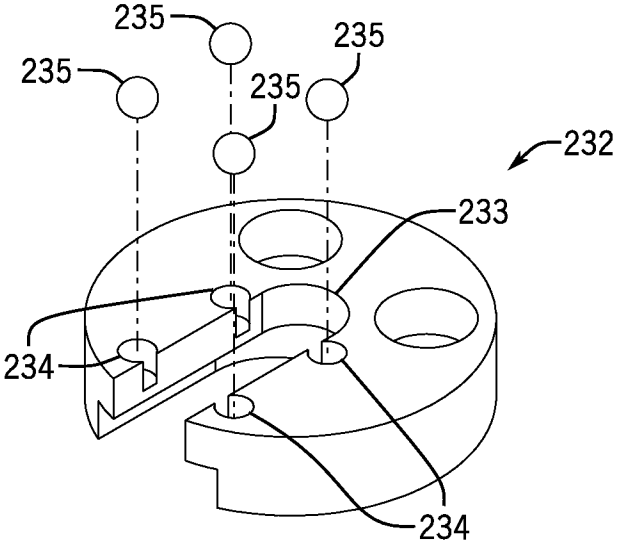
Figure 24D:
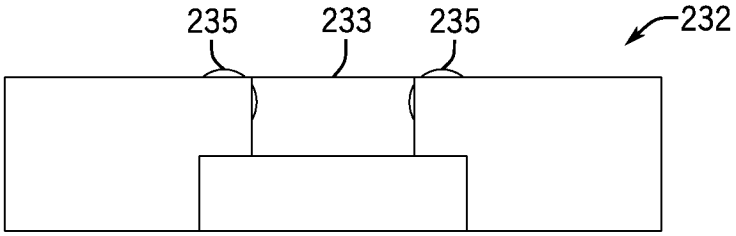
FIG. 24D is a top view of the female attachment unit of FIG. 24C with the ball bearings installed.
Figure 25B:
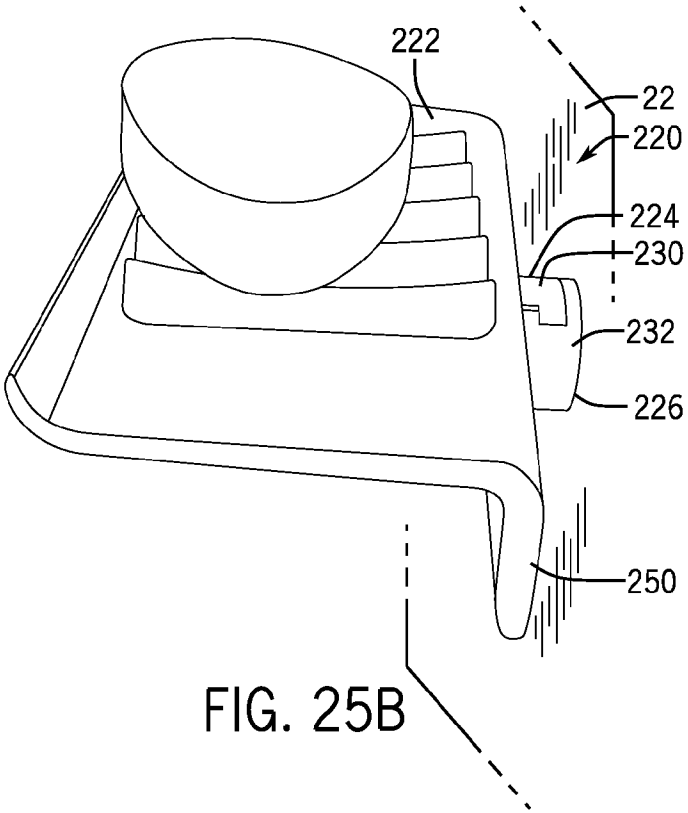
FIG. 25B is a side, perspective view of the storage device of FIG. 25A installed on the wall with the male attachment unit and the female attachment unit attached.

As shown in FIGS. 23-25, one of the storage device attachment unit 224 and the wall attachment unit 226 may be a cleat or a male attachment unit 230 (as shown in various embodiment in FIGS. 23A-23C) and the other of the storage device attachment unit 224 and the wall attachment unit 226 may be a puck or a female attachment unit 232 (as shown in FIGS. 24A-24D). A protrusion 231 of the male attachment unit 230 may fit within and secure to or be inserted at least partially into or around a slot 233 of the female attachment unit 232 to connect and secure the attachment units 230 and 232 together (as shown in FIG. 25B).

As shown in FIGS. 23A-23C, the male attachment unit 230 may have an extended area, extension, or protrusion 231 to attach into the female attachment unit 232. The protrusion 231 may include a lateral extension extending from the body of the slot 233 to extend into the slot 233 and a longitudinal extension extending from either side of the lateral extension (such that the male attachment unit 230 includes, for example, a "T" shape) to prevent the male attachment unit 230 from moving laterally out from the female attachment unit 232.

As shown in FIGS. 24A-24D, the female attachment unit 232 may include a slot 233 for at least a portion of the protrusion 231 of the male attachment unit 230 to slide or key into in order to attach the storage device 222 to the wall 22. The outermost portion of the slot 233 may include longitudinal walls with a slit therebetween. The lateral extension of the male attachment unit 230 may extend between the longitudinal walls and the longitudinal extension of the male attachment unit 230 may be positioned further within the slot 233 (e.g., beyond the longitudinal walls) to create a secure attachment therebetween.

According to one embodiment as shown in FIGS. 23B-23C and 24B-24D, the male attachment unit 230 and/or the female attachment unit 232 may have at least one ball, bearing, or ball bearing 235. The ball bearing 235 may be configured to roll between the male attachment unit 230 and the female attachment unit 232 during attachment. Accordingly, the ball bearing 235 may allow the male attachment unit 230 and the female attachment unit 232 to slide easier and more freely relative to one another during attachment as well as securely hold the male attachment unit 230 and the female attachment unit 232 together after attachment.

The ball bearing 235 may use frictional forces to keep the male attachment unit 230 and the female attachment unit 232 together. Further, the ball bearing 235 may create a tight compression fit between the male attachment unit 230 and the female attachment unit 232 in order to prevent unnecessary movement or wobble. The ball bearing 235 may be a variety of materials, including but not limited to metal, acetal, or nylon.

Any number and positioning of the ball bearings 235 may be used according to the desired configuration. As shown in FIG. 23B, the ball bearing 235 may be inserted into and roll within a slot, recess, or divot 234 within a portion, such as the protrusion 231, of the male attachment unit 230 in order to interact with a portion of the slot 233 of the female attachment unit 232. As shown in FIG. 23C, the ball bearings 235 may extend out of a top surface of the protrusion 231 of the male attachment unit 230 in order to interact with the slot 233 of the female attachment unit 232.

As shown in FIG. 24C, the female attachment unit 232 may include multiple ball bearings 235 (as shown, the female attachment unit 232 includes four ball bearings 235, though it is understood that each of the male attachment unit 230 and the female attachment unit 232 may include any number of ball bearings 235). The ball bearings 235 may be inserted into divots 234 along either side of the slot 233 of the female attachment unit 232 and may interact with a portion of the protrusion 231 of the male attachment unit 230. As shown in FIG. 24D, the bearings 235 may extend out of the top surface of the female attachment unit 232 and the side surfaces of the slot 233 in order to interact with the protrusion 231 of the male attachment unit 230.

Figure 25A:
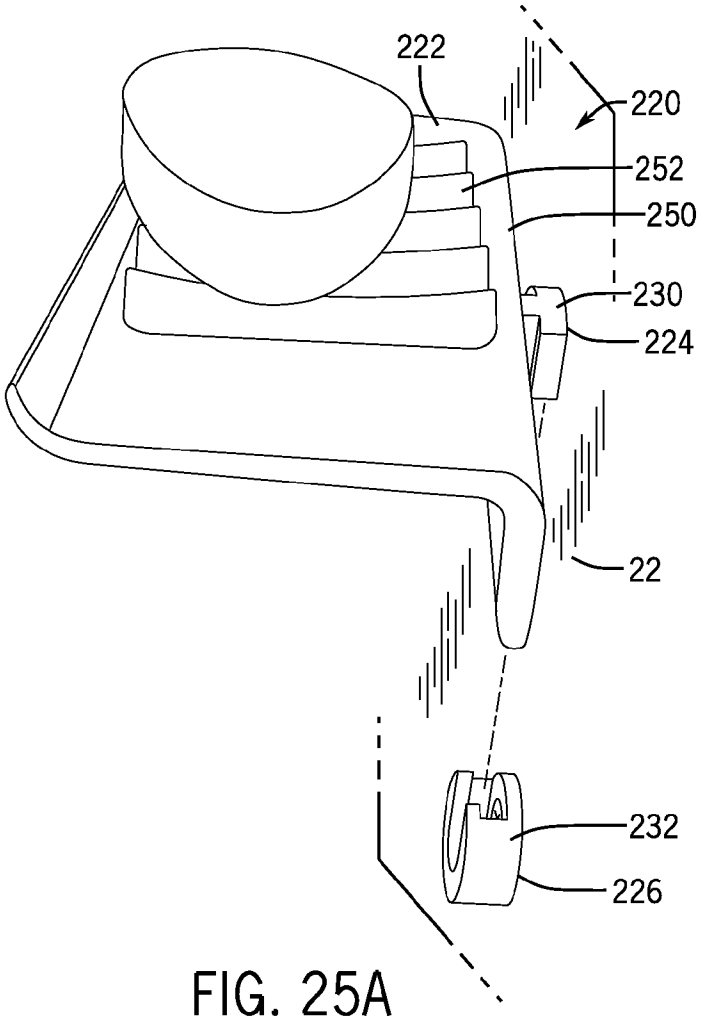
FIG. 25A is a perspective view of a male attachment unit on a storage device detached from a female attachment unit on a wall according to one embodiment.
Figure 26:
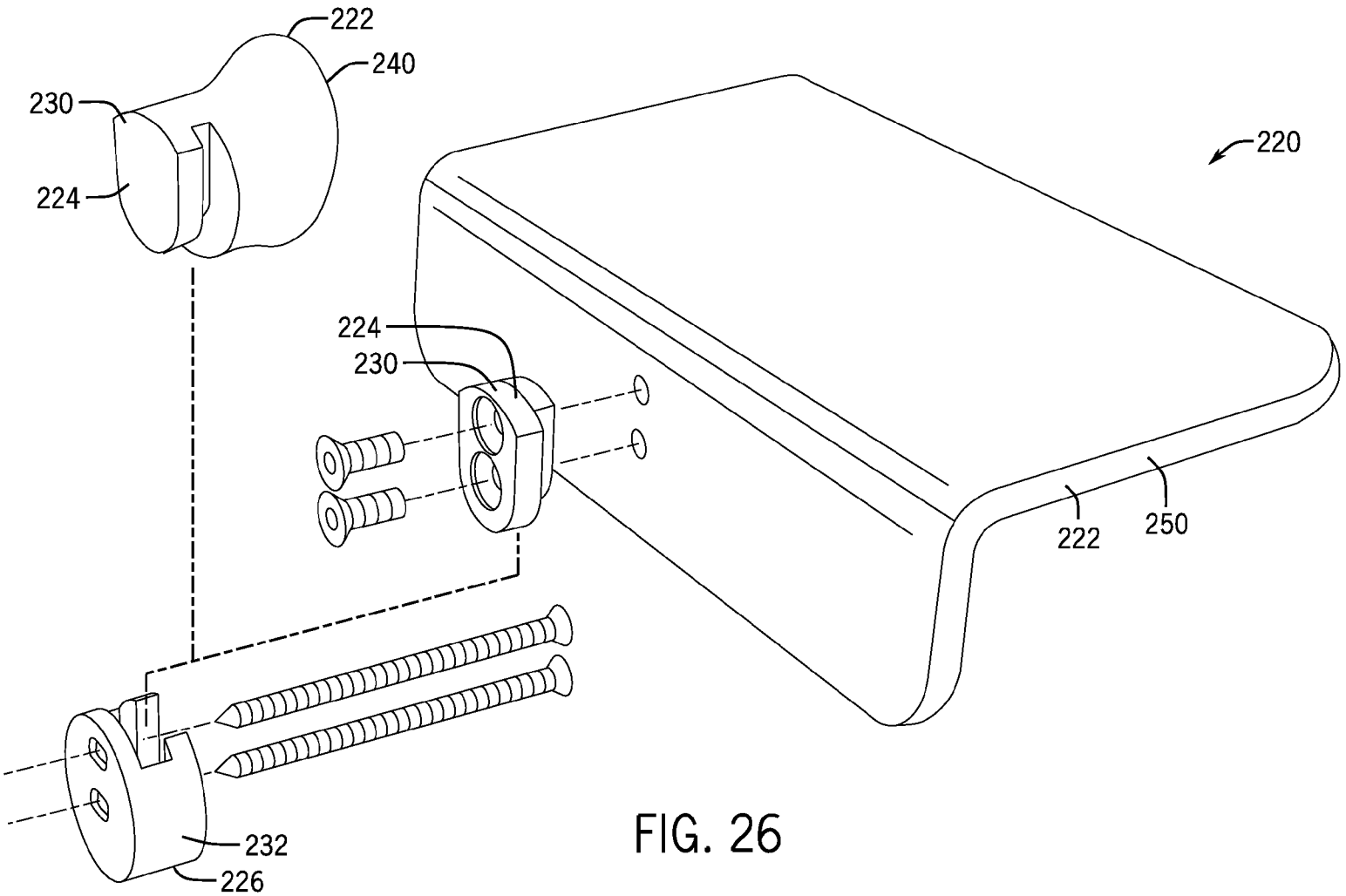
FIG. 26 is a perspective, exploded view of two of the storage assemblies of FIG. 22A showing how each of the storage assemblies is attachable to a female attachment unit.
Figure 27B:
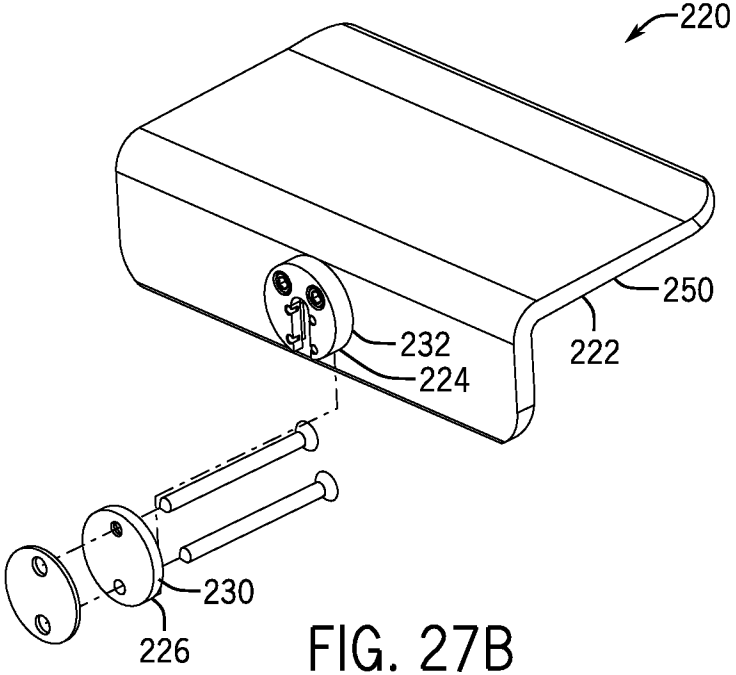
FIGS. 27A-27B are perspective, exploded views of a storage assembly of FIG. 22A being assembled and installed according to one embodiment.
Figure 27A:
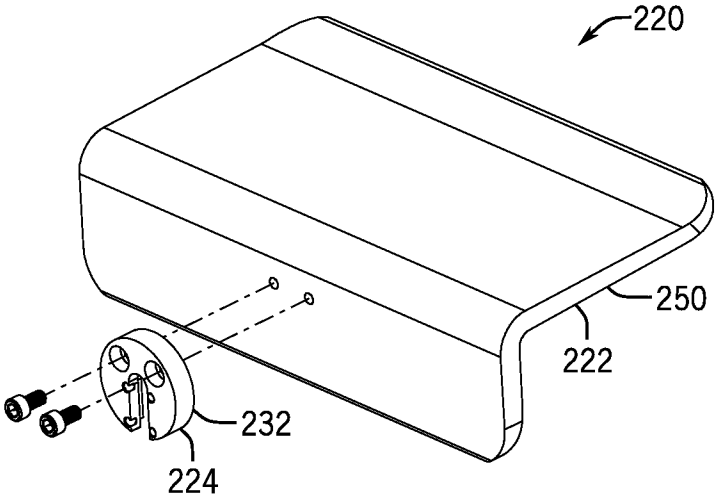
Figure 28:
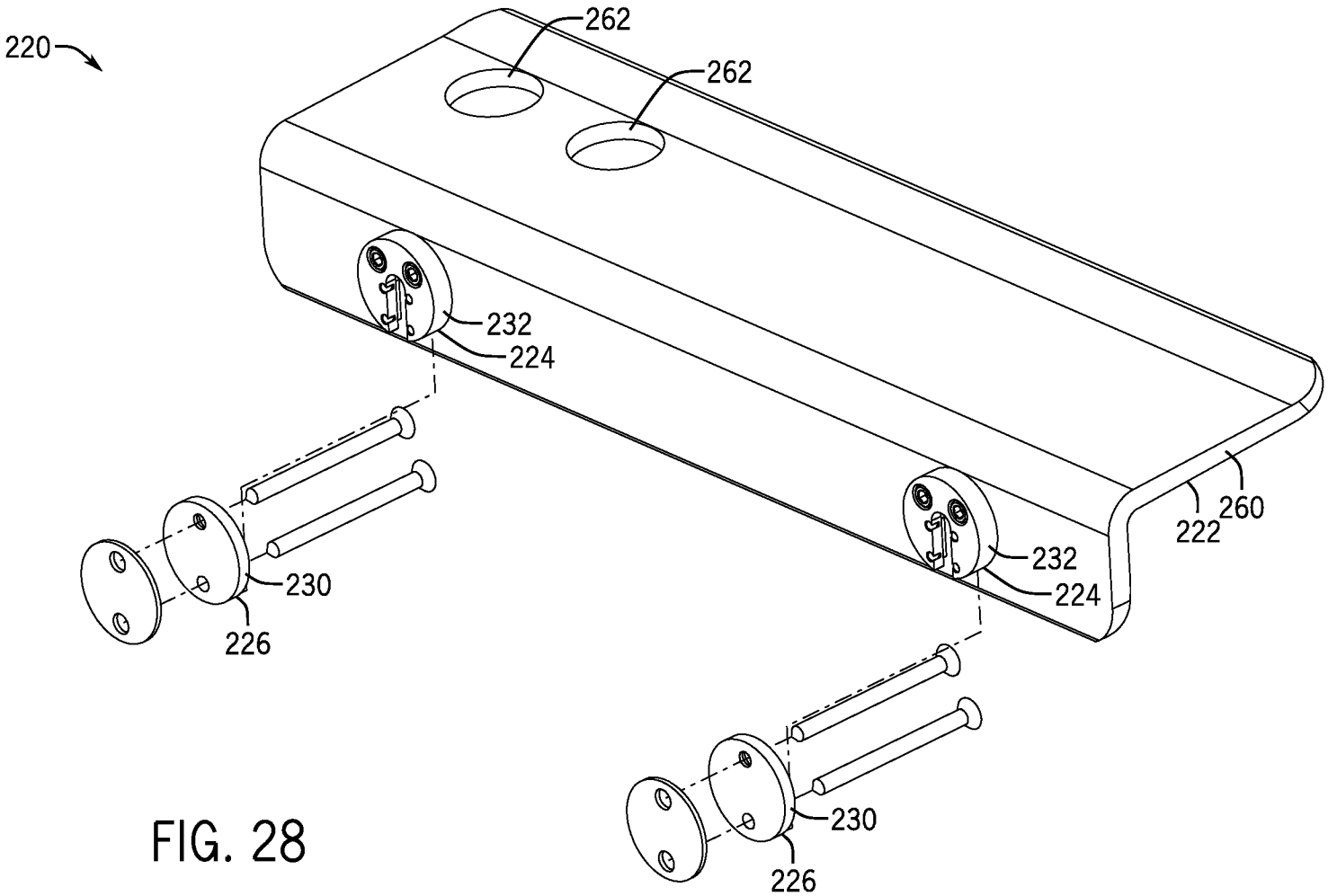
FIG. 28 is a perspective, exploded view of a storage assembly of FIG. 22A being installed according to another embodiment.

In order to install and mount the storage device 222 to the wall 22, the storage device attachment unit 224 (which may be either the male attachment unit 230 or the female attachment unit 232) may be mounted to the back of the storage device 222 with, for example, screws, as shown in FIGS. 25A, 26, and 27A. The wall attachment unit 226 (which may be the other of the male attachment unit 230 and the female attachment unit 232) may be mounted to the wall 22 with, for example, screws, as shown in FIGS. 25A, 26, and 27B. Depending on the size of the storage device 222 and the desired strength, single or multiple storage device attachment units 224 may be included on the storage device 222, as shown in FIGS. 27-28, to attach to single or multiple wall attachment units 226 on the wall 22.

Once the storage device attachment unit 224 and the wall attachment unit 226 are mounted to the storage device 222 and the wall 22, respectively (as shown in FIG. 25A), storage device attachment unit 224 (with the storage device 222) and the wall attachment unit 226 may be attached together by sliding the protrusion 231 of the male attachment unit 230 into the slot 233 of the female attachment unit 232, thus attaching the storage device 222 to the wall 22 (as shown in FIGS. 25B). The storage device attachment unit 224 and the wall attachment unit 226 may snap or click together to ensure a solid attachment.

As shown in FIG. 25B, the storage device attachment unit 224 and/or the wall attachment unit 226 may attach together such that there is a space, separation, or gap for drainage between the storage device 222 and the wall 22. Accordingly, liquid (e.g., water) may move or drain down the wall 22 (between the wall 22 and the storage device 222), which may prevent liquid accumulation.

The storage device 222 may be a variety of different units or components to tailor to the user's storage needs and bathing area space. Optionally, the wall 22 of the bathing area 20 may include multiple storage assemblies 220 with different or multiple types of storage devices 222. According to one embodiment, the storage device 222 may be a peg 240, a soap shelf 250, a holed shelf 260, or a slotted shelf 270. According to another embodiment, the storage device 222 may be a rim or frame 280 with a removable storage feature 281. However, it is understood the storage device attachment unit 224 may be attached to a variety of different other bathing accessories, including but not limited to a toy basket, a towel bar, a grooming mirror, etc.

Figure 29A:
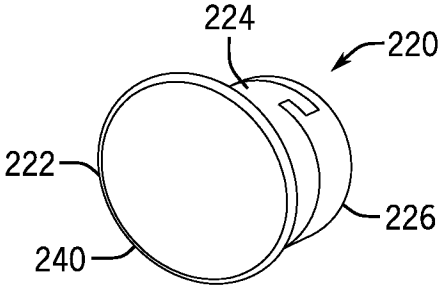
FIG. 29A is a front perspective view of storage device of FIG. 22A that is a peg.
Figure 29B:
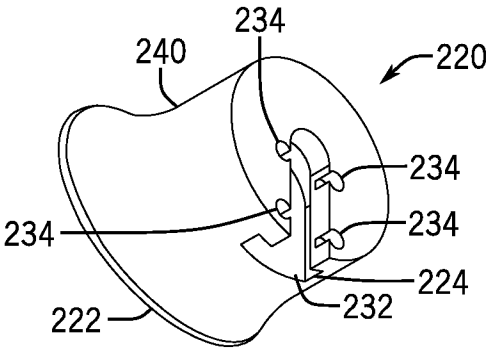
FIG. 29B is a back perspective view of the peg of FIG. 29A.
Figure 29C:
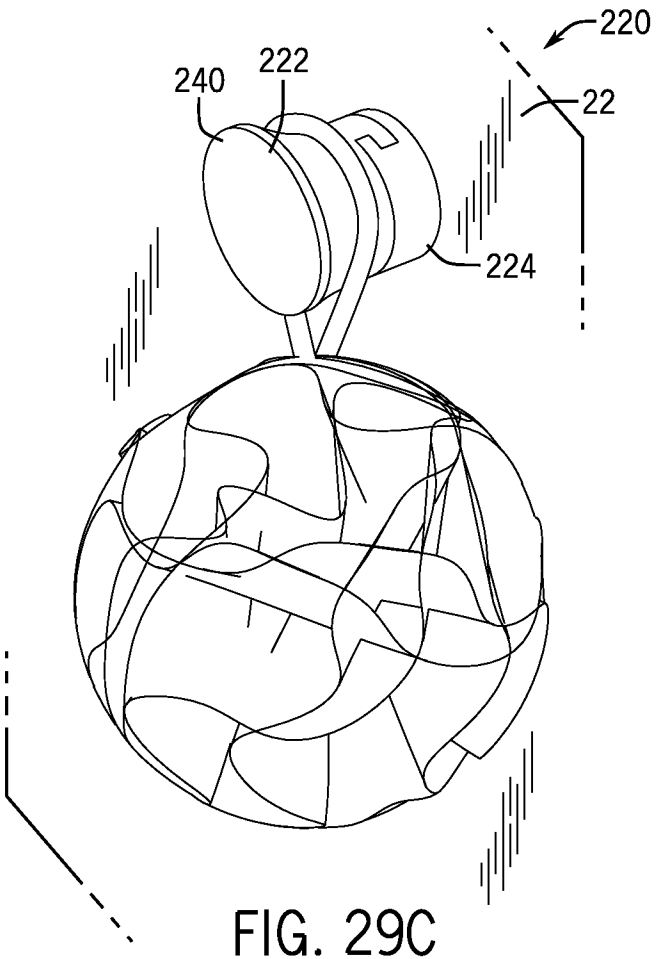
FIG. 29C is a side perspective view of the peg of FIG. 29A installed on a wall.

As shown in FIGS. 29A-29C, the hook or peg 240 may be useful for hanging various bathing items, such as loofahs, squeegees, washcloths, and robes. The front side of the peg 240 may be angled upward to prevent the bathing items from sliding off. According to one embodiment as shown in FIG. 29B, the storage device attachment unit 224 may be built into the peg 240 such that the peg 240 may directly attach to the wall attachment unit 226.

The shelves 250, 260, and 270 include a shelf side for storing bathing accessories and a back side for attachment to the storage device attachment unit 224 (and thus to the wall attachment unit 226). The shelf side and the back side may be substantially perpendicular to each other such that the shelves 250, 260, and 270 protrude or extend away from the wall 22 when attached to the wall 22. The flat shelf side may include a substantially flat storage plane, portion, or surface for holding various bathing accessories and an upturned front lip or edge. The front edge may be angled upward to prevent any bathing items from falling off.

Figure 30C:
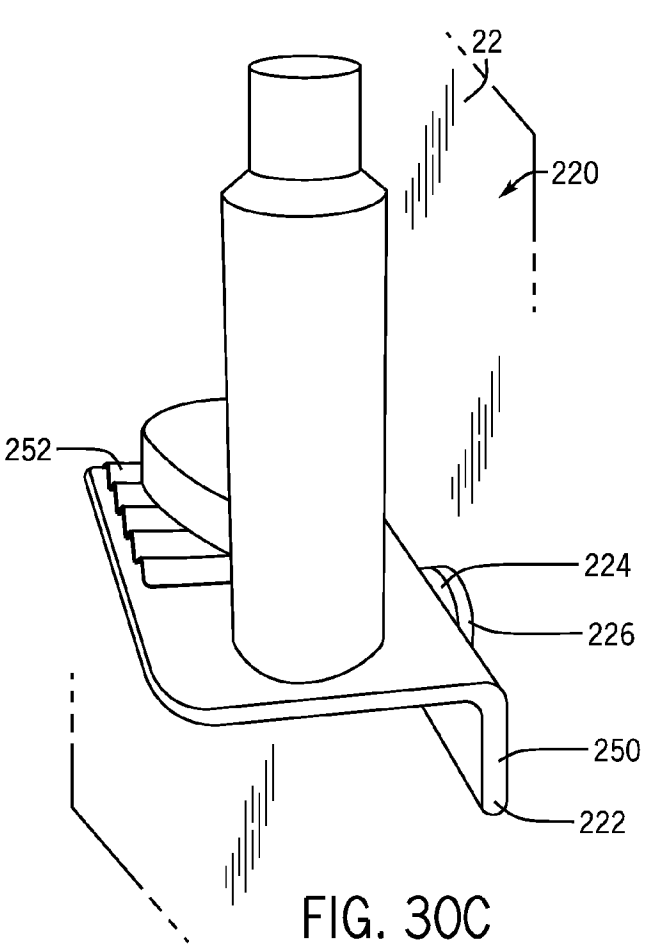
FIG. 30C is a perspective view of the shelf and the soap tray of FIG. 30A installed on a wall.
Figure 30A:
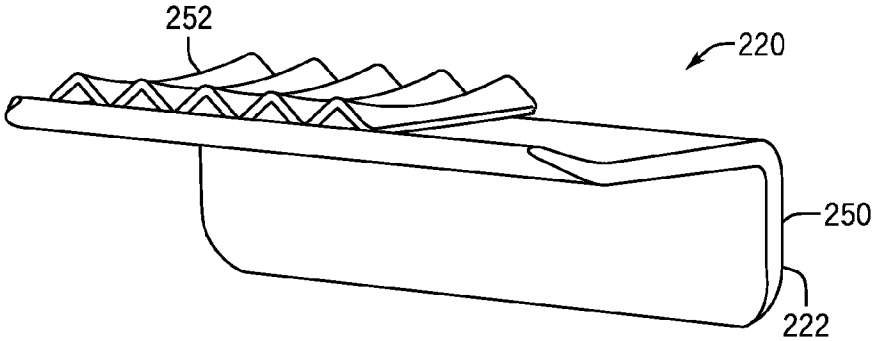
FIG. 30A is a perspective view of a storage device of FIG. 22A that is a shelf and a soap tray.
Figure 30B:
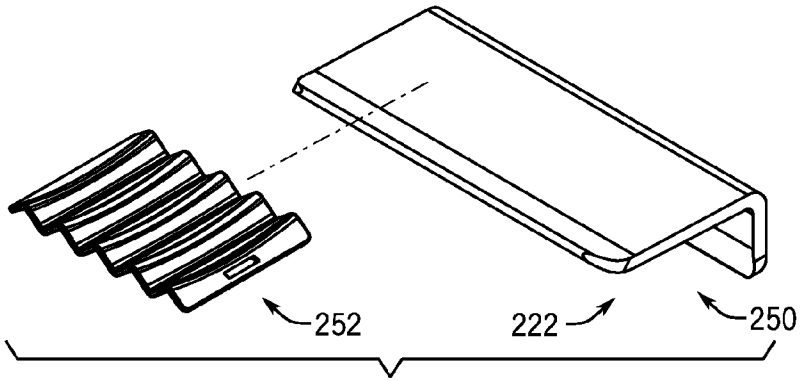
FIG. 30B is a perspective, exploded view of the shelf and the soap tray of FIG. 30A.

As shown in FIGS. 30A-30C, the soap shelf 250 may be a relatively smaller shelf for soap and/or smaller bottles. The soap shelf 250 may optionally include a removable soap pad or tray 252 on top of the soap shelf 250 to prevent a bar of soap from getting soggy or sliding off of the soap shelf 250. The soap tray 252 may have multiple folds, creases, or crevices to allow liquid to drain from the bar of soap. The soap tray 252 may be a variety of materials, including but not limited to rubber (e.g., silicone rubber).

The soap shelf 250 may be a variety of sizes. According to one embodiment, the length of the soap shelf 250 is approximately 5 to 12 inches. According to another embodiment, the length of the soap shelf 250 is approximately 7 inches.

Figure 31A:
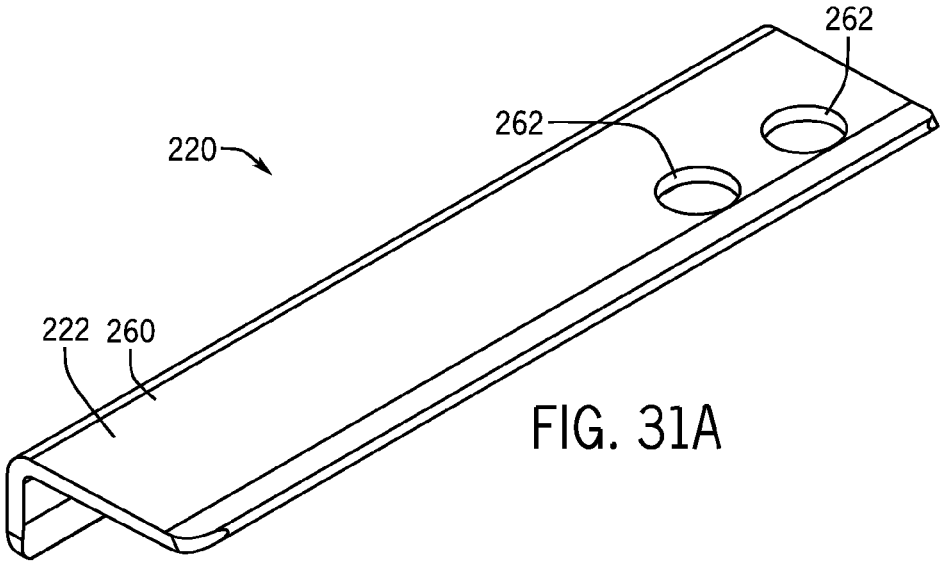
FIG. 31A is a top perspective view of storage device of FIG. 22A that is a shelf with at least one aperture.
Figure 31B:
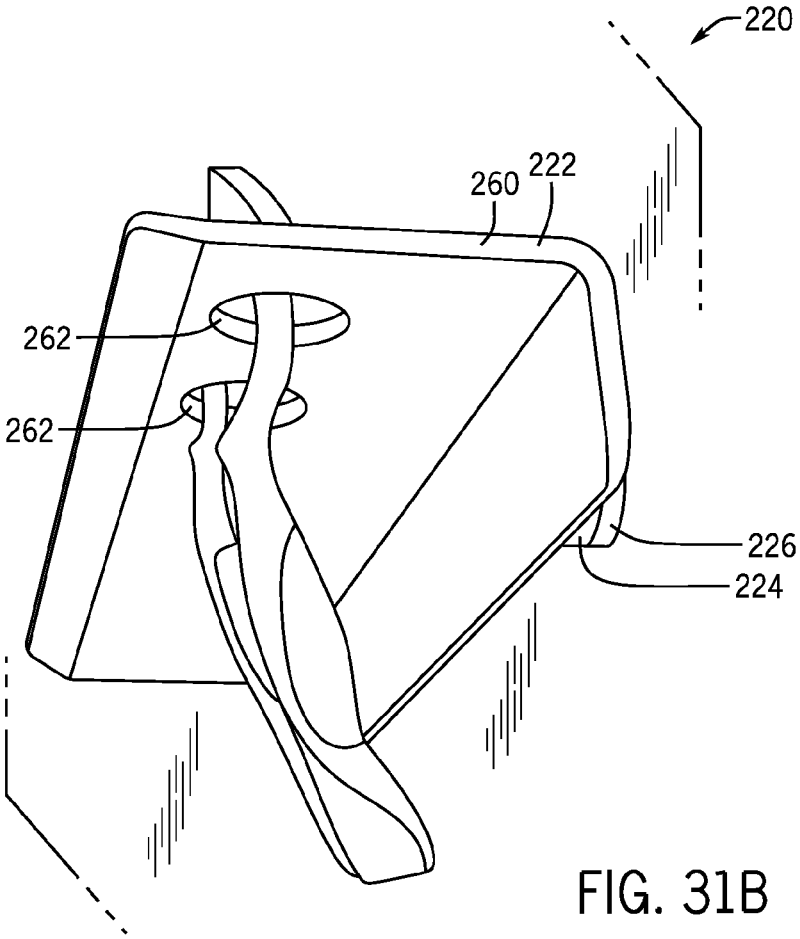
FIG. 31B is a bottom perspective view of the shelf of FIG. 31A installed on a wall.

As shown in FIGS. 31A-31B, the holed shelf 260 may include a flat storage surface and at least one hole, opening, or aperture 262 on the shelf side. The flat storage surface may be used to hold soap or a bottle, while the aperture 262 may be used to secure or hold a toothbrush or razor.

The holed shelf 260 may be a variety of sizes. According to one embodiment, the length of the holed shelf 260 is approximately 10 to 20 inches. According to another embodiment, the length of the holed shelf 260 is approximately 14 inches.

Figure 32A:
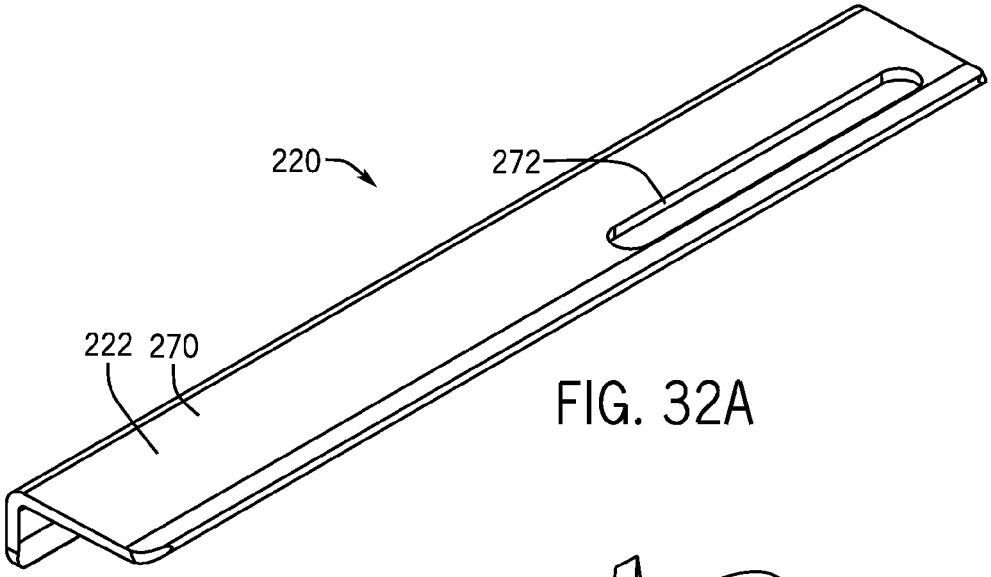
FIG. 32A is a perspective view of a storage device of FIG. 22A that is a slotted shelf.
Figure 32B:
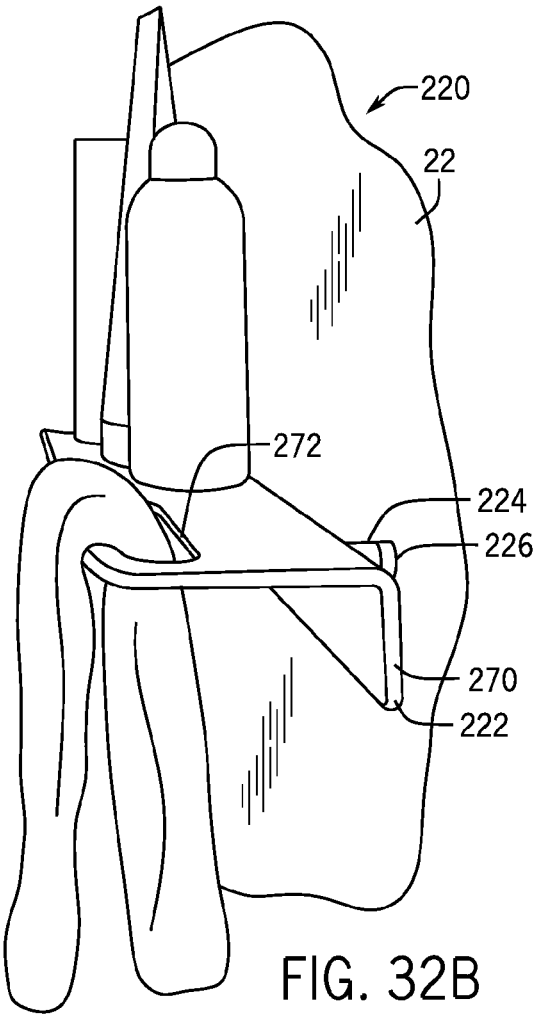
FIG. 32B is a perspective view of the slotted shelf of FIG. 32A.

As shown in FIGS. 32A-32B, the slotted shelf 270 may include a flat storage surface and at least one an opening or slot 272. The flat storage surface may be used to hold larger bottles, while the slot 272 may be used to hang towels, such as washcloths or larger towels.

The slotted shelf 270 may be a variety of sizes. According to one embodiment, the length of the slotted shelf 270 is approximately 15 to 30 inches. According to another embodiment, the length of the slotted shelf 270 is approximately 21 inches.

Figure 33A:
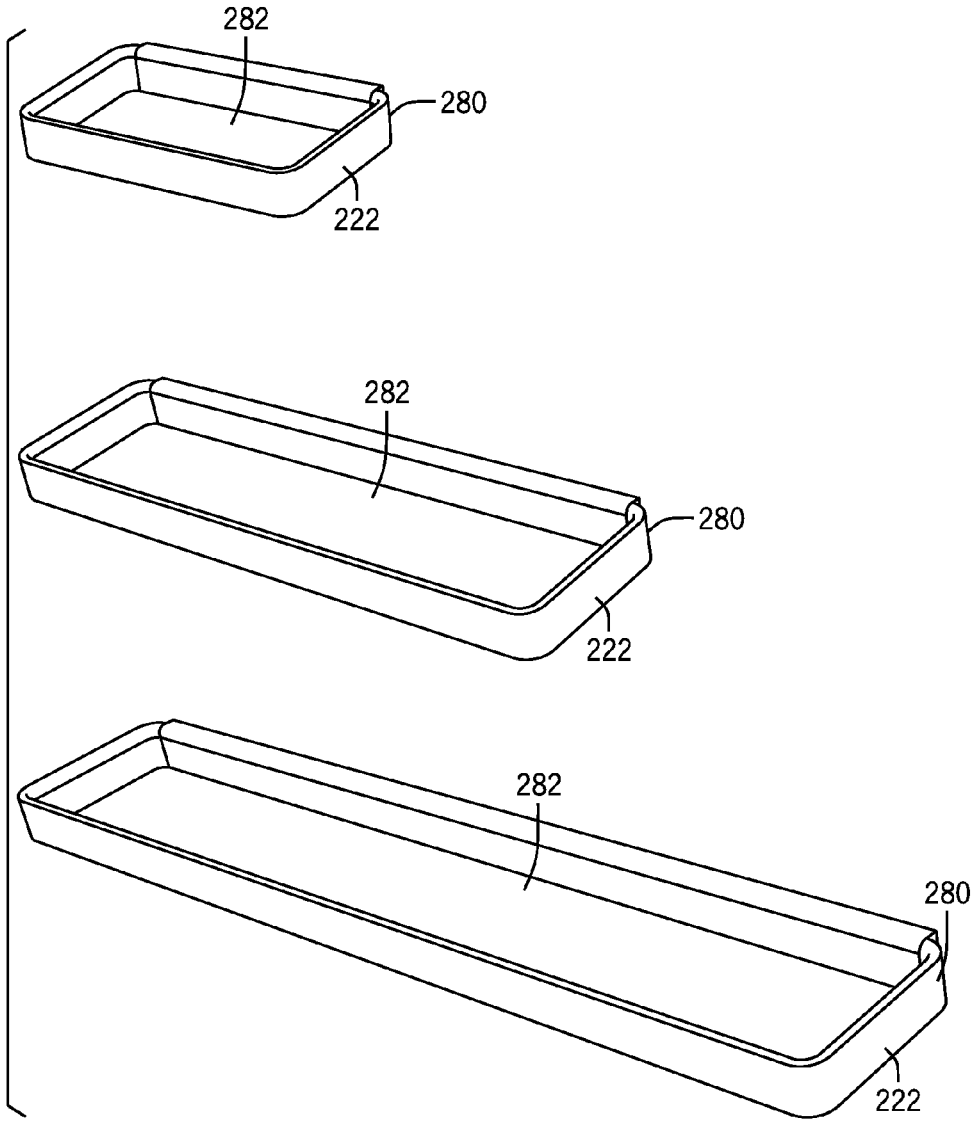
FIG. 33A is perspective views of frames of the storage assemblies of FIG. 22C.
Figure 33B:
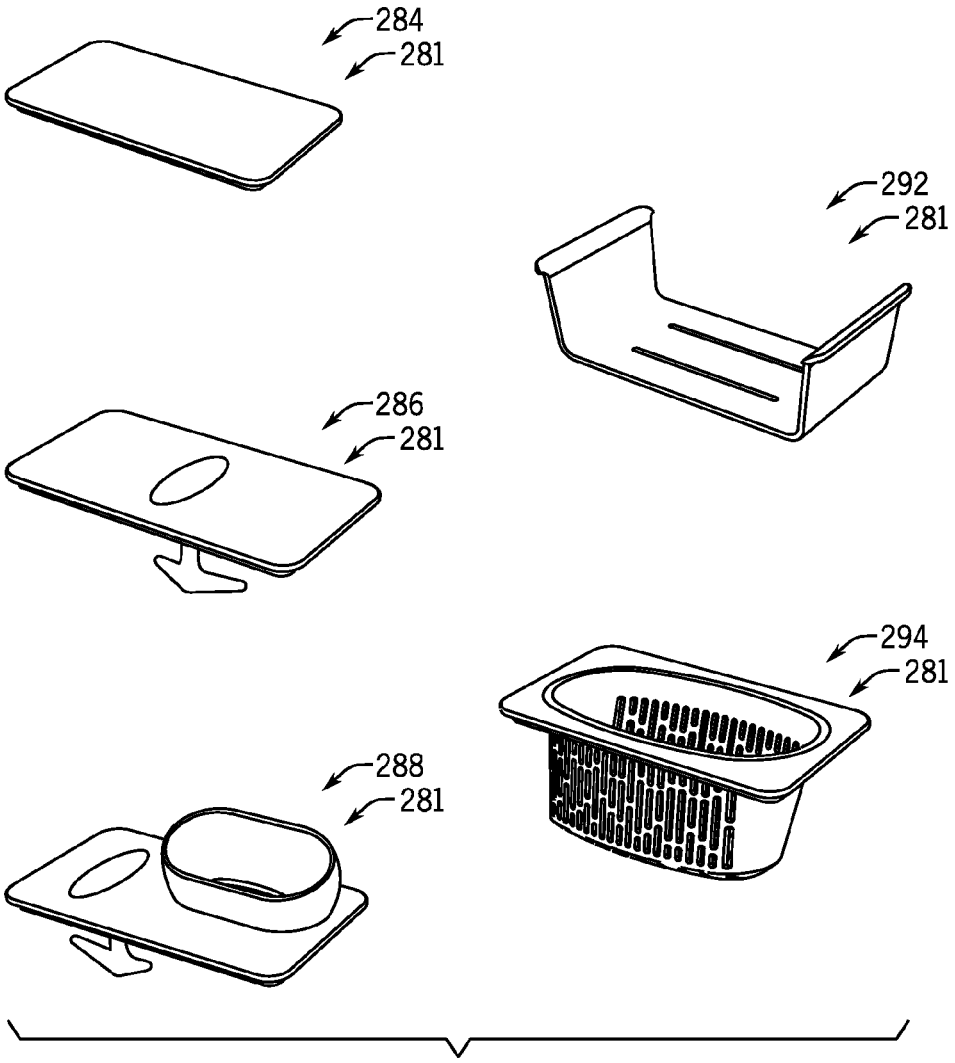
FIG. 33B is perspective views of removable storage features of FIG. 22C.
Figure 34B:
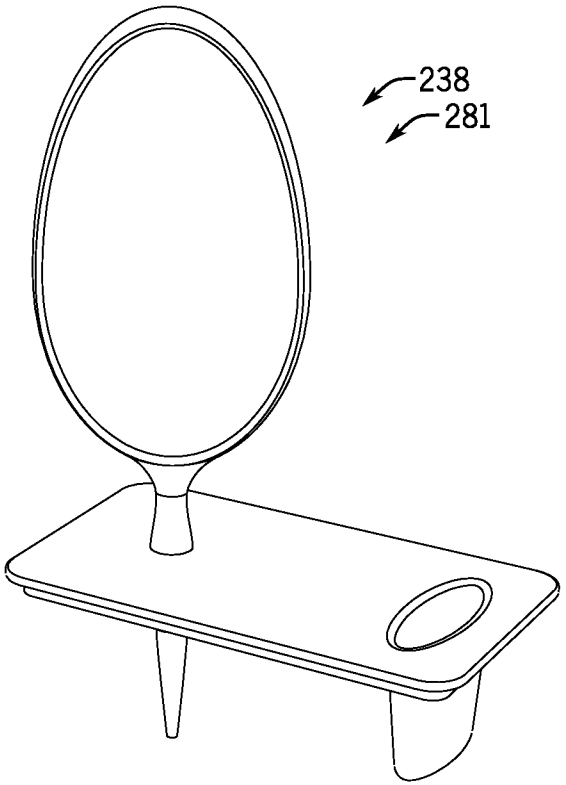
FIGS. 34A-34B are perspective views of removable storage features of FIG. 22C.
Figure 34A:
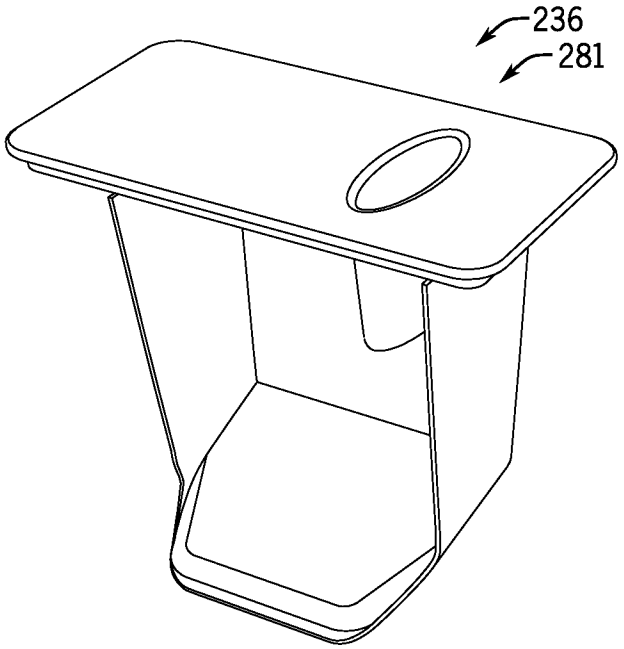

According to another embodiment as shown in FIG. 33A, the storage device 222 may be a rim or frame 280 with an aperture 282. The frame 280 may be a variety of different lengths and thus may hold one or multiple removable storage features 281, as shown in FIG. 22. For example, one frame 280 may support one, two, three, or more removable storage features 281 at the same time to provide additional storage space or different storage components according to the need of the user. Any number or combination of the various removable storage features 281 may be attached or held along the length of the frame 280 when the frame 280 is long enough to hold more than one removable storage feature 281.

The user may rearrange, transfer, or remove the removable storage features 281 from the frame 280 according to the desired confirmation. Alternatively or additionally, the frame 280 may be removed from the wall 22 and rearranged and reattached to another area of the wall 22, as described further herein with the storage device attachment unit 224 and the wall attachment unit 226.

Optionally, multiple frames 280 may be positioned along the wall 22 with the storage device attachment units 224 and the wall attachment units 226. Accordingly, the various removable storage features 281 may be transferred between the frames 280 according to the desired storage configuration and look.

The removable storage feature 281 may be attachable to the frame 280. Accordingly, the removable storage feature 281 may fit within the frame 280 and potentially at least partially through the aperture 282 of the frame 280. The removable storage feature 281 may have a lip or edge that may rest along or be secured to a top portion of the frame 280 to prevent the removable storage feature 281 from falling through the aperture 282.

A variety of different removable storage features 281 may be compatible with the frame 280, as shown in FIGS. 22C, 33B, and 34A-34B. For example, the removable storage feature 281 may include at least one of a flat surface, a recessed surface, a slot, a basket, a hook, a container, a hole, and a lower shelf connected to an upper shelf Accordingly, the removable storage feature may be a flat surface 284, a hooked surface 286, a hook surface 288 with an additional container, a slotted lower or recessed shelf 292, a basket 294, a toothbrush/razor holder 236 with a shelf, or a mirror and toothbrush shelf 238.

However, it is understood that the various removable storage features 281 may be independently attached to the wall 22 with the storage device attachment unit 224 and the wall attachment unit 226.

The various components of the storage assembly 220 may be constructed out of a variety of materials, such as metal (e.g., aluminum, such as anodized aluminum or powder coated aluminum). It is understood that the various configurations and embodiments of the storage assembly 220 may be used in conjunction with each other and in a variety of different configurations.

Bathing Area Seat Assembly

Figure 35:
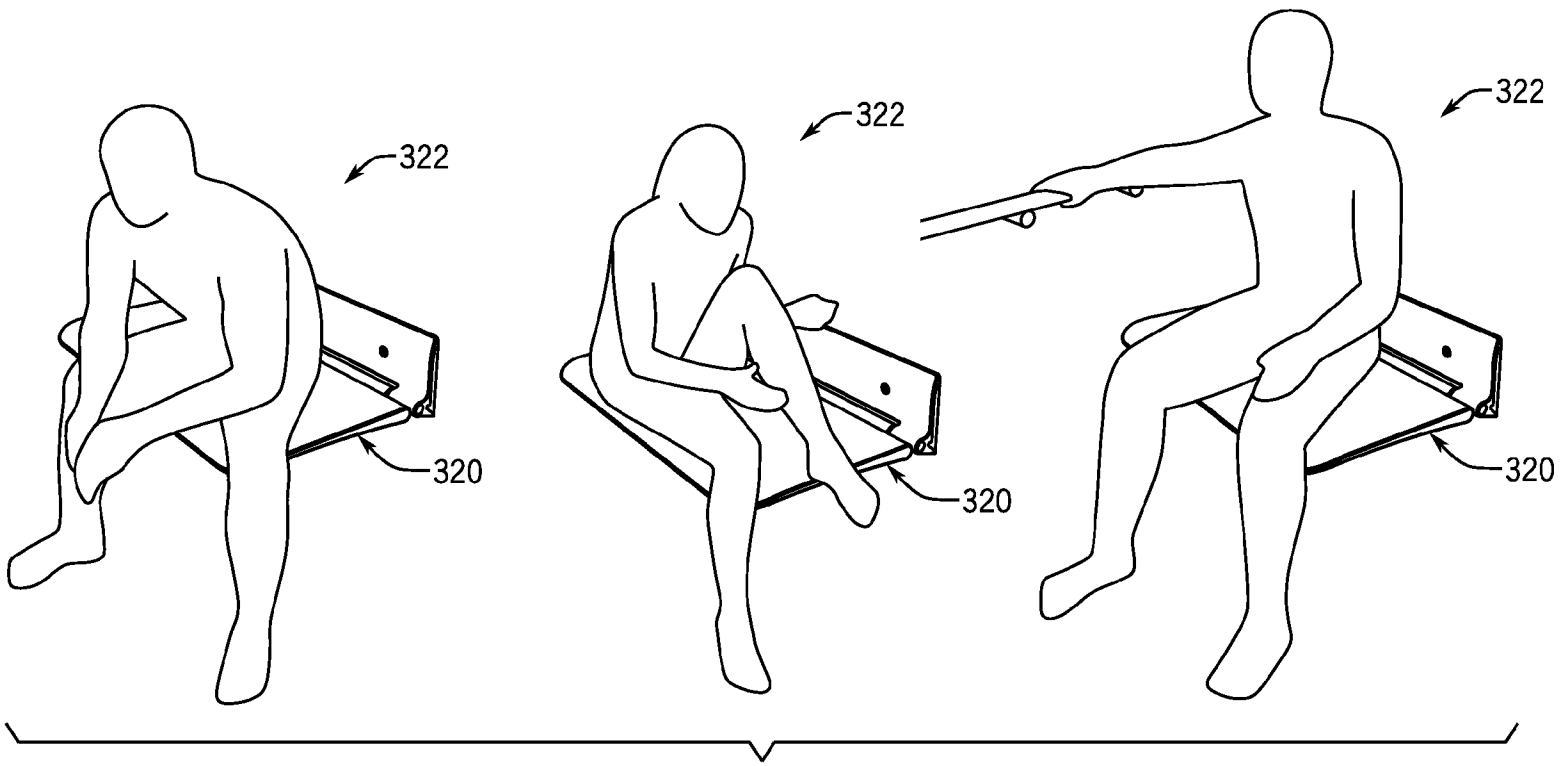
FIG. 35 is perspective views of a bathing area seat assembly being utilized by a user according to one embodiment.

According to yet another embodiment as shown in FIGS. 35-47, the bathing area 20 may include a bathing area seat assembly 320. As shown in FIG. 35, the user may sit in a variety of different positions on a bench 326 of the seat assembly 320 while the bench 326 is in a seated position 322. The wide seat pan of the bench 326 may provide a greater sense of stability to the user while seated, as well as more postural freedom to sit in a variety of different positions. Further, the particular design and configuration of the seat assembly 320 may be exceptionally strong in order to securely hold and support the user.

Figure 36B:
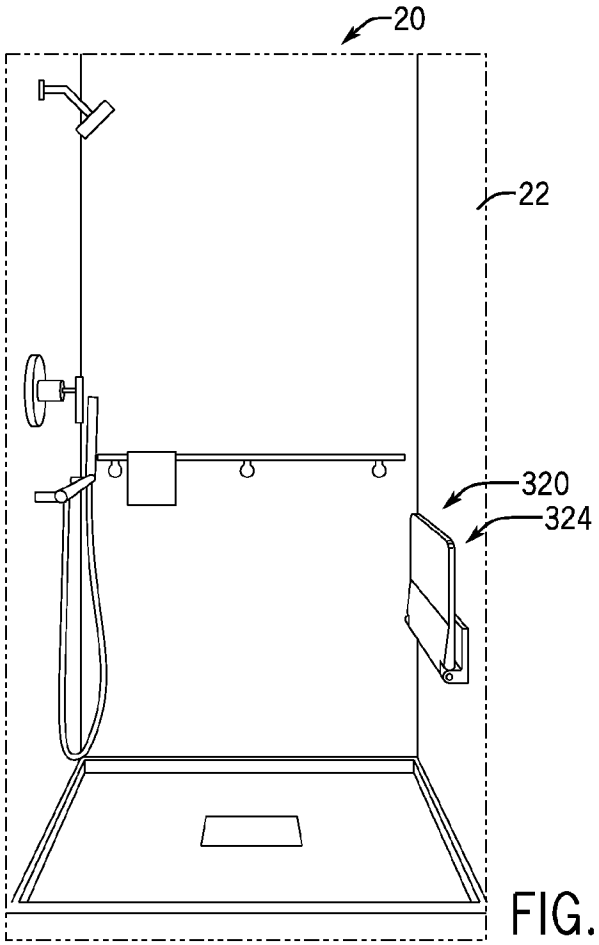
FIGS. 36A-36B are front views of a bathing area with the seat assembly of FIG. 35 in a seated position and a folded position, respectively.
Figure 36A:
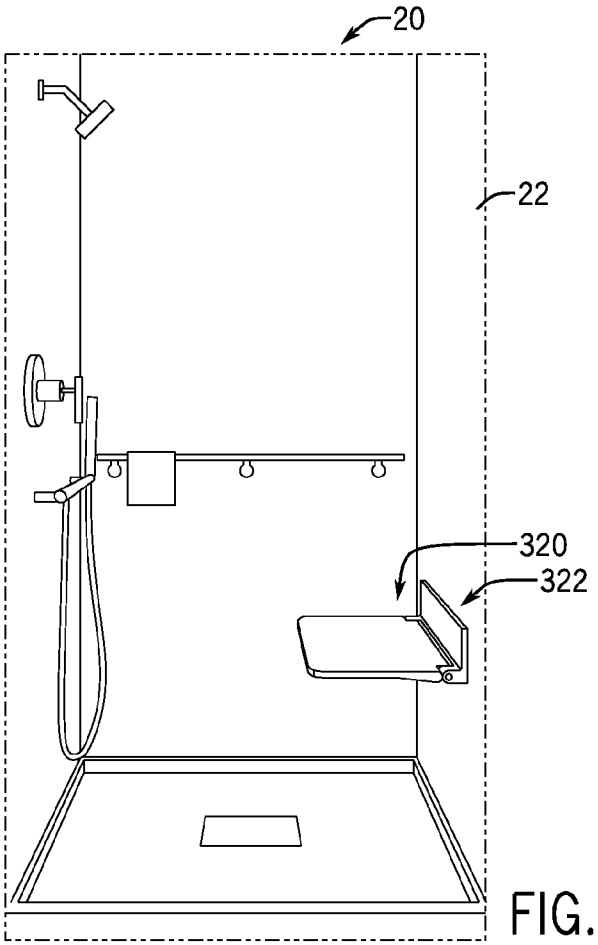

As shown in FIGS. 36A-36B, the seat assembly 320 may be integrated into and movably attached to the wall 22 of the shower or bathing area 20 and used to provide seating to the user, while still maximizing the available space within the bathing area 20, particularly when the bench 326 is in the folded position 324.

The seat assembly 320 may include a fold or flip-down seat or bench 326 and a support bracket 340. The bench 326 may be movable between a seated position 322 to provide seating to the user and a stowed, storage, or folded position 324 to move the bench 326 out of the way and to make more room available within the bathing area 20. The bench 326 may move relative to the support bracket 340 and the wall 22 of the bathing area 20 when moving between the seated position 322 and the folded position 324.

Figure 37:
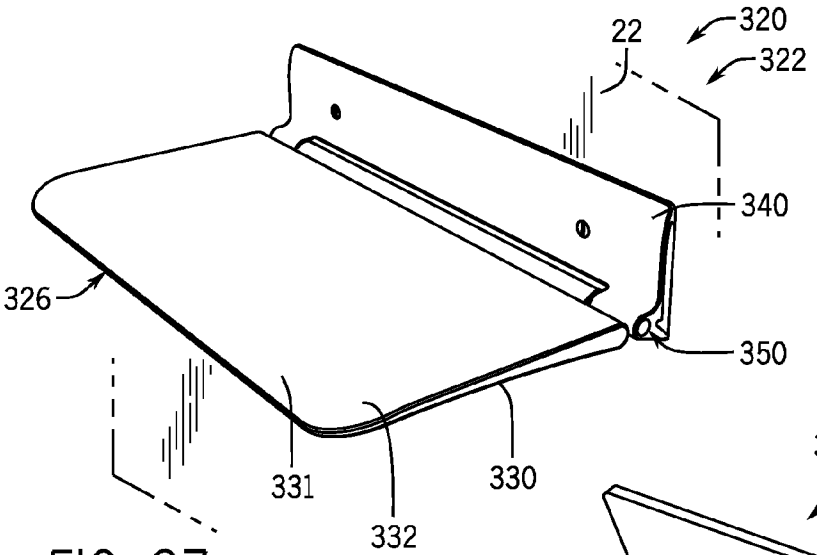
FIG. 37 is a perspective view of the seat assembly of FIG. 35 in a seated position.
Figure 40C:
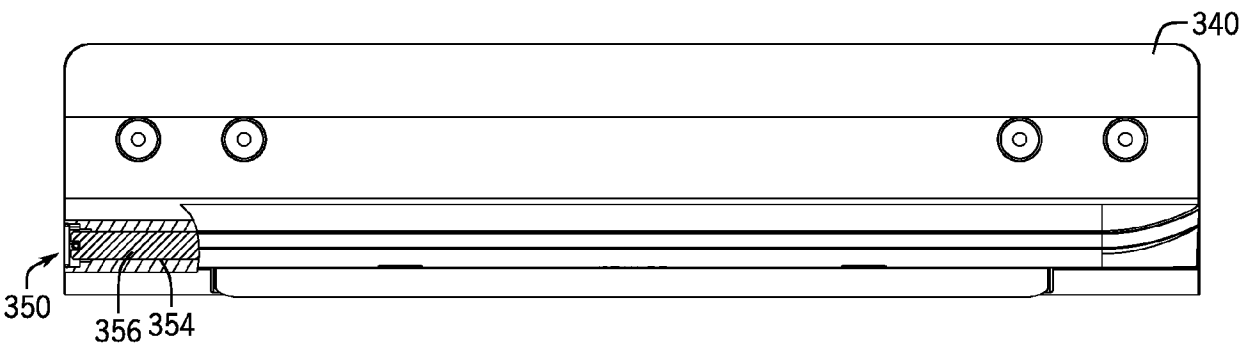
FIG. 40C is a partially cross-sectional view of Section 40C of FIG. 40B.
Figure 40B:
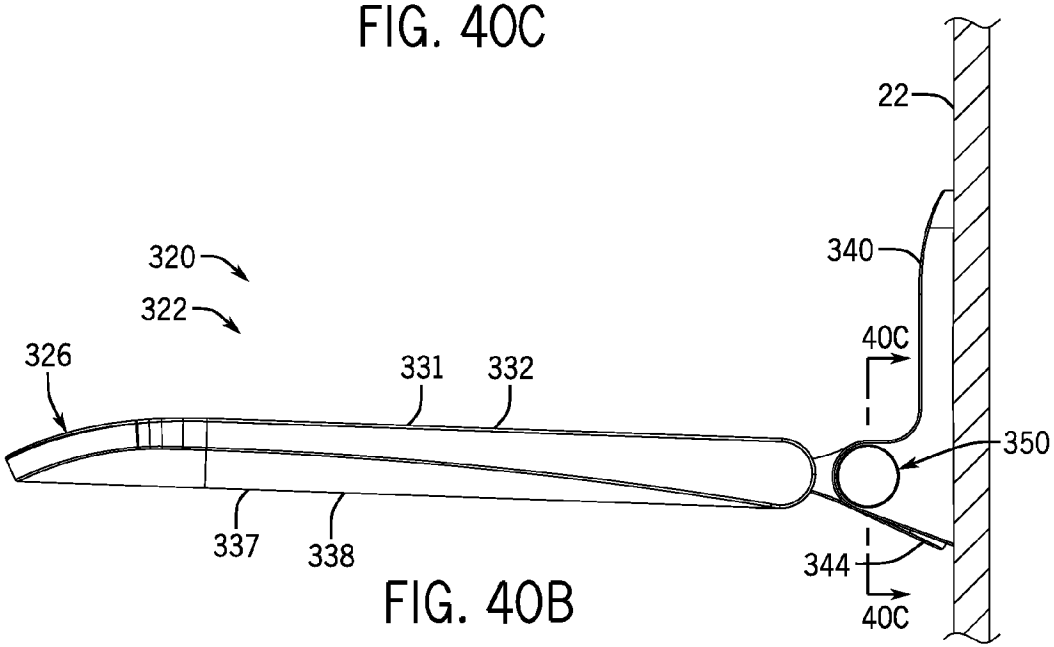
FIG. 40B is a side view of the seat assembly of FIG. 35 in the seated position.

When the user would like to sit on the bench 326, the user may fold down the bench 326 into the seated position 322 such that the bench 326 is substantially perpendicular to the wall 22 of the bathing area 20 (as shown in FIG. 40B) to provide a seating surface for the user. In the seated position 322, a top seating surface 332 of a top layer 331 of an outer covering 330 may be exposed, as shown in FIGS. 37 and 40B.

Figure 39:
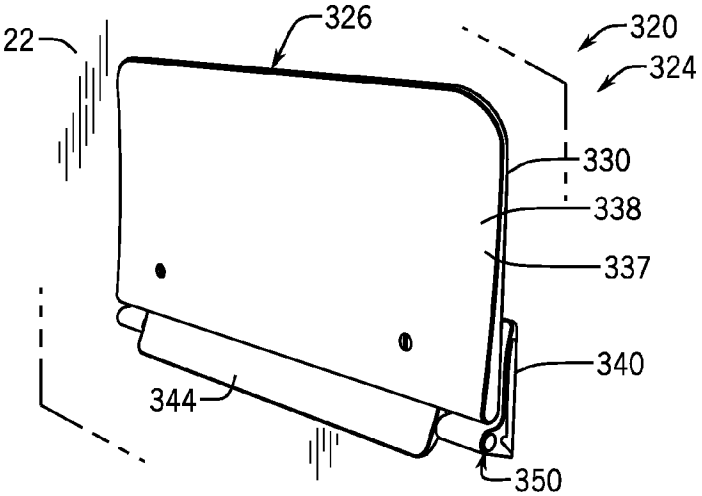
FIG. 39 is a perspective view of the seat assembly of FIG. 35 in a folded position.
Figure 38:
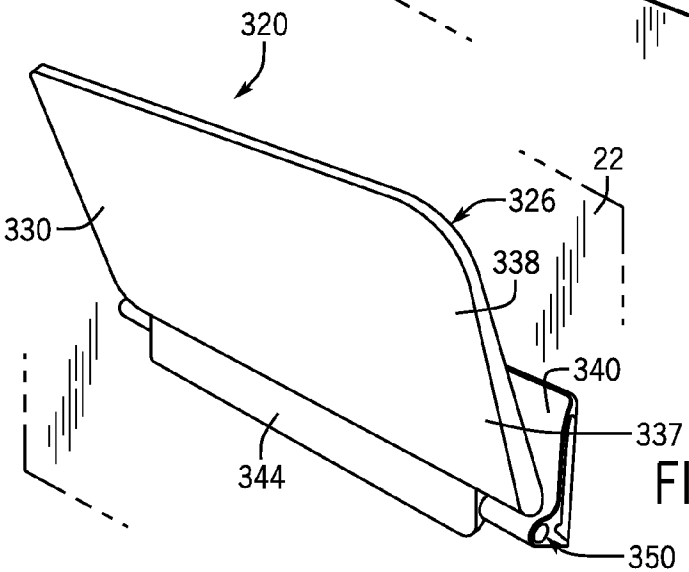
FIG. 38 is a perspective view of the seat assembly of FIG. 35 being folded.
Figure 40A:
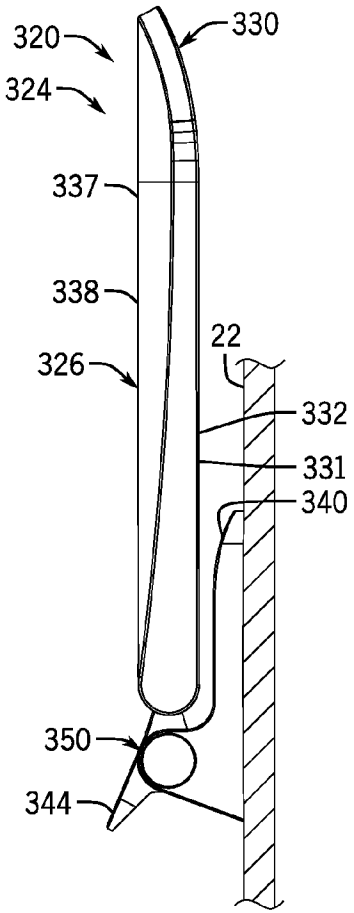
FIG. 40A is a side view of the seat assembly of FIG. 35 in the folded position.

When the user does not want to sit in the bench 326, the bench 326 may be rotated, pivoted, or folded out of the way (as shown in FIG. 38) and back up toward the wall 22, from the seated position 322 and into a stowed or folded position 324 (as shown in FIGS. 39 and 40A) such that the bench 326 may be substantially parallel to the wall 22 of the bathing area 20 (as shown in FIG. 40A) and may be folded toward the support bracket 340 and the wall 22 to conserve and maximize available space within the bathing area 20. Accordingly, in the folded position 324, the top seating surface 332 of the top layer 331 of the outer covering 330 may be substantially concealed and a bottom surface 338 of the bottom layer 337 of the outer covering 330 may be exposed to the inside of the bathing area 20.

As shown in FIG. 40A, when the bench 326 is in the folded position 324, the top seating surface 332 of the bench 326 may be between 2 to 3 inches from the wall 22 of the bathing area 20. According to one embodiment, the bench 326 may be less than 2.5 inches from the wall 22 when in the folded position 324. Accordingly, the bench 326 may utilize minimal space within the bathing area 20 while in the folded position 324.

Figure 41:
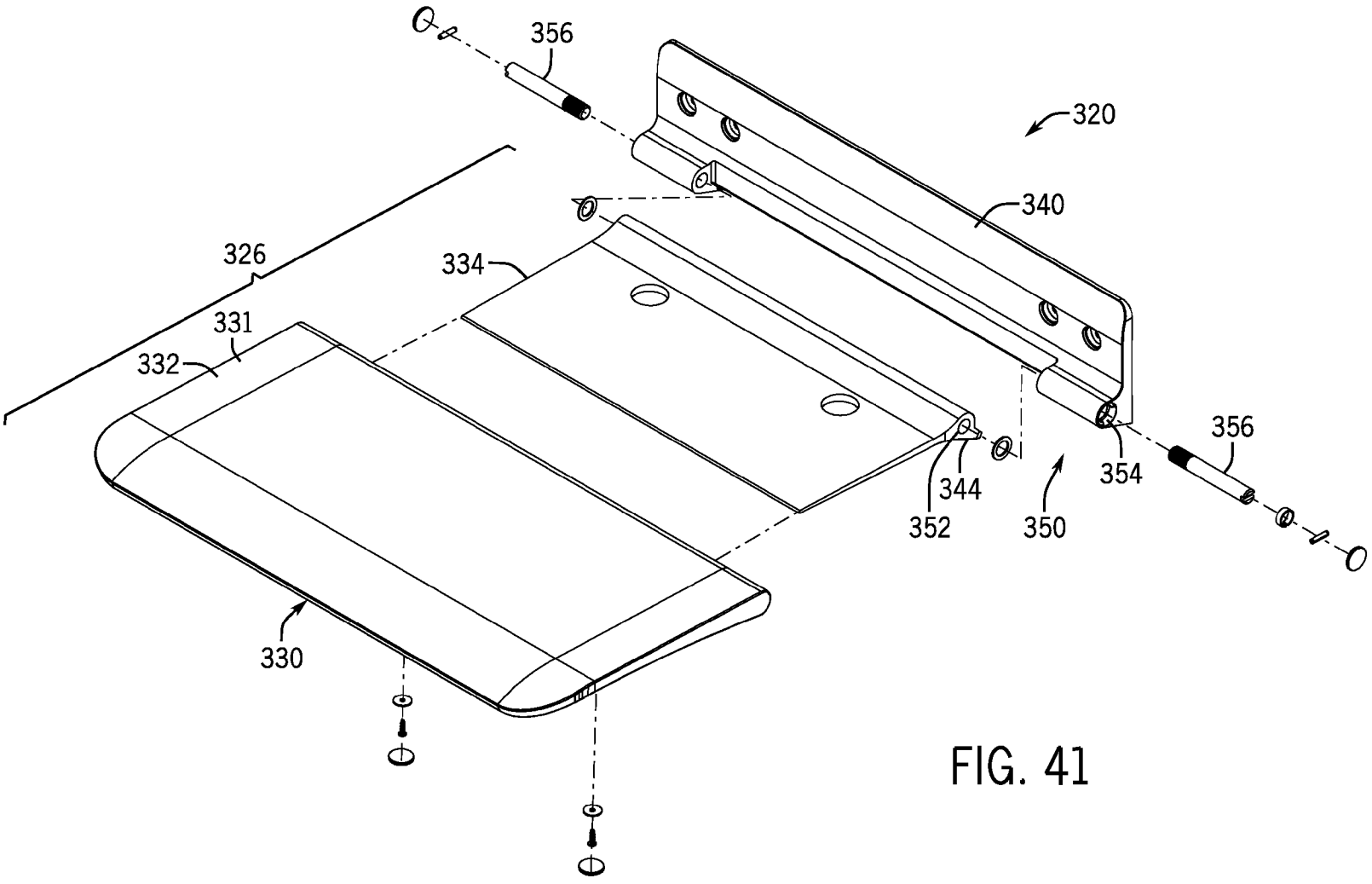
FIG. 41 is a perspective, exploded view of the seat assembly of FIG. 35.
Figure 42A:
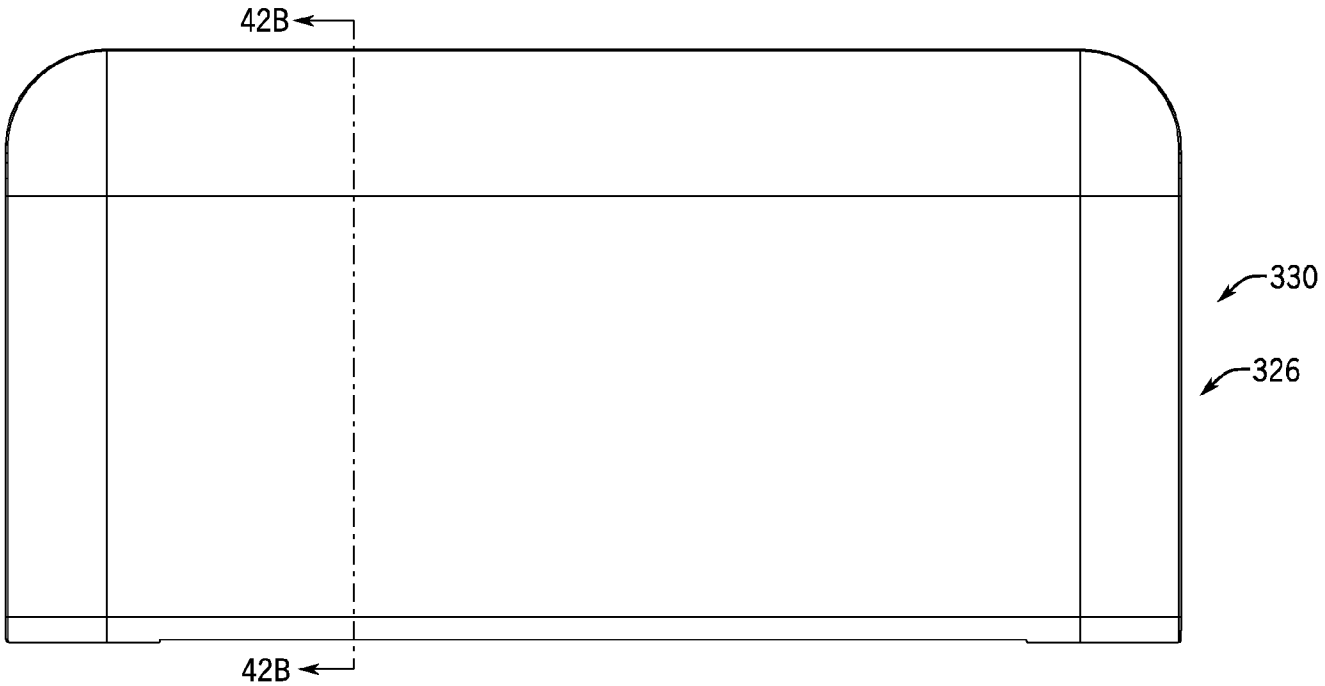
FIG. 42A is a top view of the seat assembly of FIG. 35.
Figure 42B:
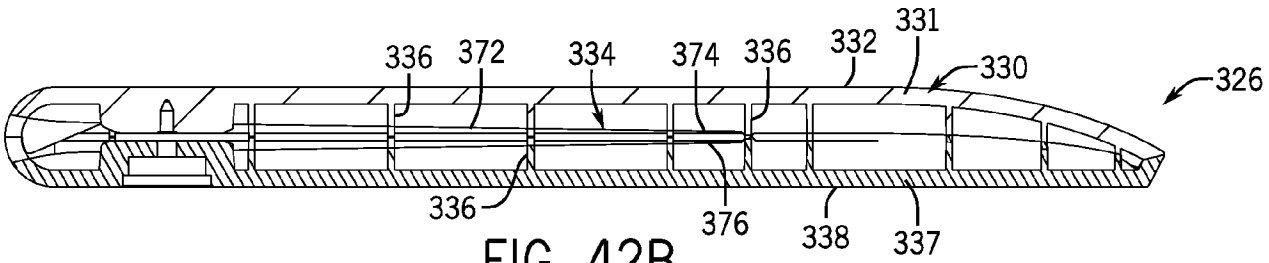
FIG. 42B is a cross-sectional view through Section 42B of FIG. 42A.

As shown in FIG. 41, the seat assembly 320 may include the bench 326 and a seat or support bracket 340 that are hingably attached. The bench 326 may include an outer surface or covering 330 and an internal support plate 334. The outer covering 330 may include a top layer 331 and a bottom layer 337 that may substantially surround or cover a top surface 374 and a bottom surface 376, respectively, of a seating portion 372 of the internal support plate 334, as shown in FIG. 42B. Accordingly, the outer covering 330 may substantially conceal a top surface and a bottom surface of the seating portion 372 of the internal support plate 334.

As shown in FIG. 42B, the top layer 331 of the outer covering 330 may include a top seating surface 332 that may be exposed when the bench 326 is in the seated position 322. The top seating surface 332 may provide a smooth and comfortable area for the user to sit on while the bench 326 is in the seated position 322. The bottom layer 337 of the outer covering 330 may include a bottom surface 338.

Figure 43B:
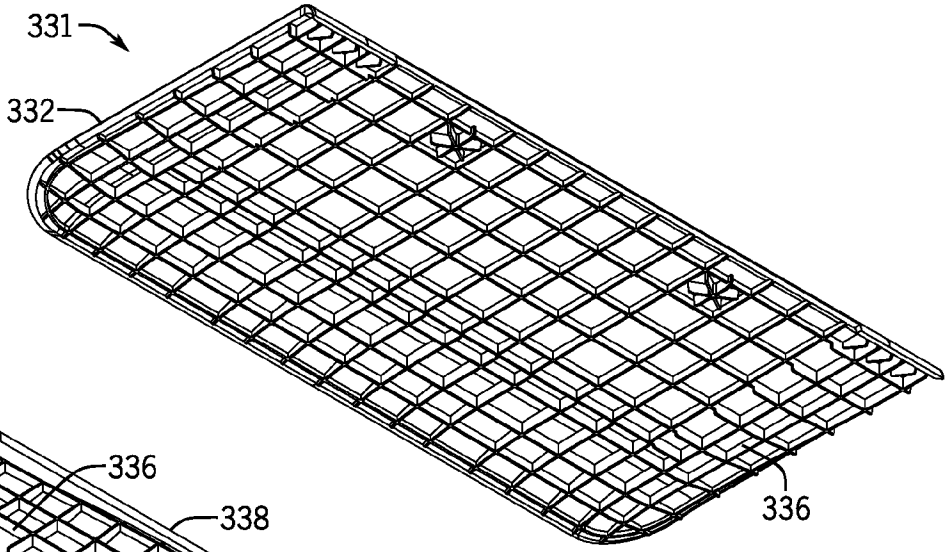
FIG. 43B is a bottom, perspective view of the inside of the top layer of the outer covering of the bench of the seat assembly of FIG. 35.
Figure 43A:
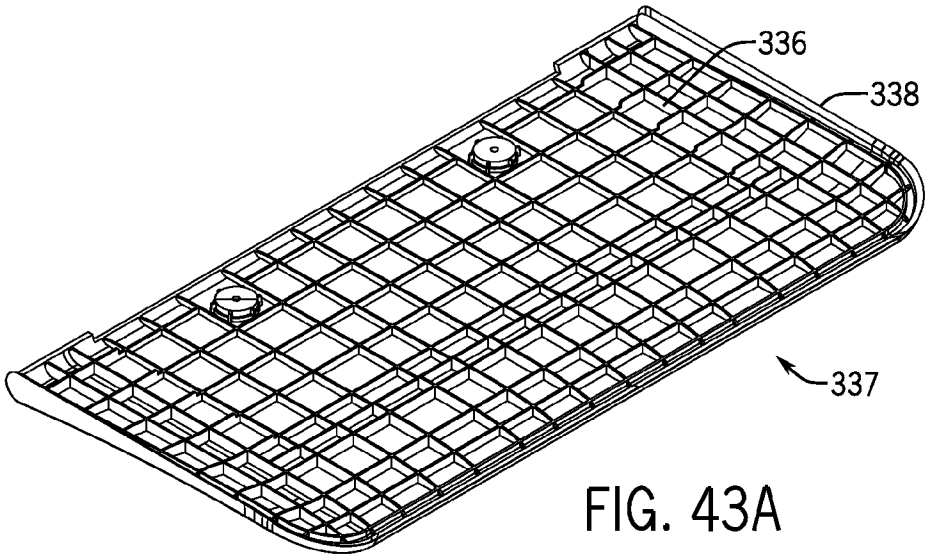
FIG. 43A is a top, perspective view of the inside of the bottom layer of the outer covering of the bench of the seat assembly of FIG. 35.
Figure 43C:
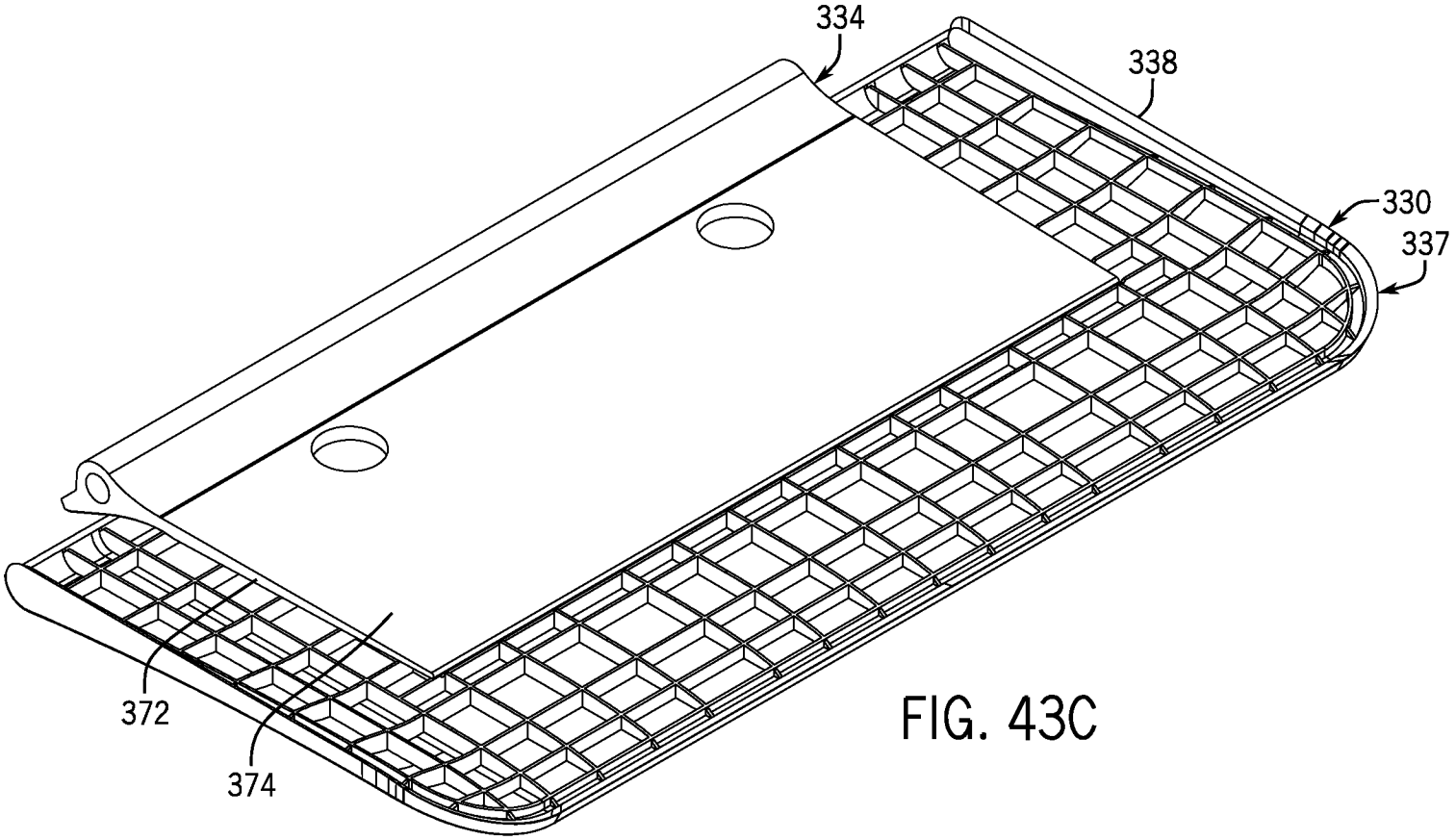
FIG. 43C is a top, perspective view of the internal support plate on top of the bottom layer of the outer covering of the bench of FIG. 35.

As shown in FIGS. 43A-43C, the inside of the top layer 331 and the bottom layer 337 of the outer covering 330 may include additional internal support structures, protrusions, or ribs 336 that are concealed within the bench 326 and provide additional support within the bench 326. The ribs 336 may protrude inwardly from the top seating surface 332 and the bottom surface 338 and may be arranged in longitudinal and lateral lines within the bench 326.

The top layer 331 and the bottom layer 337 of outer covering 330 may be at least partially welded together and/or to the internal support plate 334 to increase the strength and durability of the bench 326. According to one embodiment, the ribs 336 of the top layer 331 and the bottom layer 337 may be welded together along the outside perimeter. The ribs 336 may optionally be welded to seating portion 372 of the internal support plate 334. The outer covering 330 may be constructed out of a variety of materials, such as plastic or metal.

The inner support or the internal support plate 334 may increase the inner strength and durability of the bench 326, support the outer covering 330, provide a hinged connection to the support bracket 340, and prevent the bench 326 from rotating past the seated position 322. As shown in FIGS. 42A-42B and 43C, both sides (e.g., the top surface 374 and the bottom surface 376) of the seating portion 372 of the internal support plate 334 may be completely concealed and encompassed by the outer covering 330. The seating portion 372 may fit within the outer covering 330.

Figure 44A:
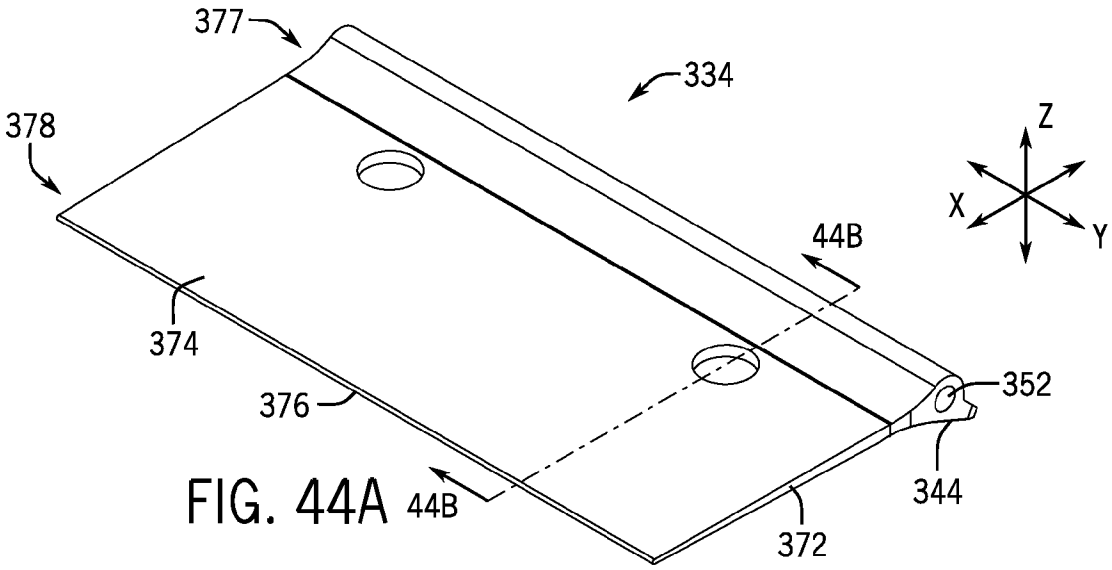
FIG. 44A is a perspective view of an internal support plate of the bench of the seat assembly of FIG. 35.
Figure 44B:
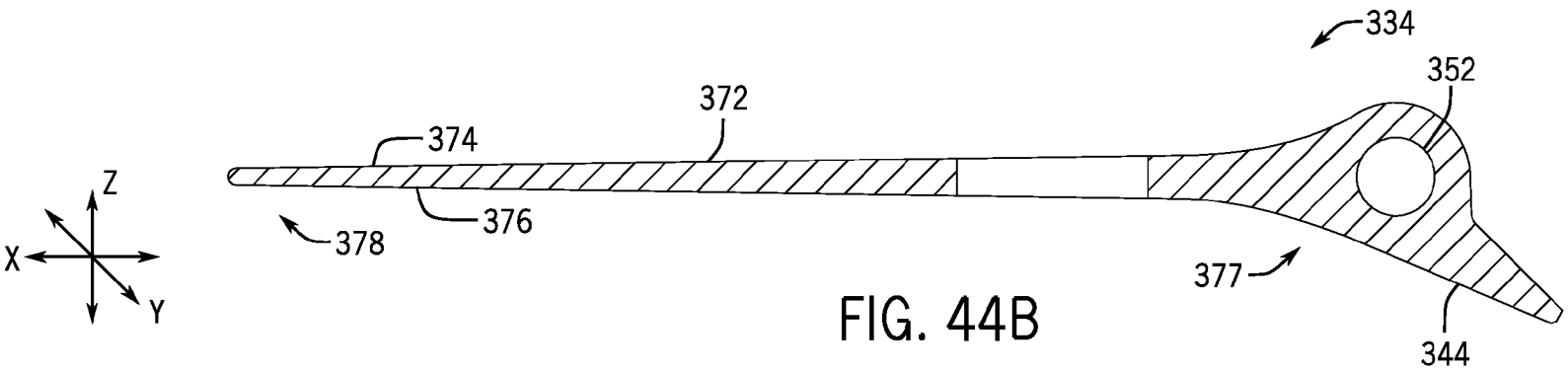
FIG. 44B is a cross-sectional view through Section 44B of FIG. 44A.
Figure 45B:
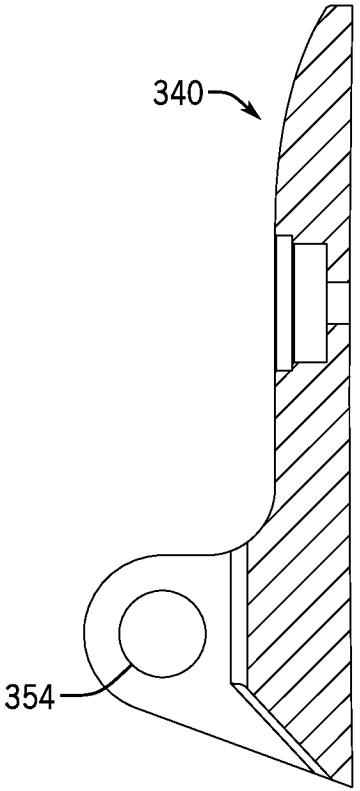
FIG. 45B is a cross-sectional view through Section 45B of FIG. 45A.
Figure 45A:
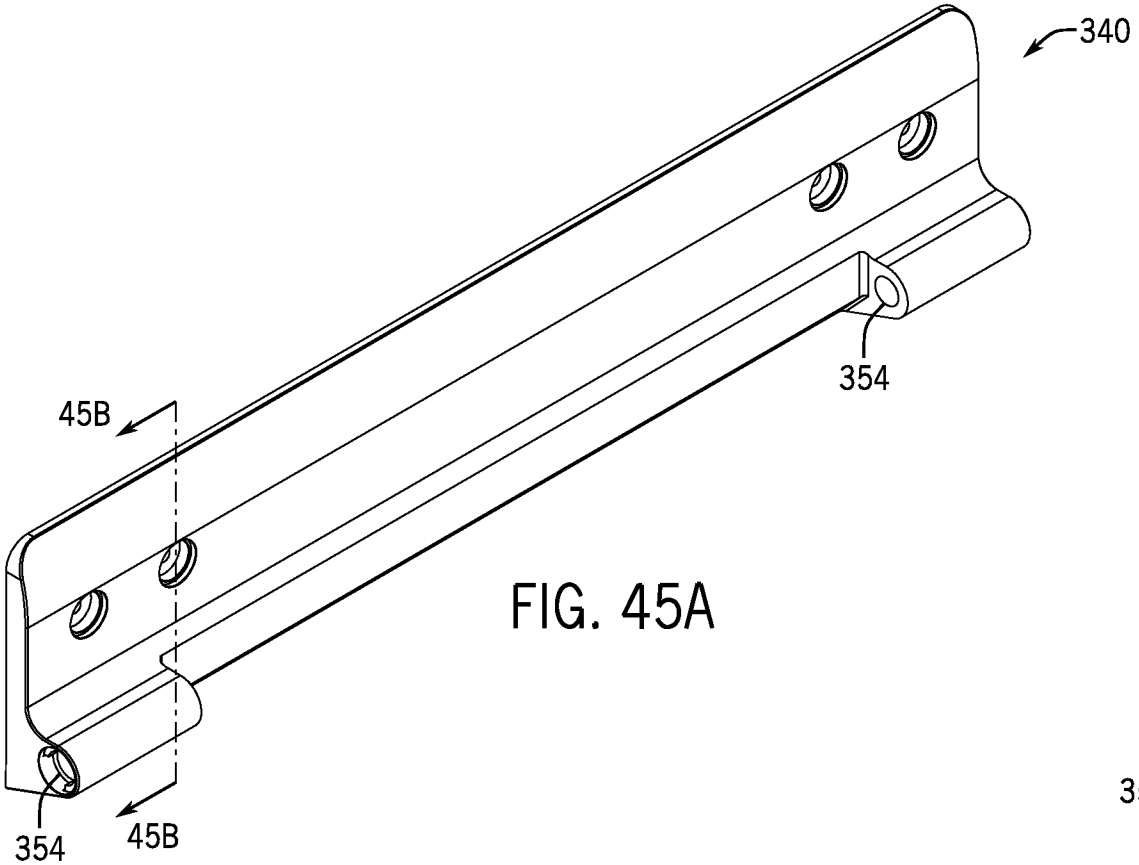
FIG. 45A is a perspective view of a support bracket of the seat assembly of FIG. 35.

As shown in FIGS. 44A-44B, the internal support plate 334 may include an inner region 377 and an outer region 378. The inner region 377 may be positioned closer to the base of the bench 326, the support bracket 340, and the wall 22 than the outer region 378 and may include the movement limiter 344, a hinge aperture 352, and a portion of the seating portion 372. The outer region 378 may include the rest of the seating portion 372 and the outer edge of the support plate 334. The seating portion 372 may correspond to an area above which the user may sit on the bench 326.

As shown in FIGS. 44A-44B, the internal support plate 334 may be a substantially flat plate. The thickness, size, and distribution of the internal support plate 334 may be optimized to provide a particularly strong and durable bench. For example, as shown in FIG. 44B, the inner region 377 of the support plate 334 is thicker than the outer region 378 of the support plate 334 (e.g., the support plate 334 may be thicker toward the base of the bench 326) to add more strength to the bench 326 while minimizing the required materials. Further, the internal support plate 334 may provide more support according to where the user may sit on the bench (e.g., closer to the wall 22 or on the edge of the bench 326). Accordingly, the bench 326 may be able to support large amounts of force or load. For example, the bench 326 may be able to support a 600 pound person sitting or a 300 pound person jumping on the bench 326.

The internal support plate 334 may be an integral or single piece of material to maximize the structural integrity of the internal support plate 334 and, thus, the bench 326. The internal support plate 334 may be constructed out of relatively strong materials, such as metal (e.g., steel).

As shown FIGS. 41 and 44A-44B, the inner region 377 of the internal support plate 334 may in include a hinge aperture 352 to create a hinged connection between the internal support plate 334 and the support bracket 340, as described further herein.

As shown in FIGS. 39, 40A, and 44A-44B, the inner region 377 of the internal support plate 334 may include a rotational or movement limiter 344 to prevent the bench 326 from rotating past the seated position 322 relative to the support bracket 340. The movement limiter 344 may extend laterally (e.g., along the x-axis, as shown in FIG. 44A) beyond the hinge aperture 352. The movement limiter 344 may also extend laterally beyond the outer covering 330 and may optionally be exposed from the outer covering 330. As shown in FIGS. 38-39, the movement limiter 344 may extend longitudinally (e.g., along the y-axis as shown in FIG. 44A) along at least a portion of the length of the internal support plate 334.

When the bench 326 is in the seated position 324, the movement limiter 344 may abut a lower portion of the support bracket 340, which prevents the bench 326 from rotating any further since the movement limiter 344 is an extension of the internal support plate 334. In order to obtain the proper angle of the bench 326 in the seated position 324, the movement limiter 344 may be angled downward relative to the seating portion 372 of the internal support plate 334, as shown in FIG. 44B. Accordingly, the movement limiter 344 may extend below the seating portion 372 of the internal support plate 334 in the seated position 324.

The support bracket 340 may be statically attached to the wall 22 of the bathing area 20 and may be used to movably or hingably mount and secure the bench 326 to the wall 22. The support bracket 340 and the bench 326 may be hingably attached to each other such that the bench 326 may rotate relative to the support bracket 340 between the seated position 322 and the folded position 324.

The bench 326 may be hingably attached to the support bracket 340 through the inner region 377 of the internal support plate 334. For example, the hinge 350 may include the hinge aperture 352 on the internal support plate 334, a hinge aperture 354 on the support bracket 340, and a rod or pin 356. The pin 356 may pivotably connect and extend through both of the hinge apertures 352 and 354, as shown in FIG. 41 to allow the internal support plate 334 to be movable relative to the support bracket 340. As shown in FIGS. 40A-40C and 45A-45B, the hinge 350 may be used to allow the bench 326 to be moved (e.g., pivot or rotate) between the seated position 322 and the folded position 324 along a horizontal axis. The hinge 350 may optionally be a frictional hinge such that the bench 326 may stay up in the folded position 324.

Figure 46:
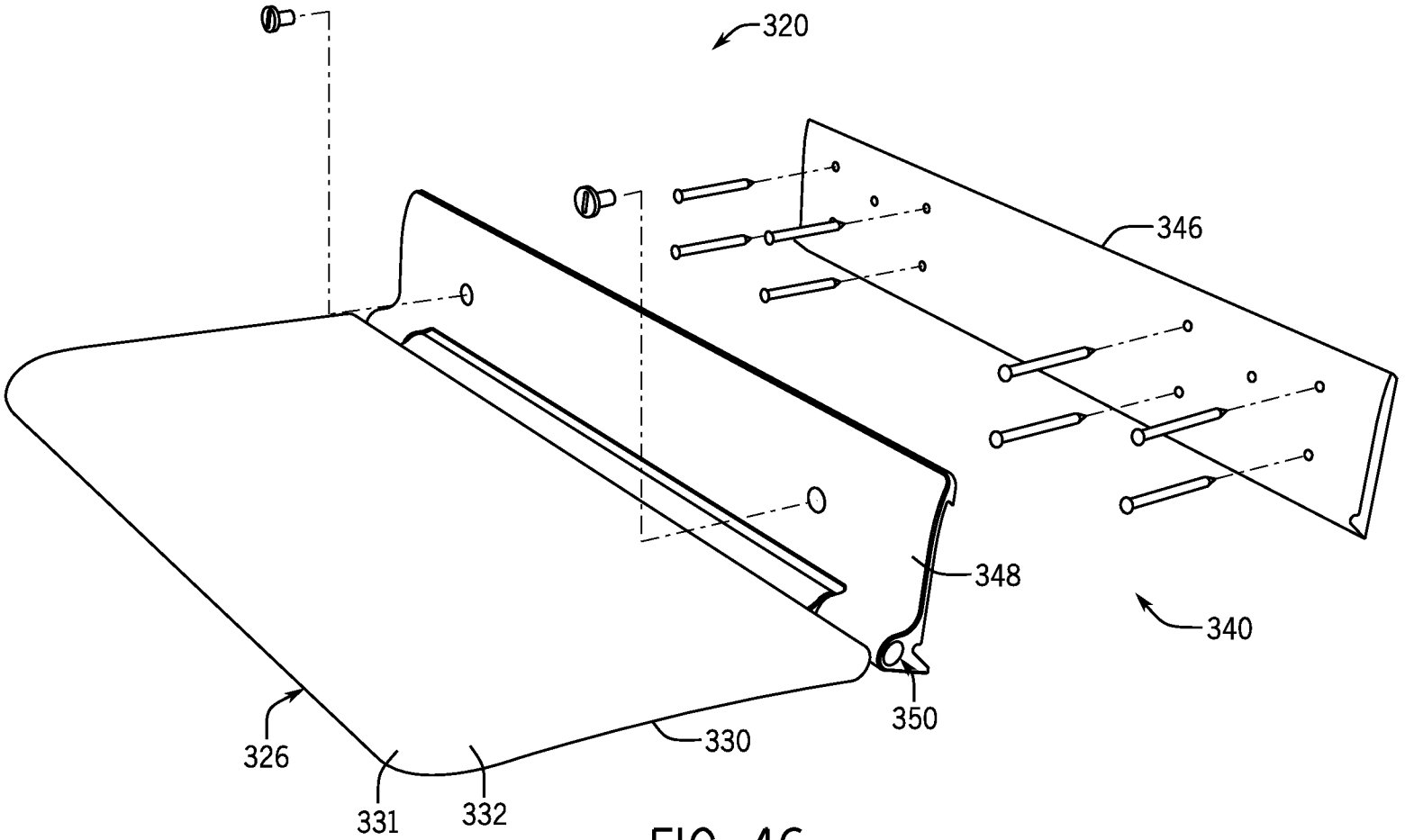
FIG. 46 is a perspective, exploded view of the seat assembly of FIG. 35 being installed.

As shown in FIG. 46, in order to install the seat assembly 320 into the bathing area 20, the back of the support bracket 340 may positioned flush with the wall 22 of the bathing area 20. The support bracket 340 may be subsequently screwed into the wall 22. According to one embodiment, the support bracket 340 may include a cleat 346 and a cover 348. The cleat 346 may be first attached (e.g., screwed) to the wall 22 and the cover 348 may be subsequently attached to the cleat 346 with the rest of the seat assembly 320. The cleat 346 and the cover 348 may attach together at least one "coinslot" fastener.

The seat assembly 320 may be sized according to the desired configuration and the size of the bathing area 20. According to one embodiment, the length and width of the bench 326 may be between 20 to 30 inches and 10 to 20 inches, respectively. According to another embodiment, the length and width of the bench 326 may be approximately 26 inches and 15 inches, respectively.

Figure 47A:
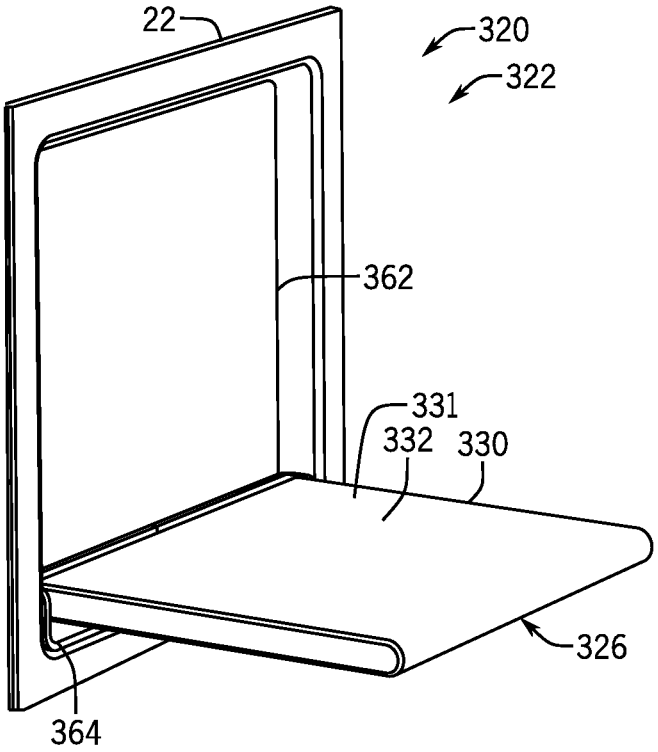
FIGS. 47A-47B are perspective views of a seat assembly in a seated position according to another embodiment.
Figure 47B:
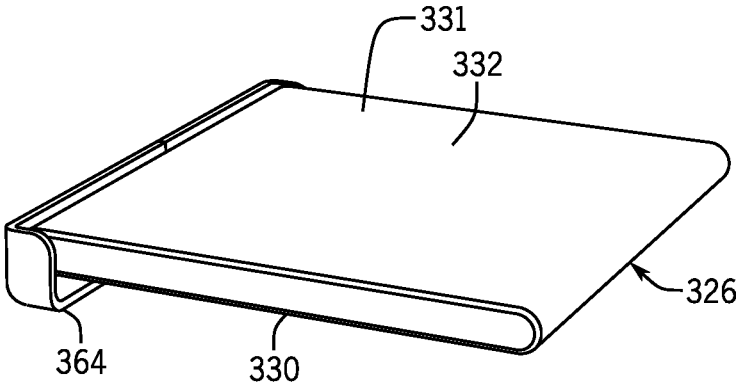
Figure 47C:
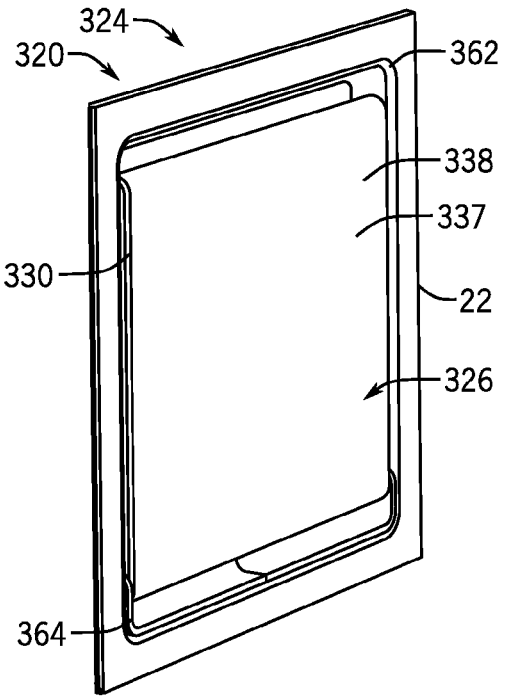
FIGS. 47C-47D are perspective and front views, respectively, of the seat assembly of FIG. 47A in a folded position.
Figure 47D:
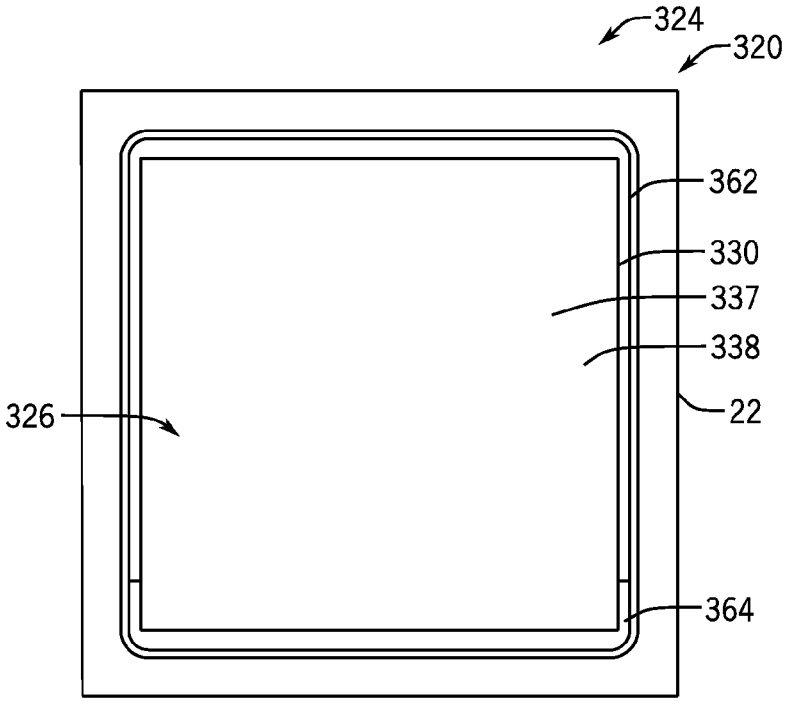

According to another embodiment as shown in FIGS. 47A-47D, the bench 326 may be at least partially flush mount or recessed within the wall 22 in the folded position 324. Accordingly, a portion of the wall 22 may be recessed and include a cutout 362 to allow the bench 326 to fold or move into the wall 22 for storage while in the folded position 324. The cutout 362 may be approximately the same size (or slightly larger) of the bench 326 such that the bench 326 may completely fit within and fold into the cutout 362. While the bench 326 is in the folded position 324, the bench 326 may be flush with the wall 22 (as shown in FIG. 47C), thereby further maximizing the available space within the bathing area 20. As shown in FIGS. 47A-47B, a lower edge of the bench 326 may have a hinge 364 and may rotate within a lower edge of the cutout 362 in order to move between the seated position 322 and the folded position 324.

The seat assembly 320 and its components may be constructed out of a variety of materials, including but not limited to aluminum (e.g., anodized aluminum), stainless steel, polyethylene, acetal, or polypropylene. It is understood that the various configurations and embodiments of the seat assembly 320 may be used in conjunction with each other and in a variety of different configurations.

Bathing Area Shaving Ledge Assembly

Figure 48C:
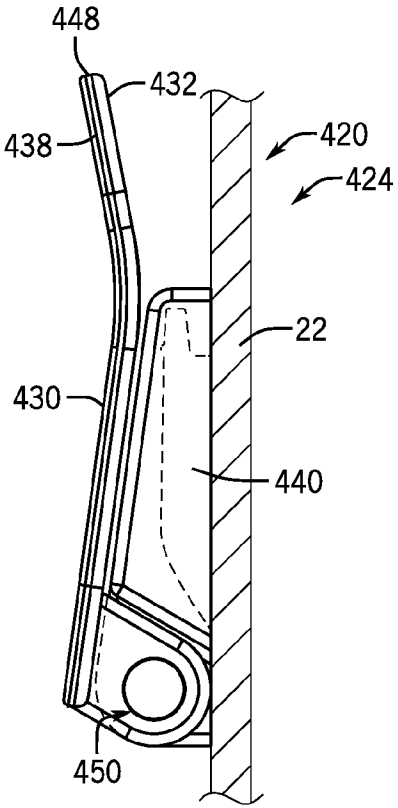
FIGS. 48B-48C are perspective and side views of the footrest of FIG. 48A in a folded position.
Figure 48A:
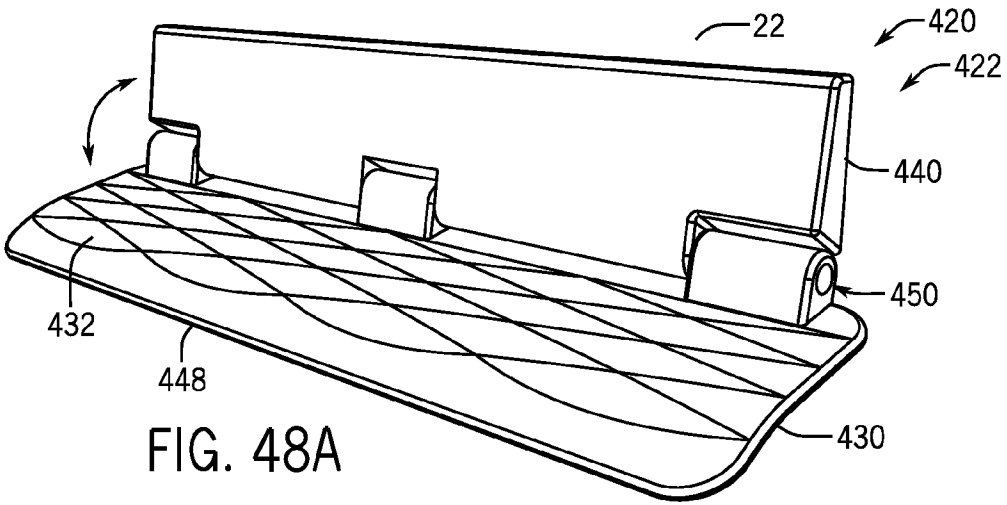
FIG. 48A is a perspective view of a shaving ledge assembly with a footrest in a use position according to one embodiment.
Figure 48B:
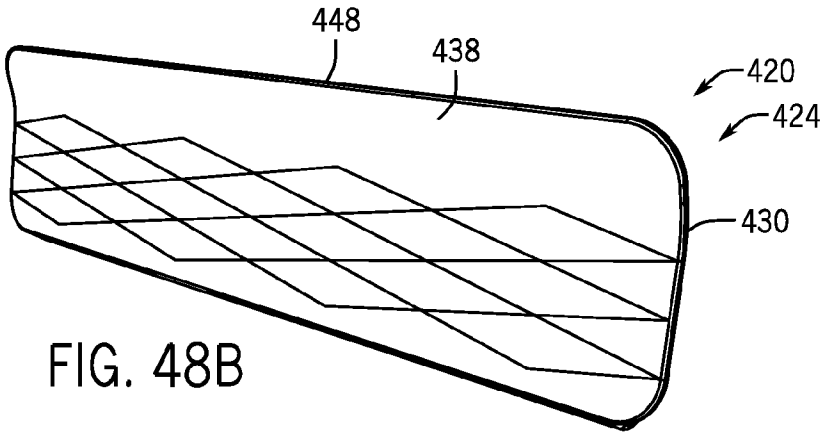

According to another embodiment as shown in FIGS. 48A-48C, the bathing area 20 may include a bathing area shaving ledge assembly 420. The shaving ledge assembly 420 may be particularly useful to provide a stable, raised surface and support for the user to rest their foot on while shaving their legs and/or washing their feet. Accordingly, the shaving ledge assembly 420 may allow the user to safely balance while shaving their legs and/or washing their feet. Further, the particular design and configuration of the shaving ledge assembly 420 may be exceptionally strong in order to securely hold and support the user.

As shown in FIGS. 48A-48C, the shaving ledge assembly 420 may be integrated into and movably attached to the wall 22 of the shower or bathing area 20 and used to provide a surface for the user to rest their feet on, while still maximizing the available space within the bathing area 20, particularly when the support, bench, or footrest 430 is in the folded position 424.

The shaving ledge assembly 420 may include a fold or flip-down footrest 430 and a support bracket 440. The footrest 430 may be movable between a use position 422 to provide an area for the user to rest their foot on and a stowed, storage, or folded position 424 to move the footrest 430 out of the way and to make more room available within the bathing area 20. The footrest 430 may move relative to the support bracket 440 and the wall 22 of the bathing area 20 when moving between the use position 422 and the folded position 424.

When the user would like to use the shaving ledge assembly 420, the user may fold down the footrest 430 into a use position 422 such that the footrest 430 is substantially perpendicular to the wall 22 of the bathing area 20 (as shown in FIG. 48A) to provide a footrest area for the user. In the use position 422, the top surface of the top layer 432 of the footrest 430 may be exposed.

When the user does not want to use the shaving ledge assembly 420, the footrest 430 may be rotated, pivoted, or folded out of the way and back up toward the wall 22, from the use position 422 and into a stowed or folded position 424 (as shown in FIGS. 48B-48C) such that the footrest 430 may be substantially parallel to the wall 22 of the bathing area 20 and may be folded toward the support bracket 440 and the wall 22 to conserve and maximize available space within the bathing area 20. Accordingly, in the folded position 424, the top surface of the top layer 432 of the footrest 430 may be substantially concealed and a bottom surface of the bottom layer 438 of the footrest 430 may be exposed to the inside of the bathing area 20. As shown in FIG. 48C, when the footrest 430 is in the folded position 424, the footrest 430 may be very close to the wall 22 and the support bracket 440 to maximize the space within the bathing area 20.

The shaving ledge assembly 420 may include the footrest 430 and a support bracket 440 that are hingably attached. The footrest 430 may provide an area for the user to rest their foot on while the shaving ledge assembly 420 is in the use position 422 and may include an outer covering and an internal support plate, as described further herein with reference to the seat assembly 320. The outer covering may include a top layer 432 and a bottom layer 438 that may substantially surround, cover, or conceal a footrest portion of an internal support plate. The internal support plate may provide additional support within the footrest 430.

As shown in FIG. 48C, the top layer 432 of the footrest 430 may include a top surface that may be exposed when the footrest 430 is in the use position 422. The top surface may provide a smooth and comfortable area for the user to rest their foot on while the footrest 430 is in the use position 422. The top surface may be substantially concealed and the footrest 430 may be folded toward the support bracket 440 when the footrest 430 is in the folded position 424. The bottom layer 438 of the footrest 430 may include a bottom surface that is exposed when the footrest 430 is in the folded position 424.

The support bracket 440 may be statically attached to the wall 22 of the bathing area 20 and may be used to mount and secure the footrest 430 to the wall 22. The support bracket 440 and the footrest 430 may be hingably attached such that the footrest 430 may rotate relative to the support bracket 440 between the use position 422 and the folded position 424. Similar to the seat assembly 320, the support bracket 440 may be mounted to a cleat that is mounted to the wall 22.

The hinge 450 may allow the footrest 430 to be rotated, pivoted, or moved between the use position 422 and the folded position 424 along a horizontal axis. The hinge 450 may include a hinge aperture through the footrest 430, a hinge aperture through the support bracket 440, and a pin that may extend through the hinge apertures to allow the footrest 430 to rotate relative to the support bracket 440. The hinge 450 may be a frictional hinge such that the footrest 430 may stay up in the folded position 424.

At least the top edge 448 (e.g., the edge furthest from the hinge 450) of the top layer 432 of the outer covering 430 may be angled downward relative to and from a middle portion of the footrest 430. Accordingly, while the footrest 430 is in the use position 422, the liquid may run off the top edge 448 of the footrest 430 and back into the bathing area 20.

The footrest 430 may include additional internal support concealed within the footrest 430. According to one embodiment, the footrest 430 may be supported and configured similarly to the bench 326. For example, the outer coverings of the footrest 430 may have protrusions or ribs protruding inward from the outside and arranged in longitudinal and lateral lines along the inside of the outer coverings. The outer coverings may be at least partially welded together and/or to the internal support plate to increase the strength and durability of the footrest 430. According to one embodiment, the ribs of the top layer 432 and the bottom layer 438 may be welded together along the outside perimeter. Alternatively or additionally, and/or the top layer 432 and the bottom layer 438 may be welded to the internal support plate. The footrest 430 may be constructed out of a variety of materials, such as plastic or metal.

Similar to the bench 326, the internal support plate of the footrest 430 may be completely concealed and encompassed on either side (e.g., the top and bottom) by the outer covering and may be a substantially flat plate. The thickness, size, and distribution of the internal support plate may be optimized to provide a particularly strong and durable footrest 430. For example, the internal support plate may be thicker toward the base of the footrest 430 (e.g., closer to the support bracket 440) than the outer or top edge 448 of the footrest 430 to add more strength to the footrest 430 while minimizing the required materials. Further, the internal support plate may provide more support according to where the user may rest their foot on the footrest 430 (e.g., closer to the wall 22 or on the edge of the footrest 430). Accordingly, the footrest 430 may be able to support large amounts of force or load. The internal support plate may be constructed out of relatively strong materials, such as metal (e.g., steel).

The internal support plate may include a movement limiter to prevent the footrest 430 from rotating past the use position 422.

The shaving ledge assembly 420 may be a stand-alone component within the bathing area 20 and may be installed into new, existing, remolded, or "refreshed" bathing area 20. As shown in FIG. 48A, the shaving ledge assembly 420 may be integrated into the wall 22 of the bathing area 20 and may be used to provide a raised, stable surface, while still maximizing the available space within the bathing area 20.

The shaving ledge assembly 420 may be attached to a variety of locations along the wall 22. According to one embodiment, the shaving ledge assembly 420 may be attached to a lower region of the wall 22 in order for the user to easily rest their foot on the footrest 430. According to one embodiment, the shaving ledge assembly 420 may be positioned between 10 to 20 inches from the floor or shower receptor. According to another embodiment, the shaving ledge assembly 420 may be positioned between 13 to 18 inches from the floor or shower receptor.

Similar to the seat assembly 320, in order to install the shaving ledge assembly 420 into the bathing area 20, the back of the support bracket 440 may positioned flush with the wall 22. The support bracket 440 may be subsequently screwed into the wall 22. According to one embodiment, a cleat may be first screwed to the wall 22 and a cover of the bracket 440 may be attached to the cleat with at least one "coinslot" fastener.

The shaving ledge assembly 420 may be sized according to the desired configuration and the size of the bathing area 20. According to one embodiment, the length and width of the footrest 430 may be between 10 to 20 inches and 2 to 5 inches, respectively. According to another embodiment, the length and width of the footrest 430 may be approximately 14 inches and 3.5 inches, respectively.

The shaving ledge assembly 420 and its components may be constructed out of a variety of materials, including but not limited to anodized aluminum or polypropylene. It is understood the various embodiments and configurations of the seat assembly 320 may be applied to and used within the shaving ledge assembly 420, according to the desired configuration. It is also understood that the various configurations and embodiments of the shaving ledge assembly 420 may be used in conjunction with each other and in a variety of different configurations.

It is further understood that the various bathing area accessories (e.g., the shelving assembly 40, the bathing area bar assembly 120, the storage assembly 220, the bathing area seat assembly 320, and/or the shaving ledge assembly 420) may be used in combination or in conjunction with each other, according to the desired configuration. For example, according to one embodiment, the bathing area seat assembly 320 may be installed to one wall 22 and the shaving ledge assembly 420 or the shelving assembly 40 may be installed to another wall that is across from or near the wall 22. Accordingly, the user may sit on the bathing area seat assembly 320 and rest their foot on the shaving ledge assembly 420 or the lower surface 42 of the niche 56 of the shelving assembly to easily shave their legs.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the bathing area accessories as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to exemplary embodiments. Other substitutions, modifications, changes and omissions may also be made in the design, operating conditions and arrangement of the various exemplary embodiments without departing from the scope of the present disclosure.

What is claimed is:

1. A shelving assembly for use within a bathing area, comprising:

a niche configured to be recessed relative to a wall of the bathing area, wherein the niche includes a plurality of slots; and at least one generally planar shelf attachable to, removable from, and reattachable to the plurality of slots of the niche, wherein the plurality of slots are configured to receive and secure the at least one shelf, wherein the niche comprises two sidewalls that extend substantially vertically along a vertical length of the niche and a lower surface that extends between and connects a lower portion of the two sidewalls, wherein the plurality of slots are on the two sidewalls and the at least one shelf attaches with a pair of slots from the plurality of slots that are vertically aligned with each other, wherein the lower surface of the niche has a front portion that is aligned with the wall of the bathing area and a back portion that is recessed relative to the wall of the bathing area, wherein the front portion and the back portion extend between the two sidewalls, wherein the front portion is lower than the back portion such that the lower surface of the niche is inclined;

wherein the niche comprises a back wall that extends substantially vertically along the vertical length of the niche and extends between a back portion of the sidewalls, wherein a back edge of the at least one shelf is spaced apart from the back wall such that there is a gap between the back edge the at least one shelf and the back wall for liquid to flow through down to the inclined lower surface which directs liquid away from the niche.

2. The shelving assembly of claim 1, wherein the plurality of slots comprises at least one additional pair of slots that are spaced from each other along the vertical length of the niche.

3. The shelving assembly of claim 2, wherein a vertical position of the at least one shelf is adjustable according to a vertical position of corresponding pairs of the plurality of slots.

4. The shelving assembly of claim 2, further comprising multiple shelves that are positionable along the vertical length of the niche within respective pairs of slots, wherein a vertical distance between the each of the multiple shelves is adjustable according to vertical positions of the respective pairs of slots.

5. The shelving assembly of claim 1, wherein the back edge of the least one shelf is recessed further into the niche than a front edge of the least one shelf, wherein the at least one shelf is angled within the niche such that the back edge of the at least one shelf is lower than the front edge of the at least one shelf.

6. The shelving assembly of claim 1, wherein the slots extend from a front region to a back region of the sidewalls, wherein a portion of the at least one shelf fits within one of the slots.

7. The shelving assembly of claim 1, wherein the at least one shelf is slidable within the pair of slots.

8. The shelving assembly of claim 1, wherein the at least one shelf has two side portions that each fit within and have complementary geometry to each respective slot, wherein the at least one shelf has a middle portion that extends between the two side portions.

9. The shelving assembly of claim 8, wherein the two side portions are thicker than the middle portion.

10. The shelving assembly of claim 8, wherein the middle portion includes a substantially flat top surface.

11. The shelving assembly of claim 10, wherein the middle portion includes an aperture and a container that extends at least partially through the aperture and beneath the flat top surface, wherein the container has at least one drain.

12. The shelving assembly of claim 11, wherein the container includes a hook extending from a surface of the container.

13. The shelving assembly of claim 10, wherein the middle portion includes at least one extension protruding from a surface of the middle portion, wherein at least one extension includes at least one of a hook and a loop configured to secure bathing accessories.

14. The shelving assembly of claim 8, wherein the middle portion includes a basket that extends beneath the two side portions, wherein the basket is at least one of perforated and mesh.

15. The shelving assembly of claim 1, wherein the niche fits between two studs within the wall of the bathing area.

16. A shelving assembly for use within a bathing area, comprising:

a niche configured to be recessed relative to a wall of the bathing area, wherein the niche includes a plurality of slots; and at least one generally planar shelf attachable to, removable from, and reattachable to the plurality of slots of the niche, wherein the plurality of slots are configured to receive and secure the at least one shelf, wherein the niche comprises two sidewalls that extend substantially vertically along a vertical length of the niche and a lower surface that extends between and connects a lower portion of the two sidewalls, wherein the lower surface of the niche has a front portion that is aligned with the wall of the bathing area and a back portion that is recessed relative to the wall of the bathing area, wherein the front portion and the back portion extend between the two sidewalls, wherein the front portion is lower than the back portion such that the lower surface of the niche is inclined;

wherein the plurality of slots are on the two sidewalls and the at least one shelf attaches with a pair of slots from the plurality of slots that are vertically aligned with each other, the wherein the at least one shelf has a front edge and a back edge, wherein the back edge is recessed further into the niche than the front edge, wherein the at least one shelf is inclined within the niche such that the back edge of the at least one shelf is lower than the front edge of the at least one shelf;

wherein the niche comprises a back wall that extends substantially vertically along the vertical length of the niche and extends between a back portion of the sidewalls, wherein the back edge of the at least one shelf is spaced apart from the back wall such that there is a gap between the back edge the at least one shelf and the back wall for liquid to flow through down to the lower surface which directs liquid away from the niche.

* * * * *